US005202225A

United States Patent [19]

Nakamine et al.

[11] Patent Number: 5,202,225

[45] Date of Patent: Apr. 13, 1993

[54] SILVER HALIDE PHOTOGRAPHIC MATERIALS WITH REDOX RELEASERS CONTAINING NUCLEOPHILIC GROUPS

[75] Inventors: Takeshi Nakamine; Takayuki Ito; Naoto Matsuda; Koki Nakamura; Hiroyuki Hirai, all of Kanagawa, Japan

[73] Assignee: Fuji Photo Film Co., Ltd., Kanagawa, Japan

[21] Appl. No.: 744,741

[22] Filed: Aug. 14, 1991

[30] Foreign Application Priority Data

Aug. 15, 1990 [JP] Japan ..... 2-215626

[51] Int. Cl.[5] ..... G03C 5/54; G03C 1/42; G03C 1/06

[52] U.S. Cl. ..... 430/566; 430/223; 430/564; 430/544; 430/611; 430/955; 430/957; 430/959

[58] Field of Search ..... 430/223, 955, 957, 564, 430/566, 611, 544, 959

[56] References Cited

U.S. PATENT DOCUMENTS

| | | | |
|---|---|---|---|
| H98 | 8/1986 | Yabuki et al. | 430/223 |
| 3,443,940 | 5/1969 | Bloom et al. | 430/223 |
| 4,358,532 | 11/1982 | Koyama et al. | 430/223 |
| 4,770,990 | 9/1988 | Nakamara et al. | 430/223 |

*Primary Examiner*—Richard L. Schilling
*Attorney, Agent, or Firm*—Sughrue, Mion, Zinn, Macpeak & Seas

[57] ABSTRACT

Disclosed is a silver halide photographic material comprising a support, having thereon at least one silver halide emulsion layer, wherein there is contained in the silver halide emulsion layer or other hydrophilic colloid layer a compound of which an oxidized form is produced in accordance with development of the silver halide and is capable of releasing a photographically useful group by means of a conjugated addition-elimination mechanism due to an intramolecular nucleophilic group attack.

5 Claims, No Drawings

SILVER HALIDE PHOTOGRAPHIC MATERIALS WITH REDOX RELEASERS CONTAINING NUCLEOPHILIC GROUPS

FIELD OF THE INVENTION

This invention concerns silver halide photographic materials, and, in particular, it concerns silver halide photographic materials which contain compounds which release photographically useful groups imagewise during the course of development processing.

BACKGROUND OF THE INVENTION

Hydroquinone derivatives which release development inhibitors (so-called DIR-hydroquinones) in accordance with the density of the image during development, or hydroquinone derivatives which release silver halide solvents in accordance with the density of the image during development, or sulfonamidophenol derivatives or hydroquinone derivatives which release diffusible dyes in accordance with the amount of silver developed during development are generally known compounds which release photographically useful groups in accordance with the density of the image during development.

The compounds disclosed, for example, in U.S. Pat. Nos. 3,379,529, 3,620,746, 4,377,634 and 4,332,878, JP-A-49-129536, JP-A-56-153336 and JP-A-56-153342 such known of DIR-hydroquinones. (The term "JP-A" as used herein signifies an "unexamined published Japanese patent application".) The compounds disclosed in U.S. Pat. No. 4,459,351 known hydroquinone derivatives which release silver halide solvents. Furthermore, the compounds disclosed in U.S. Pat. Nos. 3,698,897 and 3,725,062 known hydroquinone derivatives which release diffusible dyes. The compounds disclosed, for example, in Yuki Gosei Kagaku Kyokaishi 39, 331 (1981), Kagaku no Ryoiki, 39, 617 (1981), Kino Zairyo, 3, 66 (1983), Photographic Science and Engineering, 20, 155 (1976), Angew. Chem. Int. Ed. Eng., 22, 191 (1983), Yuki Gosei Kagaku Kyokaishi 40, 176 (1982) and Monthly Reports of the Japanese Chemical Society 35, (11), 29 (1982) give known examples of sulfonamidophenol derivatives.

The applications of the compounds indicated above are diverse, depending on the photographic effect of the photographically useful group which is released. However, the functions which are required at the redox nuclei at which the redox reactions occur upon which release of the photographically useful groups take place have many common areas. Thus, the importance of obtaining high quality photographs quickly, easily and in a stable manner has increased and the aforementioned compounds have had to meet these objectives or they have been used for their supplementary action. The common performance required at the redox nuclei of the above mentioned compounds is such that the photographically useful groups can be released efficiently in a short period of time.

The performance which is required at these redox nuclei is described in detail below. First, the rate of the cross-oxidation reaction with the oxidized form of the developing agent or auxiliary developing agent which is formed during development, or the rate at which it reduces the silver halide or other silver salt directly to form the oxidized form, must be sufficiently high so that these redox nuclei exhibit adequate activity during development processing. Secondly, the rate at which the photographically useful groups are released from the oxidized forms of the redox nuclei which have been formed in this way should be high, and release must take place efficiently.

Now, the first criteria mentioned above is satisfied satisfactorily by the known compounds disclosed in the references mentioned above, but the second point, namely the rate at which the photographically useful groups are released from the redox nucleus, and the efficiency, is unsatisfactory with the known compounds disclosed in the references mentioned above, and it is thought that the color forming function could be greatly accelerated if the release rate and the efficiency could be improved.

SUMMARY OF THE INVENTION

The aim of this present invention is to provide silver halide photographic materials which contain photographically useful reagents which release photographically useful groups rapidly and efficiently after oxidation in the course of development processing.

On studying compounds which release photographically useful groups in proportion to the density of the image during development, the present inventors discovered that the compounds which release photographically useful groups via a conjugated addition-elimination mechanism with an intramolecular nucleophilic group attack display a remarkable function.

In general, the bond by which the photographically useful group is linked to the oxidized form of the redox nucleus is broken at the stage at which the photographically useful group is released from the redox nucleus. For this bond to be broken, a nucleophilic substance, such as hydroxide ion for example, which is present during development is added to the carbon atom to which the photographically useful group is bonded as a first step and, then, this is followed by a second step in which the bond between the photographically useful group and the carbon to which is bound is broken, but it is observed that the rate and efficiency of both of these steps are inadequate.

As a result of thorough research, the present inventors have discovered that compounds which release photographically useful groups by means of a conjugated addition-elimination reaction due to intramolecular nucleophilic group attack with the oxidized form of the redox nucleus are such that the breaking of the bond between the redox nucleus and the photographically useful group occurs with surprisingly high speed and high efficiency and the photographically useful group is released.

The general conjugated addition-elimination mechanism is indicated schematically below.

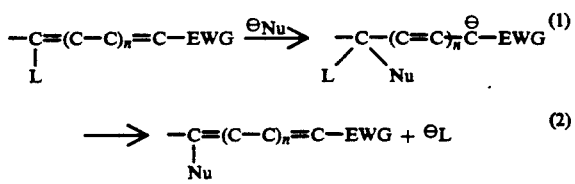

(In these equations, EWG represents an electron withdrawing group, L represents a leaving group, ⊖Nu represents a nucleophilic substance and n represents an integer of value 0 or more.)

In stage (1), the nucleophilic substance ⊖Nu attacks and adds on to the carbon atom to which the leaving group L in the conjugated system is bound, and then in stage (2) the reaction in which ⊖L is eliminated takes place.

An intramolecular nucleophilic group fulfills the role of the nucleophilic substance in these equations in this present invention. That is to say, it has been discovered that the aforementioned reaction for breaking the bond which links the photographically useful group to the oxidized form of the redox nucleus occurs with a surprisingly high speed and high efficiency, and the photographically useful group is released, in compounds of this present invention in which the reaction occurs by way of a conjugated addition-elimination mechanism due to an intramolecular nucleophilic group attack.

This present invention is realized on the basis of such findings and is a silver halide photographic material which contains in the silver halide emulsion layers or other hydrophilic colloid layers a compound which releases a photographically useful group by means of a conjugated addition-elimination mechanism due to an intramolecular nucleophilic group attack from the oxidized form which is produced in accordance with the development of the silver halide.

The preferred compounds in this present invention can be represented by the general formulae (I-1) or (I-2) which are indicated below.

General Formula (I-1)

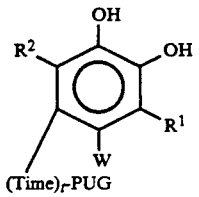

General Formula (I-2)

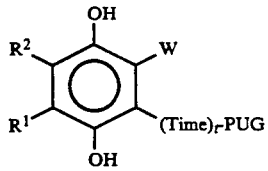

In general formulae (I-1) and (I-2), Time represents a timing group and t represents 0 or 1. PUG represents a photographically useful group.

W represents a group which is nucleophilic which is represented by —Y—X—H wherein Y represents a divalent linking group, X represents $$-\overset{\overset{R^3}{|}}{N}-$$

(where $R^3$ represents a hydrogen atom, an alkyl group, an aryl group, a heterocyclic group or an acyl group), —O— or —S—.

$R^1$ and $R^2$ are the same or different and each represent a hydrogen atom, a halogen atom, a cyano group, a carboxyl group, a sulfo group, a nitro group, an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, an acyl group, a heterocyclic group or -(Time)$_t$-PUG.

In general formula (I-2), $R^1$ and $R^2$ may be joined together to form a carbocyclic or heterocyclic ring.

DETAILED DESCRIPTION OF THE INVENTION

General formulae (I-1) and (I-2) are described in detail below.

$R^1$ and $R^2$ can be the same or different and preferably represent hydrogen atoms, halogen atoms (for example, fluorine, chlorine, bromine, iodine), cyano groups, carboxyl groups, sulfo groups, nitro groups, alkyl groups which have from 1 to 30 carbon atoms (including substituted groups, for example, methyl, ethyl, isopropyl, 2-decyl, t-octyl, octadecyl, benzyl, vinyl, 3-ethoxycarbonylpropyl), aryl groups which have from 6 to 30 carbon atoms (including substituted groups, for example, phenyl, 3-chlorophenyl, 4-cyanophenyl, naphthyl), alkylthio groups which have from 1 to 30 carbon atoms (including substituted groups, for example, methylthio, ethylthio, n-octylthio, 2-octylthio, dodecylthio, 1-ethoxycarbonyl-1-decylthio, 2-cyanoethylthio), arylthio groups which have from 6 to 30 carbon atoms (including substituted groups, for example, phenylthio, 4-chlorophenylthio, 2-n-octyloxy-5-tert-octylphenylthio, 4-tert-butylphenylthio, 1-naphthylthio), alkoxy groups which have from 1 to 30 carbon atoms (including substituted groups, for example, methoxy, ethoxy, allyloxy, 2-propyloxy, octadecyloxy, benzyloxy), aryloxy groups which have from 6 to 30 carbon atoms (including substituted groups, for example, phenoxy, 4-chlorophenoxy, 4-acetylaminophenoxy, 2-acetylamino-4-butanesulfonylphenoxy, 3-cyanophenoxy, 3-dodecyloxyphenoxy, 3-pentadecylphenoxy), amino groups which have from 1 to 30 carbon atoms (including substituted groups, for example, dimethylamino, diethylamino, n-hexylamino, cyclohexylamino, bis(2-cyanoethyl)amino), amido groups which have from 1 to 30 carbon atoms (including substituted groups, for example, acetylamino, chloracetylamino, trifluoroacetylamino, dodecenylsuccinimido, 2-hexadecenyl-3-carboxypropionylamino, pivaloylamino, 2-(2,4-di-tert-pentylphenoxy)butyroylamino), sulfonamido groups which have from 1 to 30 carbon atoms (including substituted groups, for example, benzenesulfonylamino, 4-chlorophenylsulfonylamino, N-methyl-4-methoxyphenylsulfonylamino, methanesulfonylamino, n-octanesulfonylamino, 4-methylphenylsulfonylamino), alkoxycarbonylamino groups which have from 1 to 30 carbon atoms (including substituted groups, for example, ethoxycarbonylamino, ethoxycarbonyl-N-methylamino, N-ethylphenoxycarbonylamino, isobutyloxycarbonylamino, benzyloxycarbonylamino), ureido groups which have from 1 to 30 carbon atoms (including substituted groups, for example, 3,3-diethylureido, 3-cyclohexylureido, morpholinocarbonylamino, 3-(4-cyanophenyl)ureido, 3-n-octyl-1-methylureido, 1,3-diphenylureido), carbamoyl groups which have from 1 to 30 carbon atoms (including substituted groups, for example, methylcarbamoyl, ethylcarbamoyl, butylcarbamoyl, 4-methoxyphenylcarbamoyl, 3-(2,4-di-tert-pentylphenoxy)propylcarbamoyl, pyrrolidinocarbonyl, hexadecylcarbamoyl, di-n-octylcarbamoyl), alkoxycarbonyl groups which have from 1 to 30 carbon atoms (including substituted groups, for example, methoxycarbonyl, ethoxycarbonyl, phenoxycarbonyl, hexadecyloxycarbonyl), sulfamoyl groups which have from 1 to 30 carbon atoms (including substituted groups, for example, methylsulfamoyl, diethylsulfamoyl, 3-(2,4-di-tert-pentylphenoxy)propylsulfamoyl, N-methyl-N-octadecylsulfamoyl, bis(2-methoxyethyl)sulfamoyl, 3-chlorophenylsulfamoyl, morpholinosulfonyl), sulfonyl groups which have from 1 to 30 carbon atoms (including substituted groups, for example, methanesulfonyl, propylsulfonyl, dodecylsulfonyl, 4-methylphenylsulfonyl, 2-ethoxy-5-tertbutyl-phenylsulfonyl, 2-carboxyphenylsulfonyl), acyl groups which have from 1 to 30 carbon atoms (including substituted groups, for example, acetyl, trichloroacetyl, 2-phenoxypropionyl, benzoyl, 3-acetylaminobenzoyl), heterocyclic groups which have from 1 to 30 carbon atoms (including substituted groups, for example, 1-tetrazolyl, 1,2,4-triazol-1-yl, 5-nitroindazol-1-yl, 5-methylbenzotriazol-1-yl, benzoxazol-2-yl), or -(Time)$_t$-PUG. Particularly preferred examples of $R^1$ and $R^2$ are an alkyl group, an amido group and an alkylthio group.

W represents a group which has nucleophilic properties represented by —Y—X—H. Here, Y represents a divalent linking group, for example, an alkylene group, an alkynylene group, an arylene group, a divalent heterocyclic group, —O—, —S—, imino, —COO—, —CONR$^8$—,

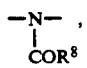

—NHCONR$^8$—, —NHCOO—, —SO$_2$NH—, —CO—, —SO$_2$—, —SO—, —NHSO$_2$NH— or a group comprised of these groups. X represents

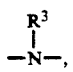

—O— or —S—. $R^3$ and $R^8$ represent hydrogen atoms, alkyl groups (which may be substituted, preferably having 1 to 30 carbon atoms, for example, methyl, ethyl), aryl groups (which may be substituted, preferably having 6 to 30 carbon atoms, for example, phenyl, 3-chlorophenyl), heterocyclic groups (which may be substituted, preferably having 5 to 30 carbon atoms, for example, 1-tetrazolyl, 2-furyl), or acyl groups (for example, acetyl, benzoyl).

In general formula (I-2), $R^1$ and $R^2$ may be joined together to form a carbocyclic or heterocyclic ring.

The preferred compounds of general formulae (I-1) and (I-2) are compounds in which the total number of atoms in the linear chain parts which are included in Y and X, excluding them terminal hydrogen atoms therein, in group W is from 3 to 8.

The most desirable compounds of general formulae (I-1) and (I-2) are compounds in which W can be represented by the formulae indicated below.

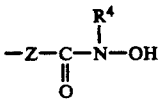

(i)

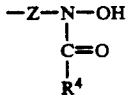

(ii)

Here, $R^4$ represents an alkyl group, an aryl group or a heterocyclic group, and typical examples and preferred examples are the same as those described earlier for $R^3$ and $R^8$. Z is a divalent group (for example,

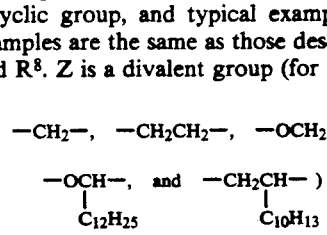

and most desirably an alkylene group which has from 1 to 30 carbon atoms, or an oxyalkylene group. In the case of formulae (i) and (ii), for purposes of the present invention, the number of atoms in the linear chain part is considered to be the number of atoms counted in the chain series Z—C—N—O in (i) and the number of atoms counted in the chain series Z—N—C—O in (ii). For example, in the case of the group

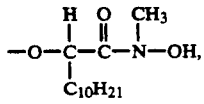

the number of atoms in the linear chain part is considered as five, namely —O—C—C—N—O—.

(Time)$_t$-PUG is described below. Time represents a timing group and t represents 0 or 1. When t is 0 this indicates that the PUG is bonded directly to the nucleus, and in cases in this application where "t" is 2 or more this indicates combinations of two or more Time groups which may be the same or different.

The timing group adjusts timing for PUG release after generation of an oxidized form of the compound of the formula (I-1) or (I-2). Since the desired timing for PUG release varies depending on kinds of the PUG, photosensitive material, and processing, etc., the timing group is selected depending on each system.

Examples of the timing group Time are described below.

(1) Groups with which a Hemi-acetal Cleavage Reaction is Used

The groups disclosed, for example, in U.S. Pat. No. 4,146,396, JP-A-60-249148 and JP-A-60-249149, and the groups represented by the general formula (T-1) indicated below. Here, * indicates the position which is bonded to the left hand side in general formula (I), and ** indicates the position which is bonded to PUG.

General Formula (T-1)

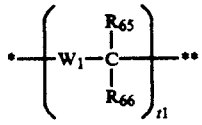

In this formula, $W_1$ represents an oxygen atom, a sulfur atom or an

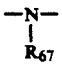

group, $R_{65}$ and $R_{66}$ represent hydrogen atoms or substituent groups, $R_{67}$ represents a substituent group and $t_1$ represents 1 or 2. When $t_1$ is 2 the two

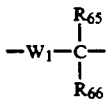

groups may be the same or different. Typical examples of $R_{65}$ and $R_{66}$ when they represent substituent groups, and $R_{67}$, include $R_{69}$, $R_{69}CO$—, $R_{69}SO_2$—,

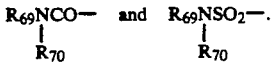

Here, $R_{69}$ represents an aliphatic group, an aromatic group or a heterocyclic group and $R_{70}$ represents a hydrogen atom, an aliphatic group, an aromatic group, a heterocyclic group or a hydrogen atom. Those cases in which $R_{65}$, $R_{66}$ and $R_{67}$ each represent divalent groups which are joined together to form ring structures are also included. Actual examples of groups represented by the general formula (T-1) are indicated below.

1) 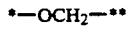

2) 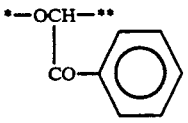

3) 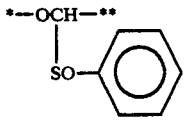

4) 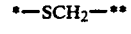

5) 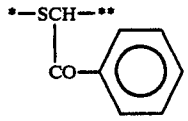

6) 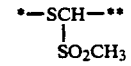

7) 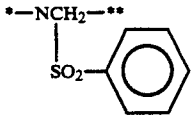

8) 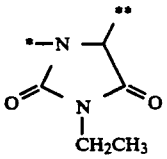

9) 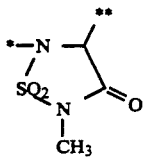

(2) Groups with which a Cleavage Reaction Occurs via an Intramolecular Nucleophilic Substitution Reaction For example, the timing groups disclosed in U.S. Pat. No. 4,248,962. These can be represented by the following general formula:

General Formula (T-2)

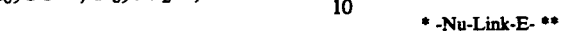

In this formula, * represents the position which is bonded to the left hand side in general formula (I),  represents the position which is bonded to PUG, and Nu represents a nucleophilic group, where the oxygen and sulfur atoms are examples of nucleophilic species, E represents an electrophilic group, being a group which is subjected to nucleophilic attack by Nu and with which the bond marked  can be cleaved, and Link is a linking group which enables Nu and E to have a steric arrangement such that an intramolecular nucleophilic substitution reaction can occur. Actual examples of groups represented by general formula (T-2) are indicated below.

1) 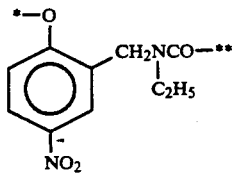

2) 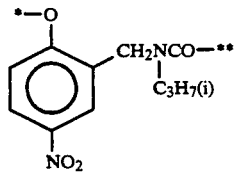

3) 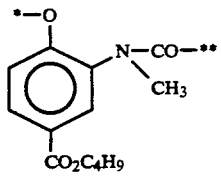

4) 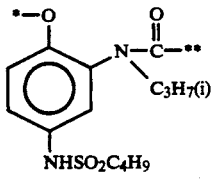

5) 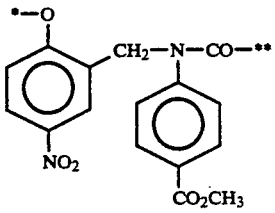

-continued

6)

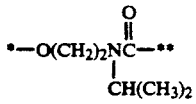

7)

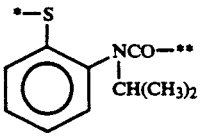

8)

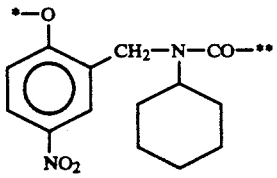

(3) Groups in which a Cleavage Reaction Occurs via an Electron Transfer Reaction along a Conjugated System For example, those disclosed in U.S. Pat. Nos. 4,409,323 and 4,421,845, and the groups represented by the general formula (T-3).

General Formula (T-3)

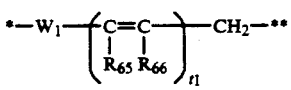

In this formula, *, **, $W_1$, $R_{65}$, $R_{66}$ and $t_1$ all have the same significance as described in connection with (T-1).

Actual examples of (T-3) are indicated below.

1)

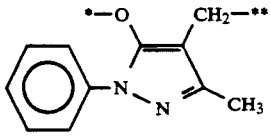

2)

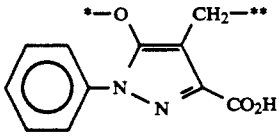

3)

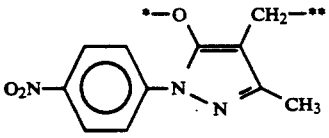

4)

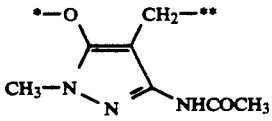

5)

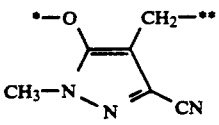

-continued

6)

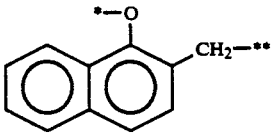

7)

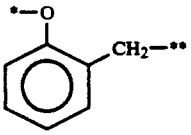

8)

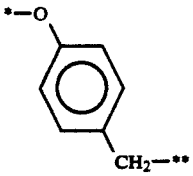

9)

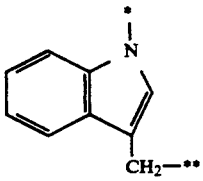

10)

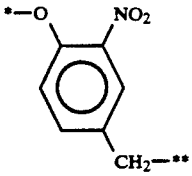

(4) Groups with which a Cleavage Reaction due to Ester Hydrolysis is Used

For example, the linking groups disclosed in West German Patent laid open 2,626,315, and the groups indicated below. In these formulae, * and ** have the same significance as described in connection with general formula (T-1).

General Formula (T-4)

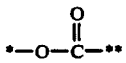

General Formula (T-5)

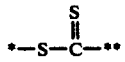

(5) Groups with which an Iminoketal Cleavage Reaction is Used

For example, the linking groups disclosed in U.S. Pat. No. 4,546,073, and the groups represented by the general formula indicated below.

General Formula (T-6)

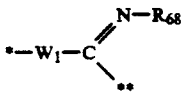

In this formula, *, **, and $W_1$ have the same significance as described in connection with general formula (T-1) and $R_{68}$ has the same significance as $R_{67}$. Actual examples of groups represented by general formula (T-6) are indicated below.

1) 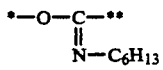

2) 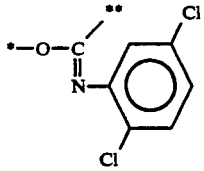

3) 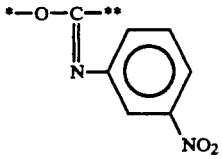

4) 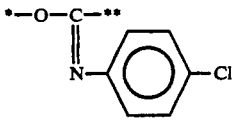

5) 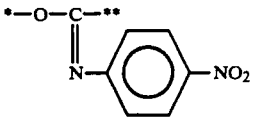

-continued

6) 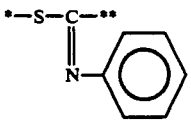

Again, in the present invention, PUG is a photographically useful group.

Examples of photographically useful groups include development inhibitors, development accelerators, fogging agents, couplers, coupler releasing couplers, diffusible and non-diffusible dyes, desilvering accelerators, silver halide solvents, competitive compounds, developing agents, auxiliary developing agents, fixing accelerators, fixing inhibitors, image stabilizers, toners, processing dependance improvers, screen dot improvers, dye stabilizers, dyes for photographic purposes, surfactants, film hardening agents, ultraviolet absorbers, fluorescent whiteners, desensitizing agents, contrast increasing agents and chelating agents, and precursors or these groups.

Actual examples of these photographically useful groups include the compounds disclosed from the lower left column on page 14 to the lower right column on page 29 of JP-A-61-236549 (which corresponds to U.S. Pat. No. 4,770,990).

Actual examples of PUG releasing compounds which can be used in this present invention are indicated below, but the compounds of this present invention are not limited by these following examples.

(1) 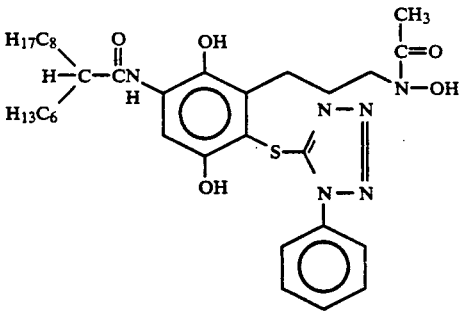

(2) 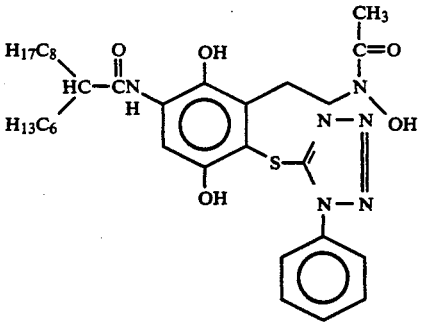

(3) 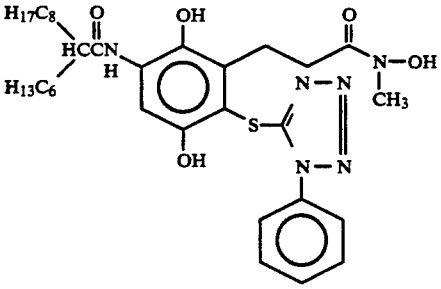

(4) 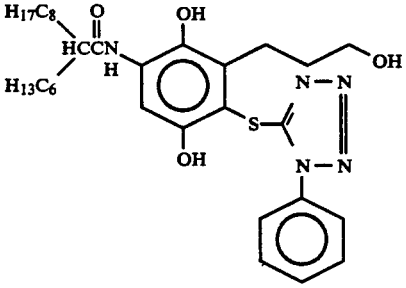

-continued
(5)
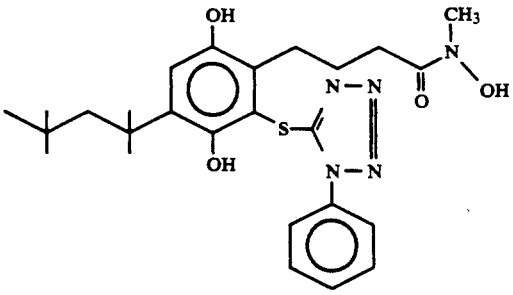
(6)
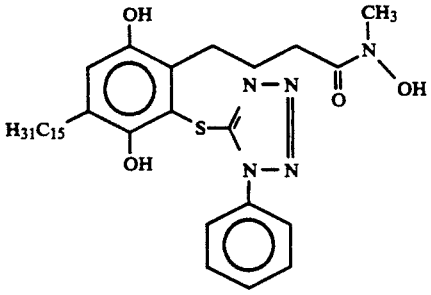
(7)
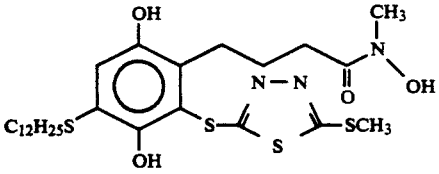
(8)
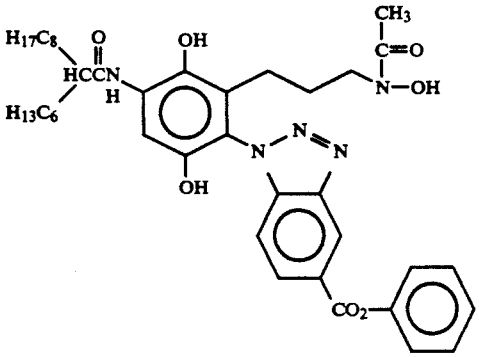
(9)
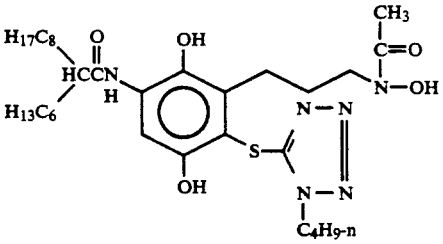
(10)
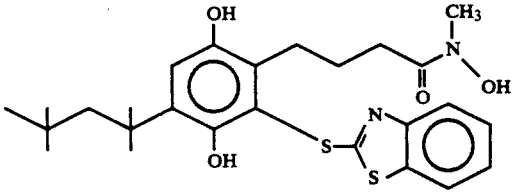
(11)
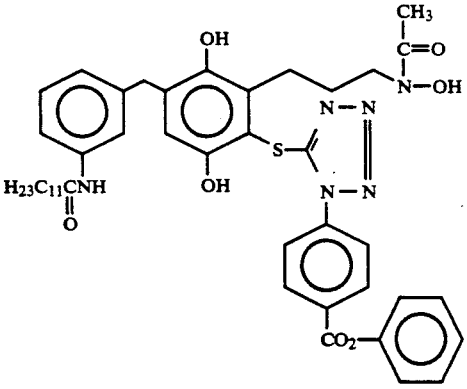
(12)
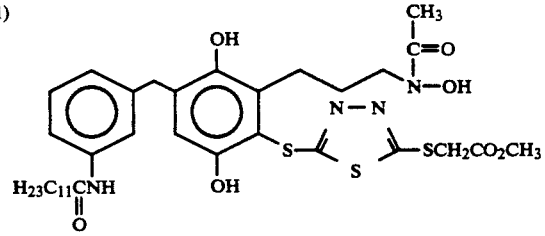
(13)
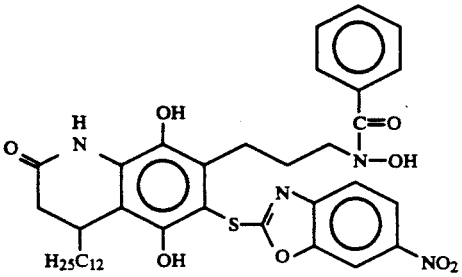
(14)
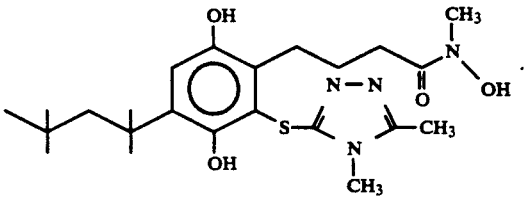

-continued
(15)
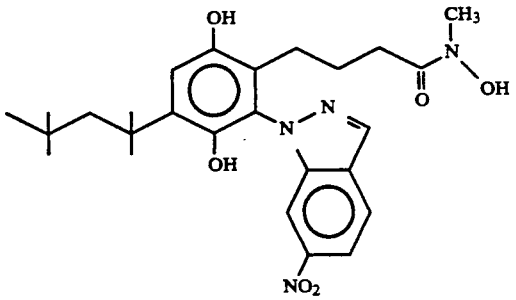
(16)
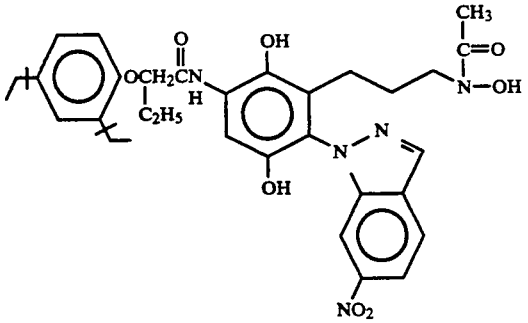
(17)
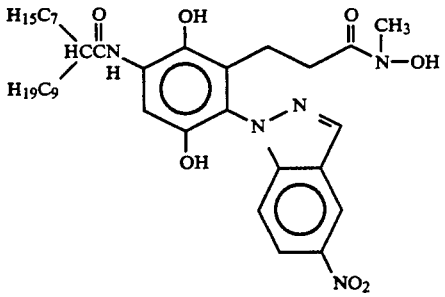
(18)
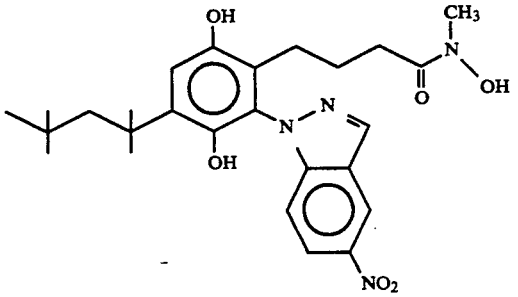
(19)
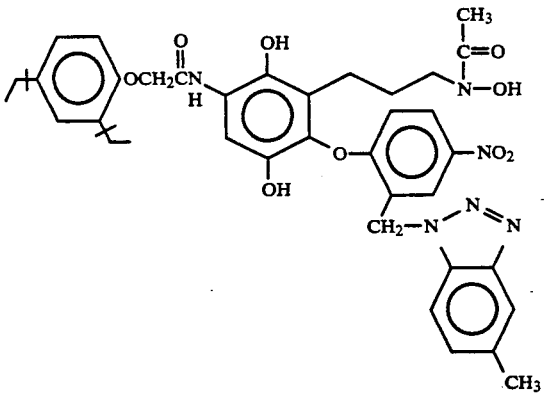
(20)
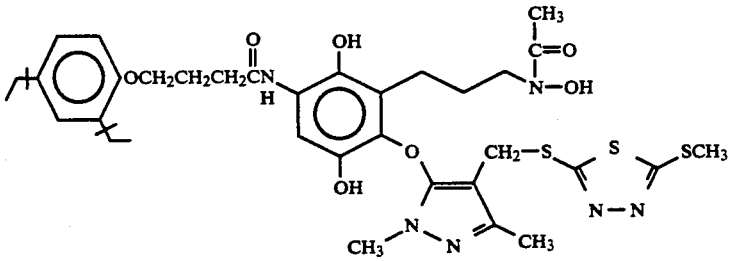

-continued
(21)
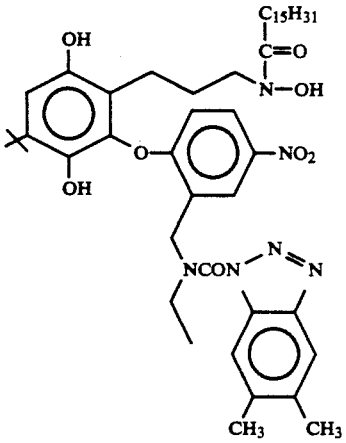
(22)
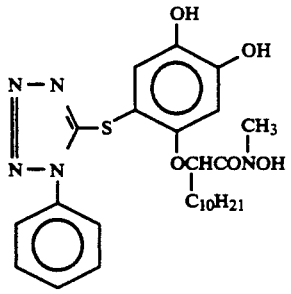
(23)
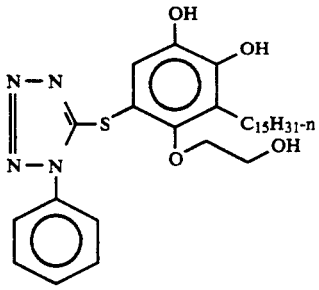
(24)
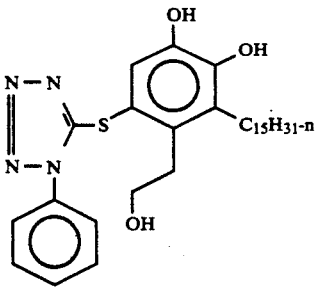
(25)
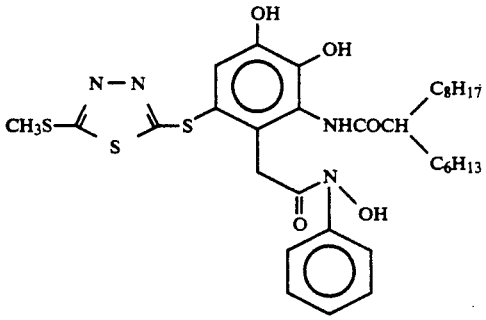
(26)
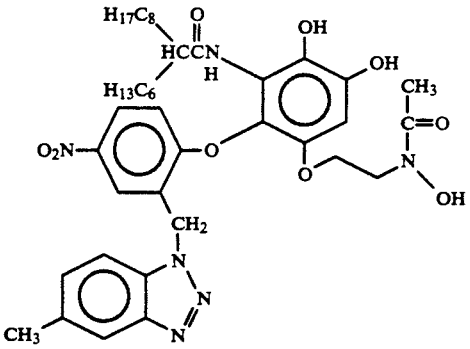
(27)
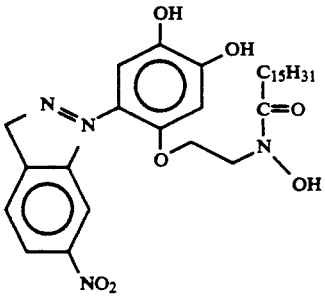
(28)
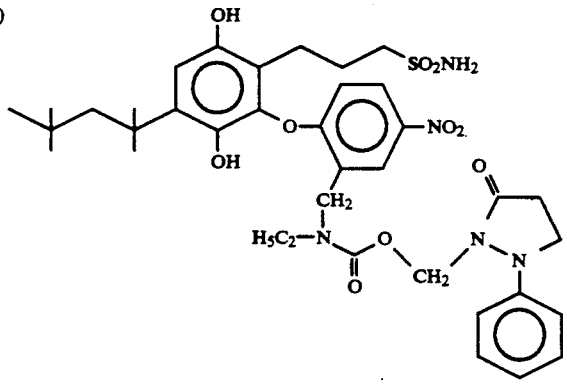

-continued
(29)
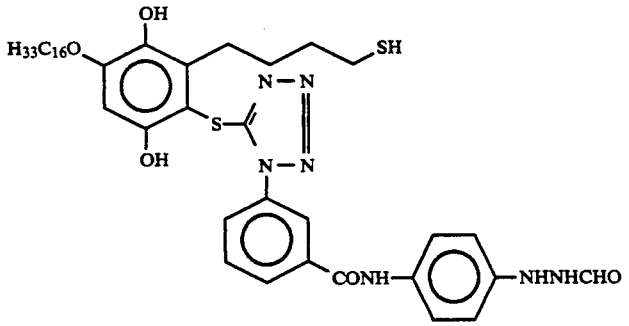
(30)
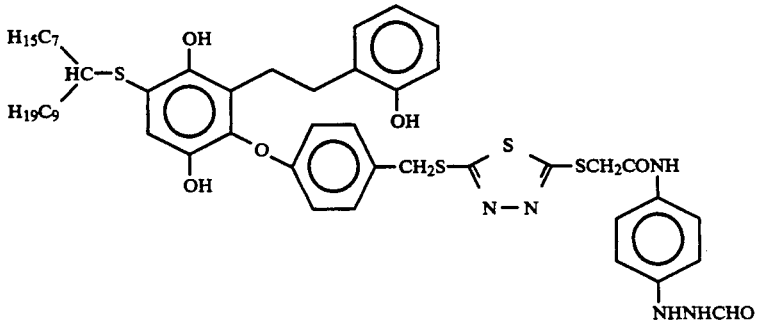
(31)
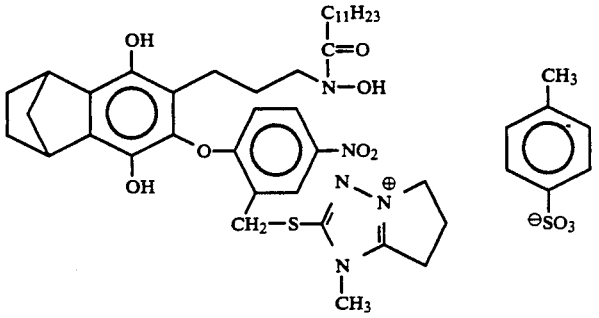
(32)
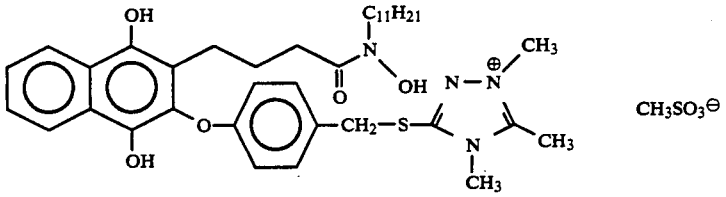
(33)
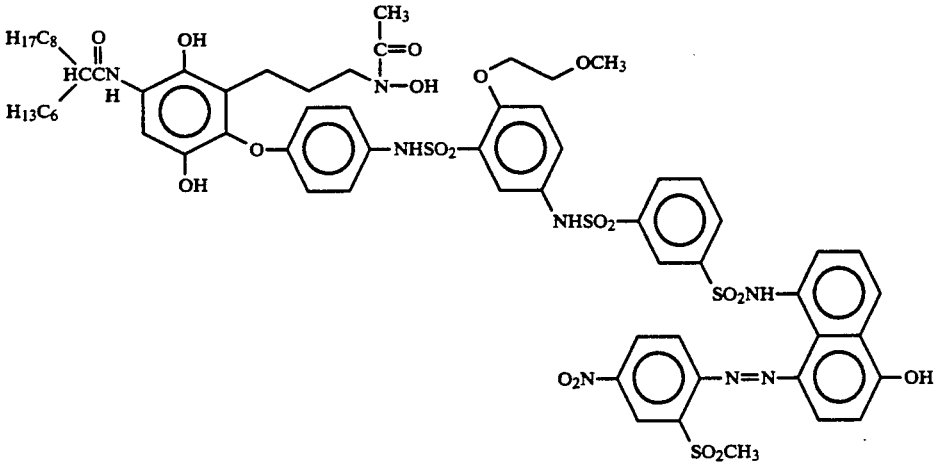

-continued
(34)
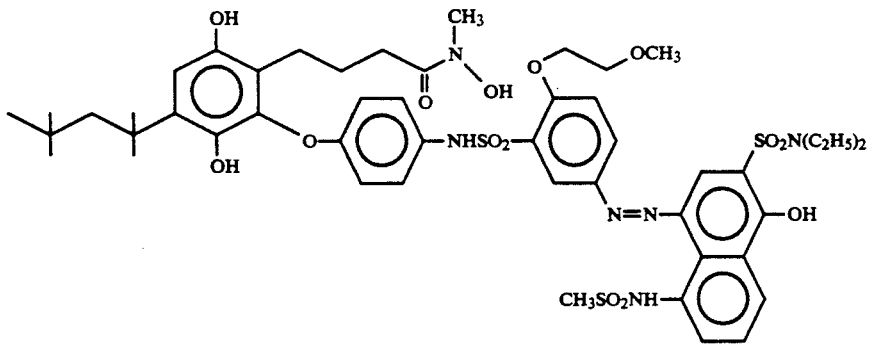
(35)
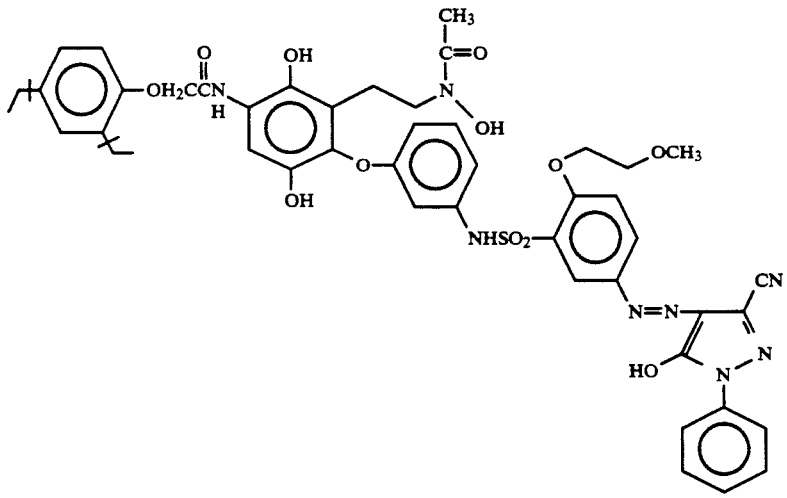
(36)
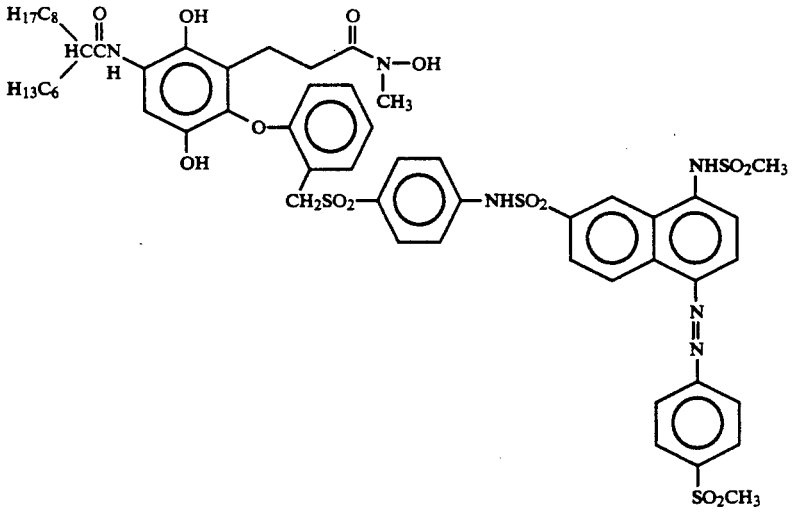

-continued
(37)
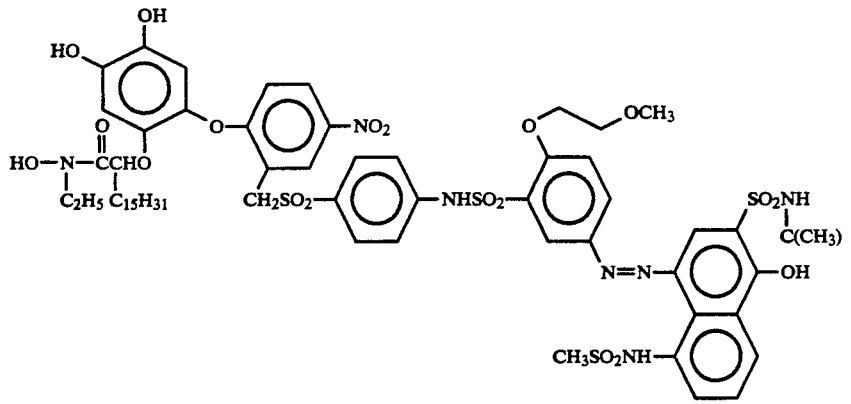
(38)
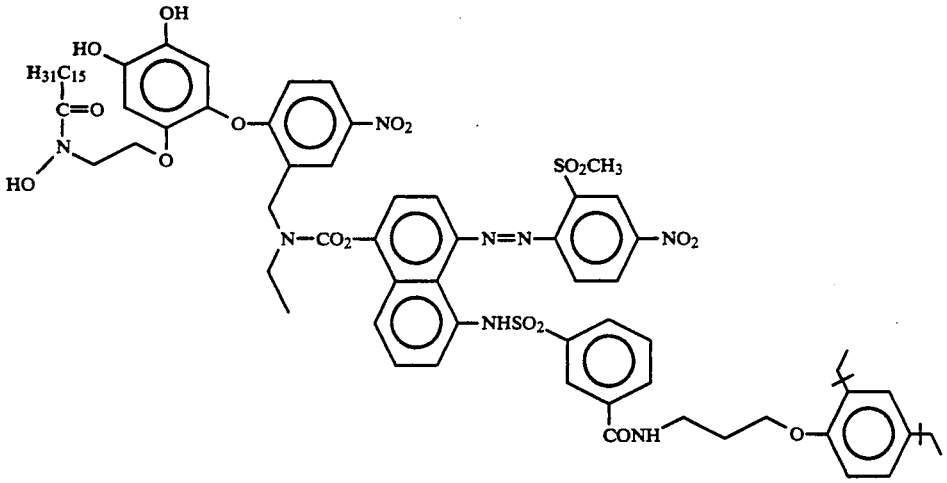
Examples of Synthesis
Methods for the preparation of illustrative PUG releasing compounds (1), (5) and (22) of this present invention are described below. Other PUB releasing compounds of the present invention can also be prepared using similar methods.
1. The Synthesis of Compound (1)
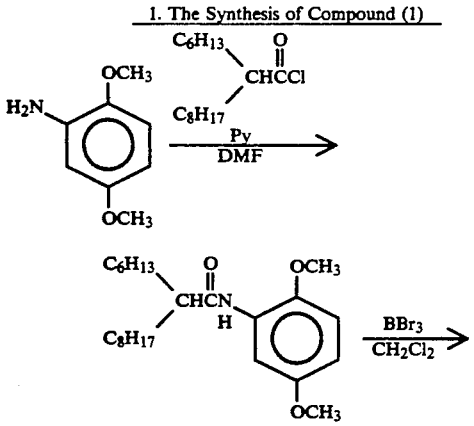
(1-A)
-continued
1. The Synthesis of Compound (1)
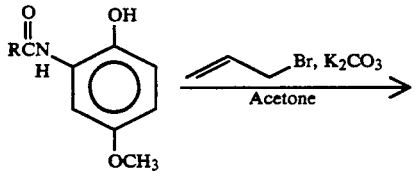
(1-B)
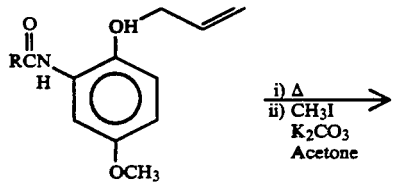
(1-C)
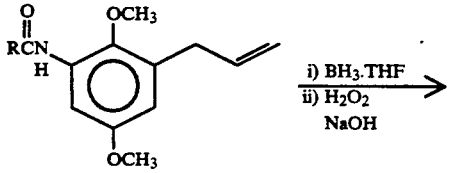
(1-D)

-continued

1. The Synthesis of Compound (1)

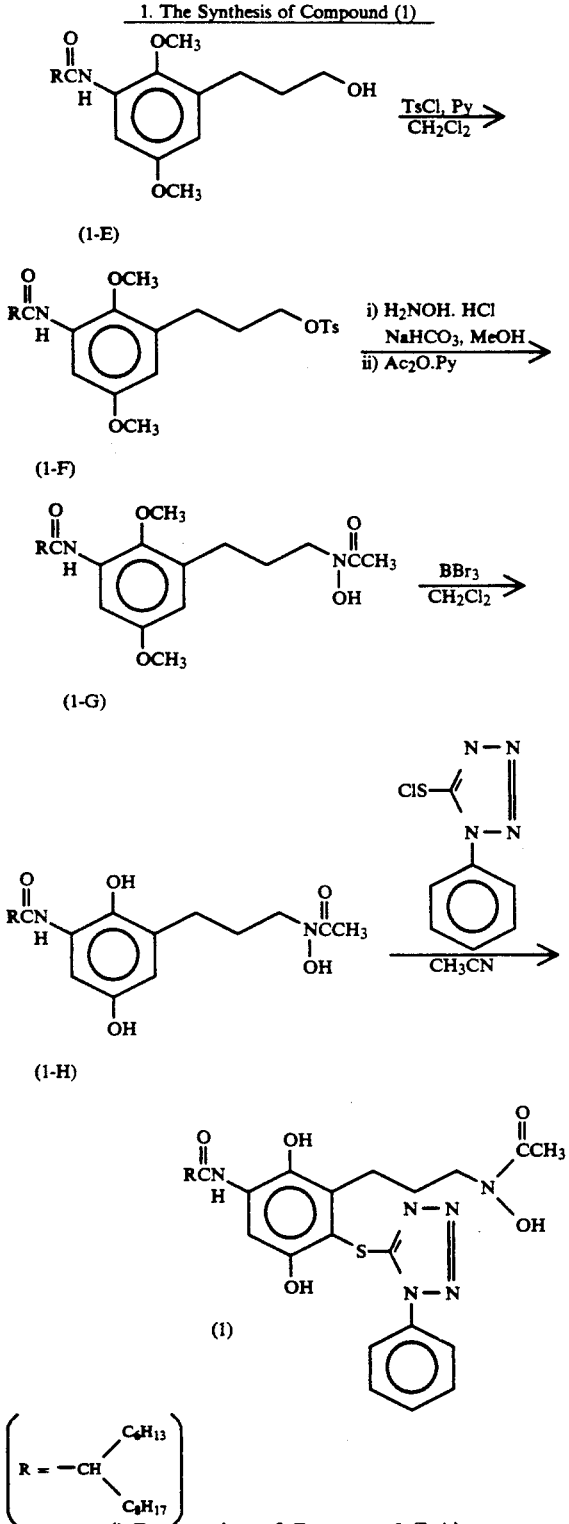

i) Preparation of Compound (I-A)

2,5-Dimethoxyaniline (160 grams, 1.04 mol) was dissolved in 1.5 liters of DMF and cooled to 0° C. Pyridine (89 ml, 1.1 mol) was added to this solution and then 300 grams (1.09 mol) of 2-hexadecanoic acid chloride was added dropwise in such a way that the temperature did not exceed 10° C. after stirring for 30 minutes at room temperature, the reaction liquid was poured slowly into 4.5 liters of water and crystals were obtained. The crystals were isolated using suction filtration and dried after washing thoroughly with water, and 360 grams of compound (1-A) was obtained for a yield of 92%.

i) Preparation of Compound (1-B)

Boron tribromide (73 ml, 0.77 mol) was dripped into 1.5 liters of a dichloromethane solution of 300 grams (0.766 mol) of compound (1-A) at a temperature of between 5° C. and 10° C. After stirring the reaction liquid for a further 30 minutes at 10° C., 50 ml of water was slowly added dropwise to decompose the excess boron tribromide. The reaction liquid was then washed with 1.5 liters of dilute hydrochloric acid and 1.5 liters of salt water, after which the organic layer was dried over magnesium sulfate. After removing the magnesium sulfate by filtration, the dichloromethane was removed by distillation under reduced pressure and 281 grams of the compound (1-B) was obtained for a Crude yield of 97%.

iii) Preparation of Compound (1-C)

A mixture of 56.6 grams (0.15 mol) of compound (1-B), 23 grams (0.17 mol) of potassium carbonate, 14.4 ml (0.17 mol) of allyl bromide, 1.5 ml of tris-(methoxyethoxyethylamine) and 280 ml of acetone was heated under reflux for 6 hours. The reaction mixture was extracted with 750 ml of ethyl acetate and 750 ml of water and, after washing the organic layer with 500 ml each of 1N sodium hydroxide solution, water and salt water, it was dried over magnesium sulfate. After removing the magnesium sulfate by filtration, the organic solvent was removed by distillation under reduced pressure and 55 grams of compound (1-C) (oil) was obtained for a Crude yield of 89%.

iv) Preparation of Compound (1-D)

Compound (1-C) (55 grams, 132 mmol) was stirred for 30 minutes at 200° C. under a blanket of nitrogen. After cooling, the mixture was refined using a column and 38 grams (91 mmol) of the Claisen rearrangement product was obtained. A mixture of 38 grams (91 mmol) of the Claisen rearrangement product, 14 grams (0.1 mol) of potassium carbonate, 30 ml (0.48 mol) of methyl iodide and 200 ml of acetone was heated under reflux for 5 hours. After cooling, the reaction liquid was extracted with 600 ml of ethyl acetate and 600 ml of water. The organic layer was washed with 300 ml each of 1N hydrochloric acid, water and salt water and dried over magnesium sulfate. After removing the magnesium sulfate by filtration, the organic solvent was removed by distillation under reduced pressure and 38 grams of compound (1-D) was obtained for a Crude yield of 67% (two steps from (1-C)).

v) Preparation of (1-E)

A 1M THF solution of borane-THF complex (45 ml) was drip fed into 150 ml of a THF solution of 32 grams (0.074 mol) of (1-D) at room temperature under a blanket of nitrogen. After stirring at room temperature of 2 hours, 15 ml of 3N aqueous NaOH was added dropwise and then 15 ml of a 30% aqueous hydrogen peroxide solution was added dropwise at a temperature of not more than 60° C. After stirring for 30 minutes at room temperature, the reaction liquid was poured into 500 ml of water and extracted with 500 ml of ethyl acetate. The organic layer was washed with salt water and then dried over magnesium sulfate. After removing the magnesium sulfate by filtration, the organic solvent was removed by distillation under reduced pressure and 30 grams of compound (1-E) was obtained for a Crude yield of 90.0% iv) Preparation of (1-F)

A liquid mixture of 30 grams (0.067 mol) of compound (1-E), 15 grams (0.079 mol) of p-toluenesulfonic acid chloride, 6.4 ml (0.079 mol) of pyridine and 150 ml of dichloromethane was stirred at room temperature for 48 hours. Next 150 ml of dichloromethane was added to the reaction liquid and then the reaction liquid was washed with 200 ml each of dilute aqueous hydrochloric acid, water and salt water and then the organic layer was dried by adding magnesium sulfate. The magnesium sulfate was then removed by filtration, and the organic solvent was removed by distillation under reduced pressure and the crude product (1-F) was obtained. This product was refined by column chromatography and 21 grams of compound (1-F) was obtained as a pure product for a yield of 52%.

vii) Preparation of Compound (1-G)

A mixture of 20 grams (0.033 mol) of compound (1-F), 95 grams (1.35 mol) of hydroxylamine hydrochloride, sodium bicarbonate (1.35 mol) and 400 ml of methanol was heated under reflux for 2 hours. After cooling, 1 liter of water was added to the reaction liquid and the mixture was extracted with 1 liter of ethyl acetate. Acetic anhydride (25 ml) and 25 ml of pyridine were added to the organic layer at room temperature and the mixture was stirred for 30 minutes. The reaction liquid was then washed with 1 liter each of dilute aqueous hydrochloric acid, aqueous sodium bicarbonate solution and salt water, after which magnesium sulfate was added and the organic layer was dried. After removing the magnesium sulfate by filtration, the solvent was removed by distillation under reduced pressure and 13.4 grams of compound (1-G) was obtained by refining by means of column chromatography for a yield of 80.0%.

viii) Preparation of Compound (1-H)

Boron tribromide (13 ml, 138 mmol) was drip fed at 10° C. into a dichloromethane solution of 13.4 grams (26.4 mmol) of compound (1-G). After stirring for 30 minutes, 50 ml of water was dripped slowly and the excess boron tribromide was decomposed and then 100 ml of dilute hydrochloric acid was added. After extracting with 200 ml of ethyl acetate, the organic layer was washed with aqueous salt solution, magnesium sulfate was added and the organic layer was dried. After removing the magnesium sulfate by filtration, the solvent was removed by distillation under reduced pressure and 10 grams of the compound (1-H) was obtained by refining the residue using column chromatography for a yield of 79.0%.

ix) Preparation of Compound (1)

Sulfuryl chloride (4.5 grams, 0.056 mol) was added dropwise at 10° C. to a mixture comprised of 10 grams (0.056 mol) of 1-phenyl-5-mercaptotetrazole and 100 ml of dichloromethane: The reaction mixture was then stirred for 2 hours at room temperature, after which the low boiling point compounds were removed by distillation under reduced pressure at a temperature of from 30° C. to 40° C. and 1-phenyltetrazol-5-sulfenyl chloride was obtained.

The 1-phenyltetrazol-5-sulfenyl chloride (5.3 grams, 0.025 mol) so obtained was added slowly at room temperature to 100 ml of a THF solution 10 grams (0.021 mol) of compound (1-H). After stirring for 30 minutes at room temperature, the mixture was extracted with 300 ml of ethyl acetate and 300 ml of water and the organic layer was dried with magnesium sulfate. The organic solvent was removed by distillation under reduced pressure and then 8.3 grams of compound (1) as final product was obtained by recrystallization from 100 ml of ethyl acetate for a yield of 60%, Melting Point 180° C. (dec).

2. The Synthesis of Compound (5)

Step i) Preparation of 4-(2,5-dimethoxy-4-tert-octylphenyl)-4-oxoacetic acid

Dichloromethane (800 ml) was added to 200 grams of tert-octylhydroquinone dimethyl ether to form a solution, after which 160 grams of succinic anhydride was added and the mixture was stirred, and then 420 grams of aluminum chloride-was added in small quantities with ice cooling in such a way that the temperature did not exceed 25° C. After completing the addition, the mixture was stirred for 1 hour while maintaining a temperature of from 15° C. to 25° C., after which the reaction mixture was poured into about 2 liters of ice water and extracted with the addition of ethyl acetate. The extract obtained was washed with saturated salt water, dried over magnesium sulfate and concentrated using a rotary evaporator whereupon crude crystals were obtained. Ethyl acetate (300 ml) was added to the crude crystals and the mixture was heated to form a solution, after which 1200 ml of n-hexane was added and crystals precipitated out. 700 ml of water was added to the crystals so obtained and the mixture was boiled for 5 minutes.

After cooling, the crystals were recovered by filtration and 160 grams of 4-(2,5-dimethoxy-4-tert-octylphenyl)-4-oxobutyric acid was obtained for a yield of 57%, Melting Point 142° C.

Step ii) Preparation of 4-(2,5-Dimethoxy-4-tert-octylphenyl)butyric acid 4-(2,5-dimethoxy-4-tert-octylphenyl)-4-oxobutyric acid (70 grams), and 100 ml of tert-butanol, 100 ml of acetic acid and 3 grams of 10% Pd/C were introduced into a 500 ml capacity stainless steel autoclave and hydrogen was introduced at a pressure of 40 atmospheres.

The mixture was heated to 70° C. and reacted and, when the hydrogen pressure stopped falling and the reaction was complete, the autoclave was opened and the reaction mixture was recovered. The reaction mixture was filtered using Celite and the Pd/C was removed, and then the filtrate was concentrated in a rotary evaporator whereupon 60 grams of 4-(2,5-dimethoxy-4-tert-octylphenyl)butyric acid was obtained for a yield of 90%, oil Step iii) Preparation of 4-(2,5-Dimethoxy-4-tert-octylphenyl)-N-methylbutyrylhydroxamic acid Chloroform (300 ml) was added to 100 grams of 4-(2,5-dimethoxy-4-tert-octylphenyl)butyric acid to form a solution and then 138 grams of thionyl chloride was added and the mixture was heated under reflux for 2 hours. After reaction, the chloroform and thionyl chloride were removed by distillation under reduced pressure and the acid chloride was obtained.

N-Methylhydroxylamine hydrochloride (50 grams) was introduced into a separate reactor, 500 ml of water and 200 grams of sodium bicarbonate were added and the mixture was stirred with ice cooling.

Next, 300 ml of ethyl acetate was added and then the above mentioned acid chloride was added dropwise while maintaining the temperature at from 10° C. to 12° C. After the reaction had been completed, 6N hydrochloric acid was added to acidify the mixture and then the mixture was extracted with ethyl acetate. The extract was washed with saturated salt water and dried with the addition of magnesium sulfate and, after removing the solvent using a rotary evaporator, 300 ml of n-hexane was added and heated to form a solution. Crystals precipitated out on cooling this solution and, after leaving the mixture to stand at 0–5° C. for 2 hours, the crystals which had formed were recovered by filtration and 80 grams of 4-(2,5-dimethoxy-4-tert-octylphenyl)-N-methylbutyrylhydroxamic acid was obtained for a yield of 77%, melting Point 89° C.

Step iv) Preparation of Compound (5)

Dichloromethane (300 ml) was added to 30 grams of 4-(2,5-dimethoxy-4-tert-octylphenyl)-N-methylbutyrylhydroxamic acid to form a solution. Boron tribromide (27 ml) was added dropwise, with ice cooling, and after completing the dropwise addition the mixture was reacted for 2 hours at room temperature. After completing the reaction, the reaction liquid was poured into 1 liter of ice water and ethyl acetate was added and the mixture was extracted. The extract was washed with saturated salt water and dried by adding magnesium sulfate, after which the mixture was concentrated using a rotary evaporator and sticky solid was obtained. This was redissolved by the addition of 200 ml of dichloromethane, and 18 grams of 1-phenyl-5-chlorsulfenyltetrazole which had been prepared separately was dissolved in 50 ml of dichloromethane and added dropwise.

The crystals which formed on reacting for 3 hours while maintaining at a temperature of 25–28° C. were recovered by filtration. A solution was formed by adding 100 ml of dichloromethane and 100 ml of water to the crystals so obtained and, after thorough agitation, the dichloromethane layer was washed with water, dried by the addition of magnesium sulfate and concentrated using a rotary evaporator. The dry solid which was obtained on concentration was recovered and 12 grams of compound (5) as final product was obtained for a yield of 25%, melting Point 83° C.

3. The Synthesis of Compound (22)

Step i) Preparation of 2-(3,4-Methylenedioxyphenoxy)-lauric acid ethyl ester

Sesamol (42.7 grams) was dissolved in 300 ml of DMF, 100 grams of 2-bromolauric acid ethyl ester was added and the mixture was stirred. Potassium carbonate (50 grams) was added and the mixture was reacted at 80° C. for 10 hours. The end of the reaction was verified using TLC, after which 1 liter of water and 500 ml of ethyl acetate were added and the mixture was extracted. The organic layer was washed twice with water and then dried over magnesium sulfate and, on removing the solvent by distillation, 90 grams of 2-(3,4-methylenedioxy-phenoxy)lauric acid ethyl ester was obtained as an oily material for a yield of 79.9%.

Step ii) Preparation of 5-(2-(dodecanoic acid ethyl-2-yl)oxy-3,4-methylenedioxy)phenylthio-1-phenyltetrazole 5-Mercapto-1-phenyltetrazole (23.4 grams) was suspended in 300 ml of chloroform and 17.8 grams of sulfuryl chloride was added dropwise at 0° C. The solvent was removed after reacting for 2 hours at 0° C. The residue was dissolved in 100 ml of acetonitrile and a solution comprised of 300 ml of acetonitrile and 40 grams of 2-(3,4-methylenedioxyphenoxy)lauric acid ethyl ester was added dropwise at a temperature of not more than 10° C. After reacting for 2 hours at a temperature of not more than 10° C., 1 liter of water and 500 ml of ethyl acetate were added and the mixture was extracted. The organic layer was dried using magnesium sulfate and, on removing the solvent by distillation, crude 5-(2-(dodecanoic acid ethyl-2-yl)oxy-3,4-methylenedioxy) phenylthio-1-phenyltetrazole was obtained as an oily material. This oily material was subjected to column chromatography and 50 grams of 5-(2-(dodecanoic acid ethyl-2-yl)oxy-3,4-methylenedioxy)-phenylthio-1-phenyltetrazole was obtained for a yield of 84%.

Step iii) Preparation of 5-(2-dodecanoic acid ethyl-2-yl)oxy-3,4-dihydroxy-phenylthio-1-phenyltetrazole 5-(2-dodecanoic acid ethyl-2-yl)oxy-3,4-methyleneoxy)phenylthio-1-phenyltetrazole (35 grams) was dissolved in 300 ml of dichloromethane and stirred. Boron trifluoride (115 ml) was added dropwise with ice cooling. After reacting for 2 hours after completing this dropwise addition, 100 ml of methanol was added slowly by means of a drip feed. After stirring for a further period of 1 hour, 500 ml of ethyl acetate and 500 ml of water were added and the mixture was extracted. The organic layer was dried over sodium sulfate and then the solvent was removed by distillation under reduced pressure and an oily substance was obtained. This oily substance was separated using column chromatography and the main product was recovered. This compound was analyzed using NMR spectroscopy and found to be 5-(2-(dodecanoic acid ethyl-2-yl)oxy-3,4-dihydroxy)phenylthio-1-phenyltetrazole. Recovery was 30 grams, for a yield of 87.7%.

Step iv) Preparation of 5-(2-(Dodecanoic acid-2-yl)oxy-3,4-dihydroxy)phenylthio-1-phenyltetrazole 5-(2-dodecanoic acid ethyl-2-yl)oxy-3,4-dihydroxy)-phenylthio-1-phenyltetrazole (30 grams) was dissolved in 150 ml of dioxane and stirred. 5N Sodium hydroxide (100 ml) was added to this solution at room temperature and the mixture was reacted for 2 hours. After completing the reaction, 300 ml of ethyl acetate and 100 ml of dilute hydrochloric acid were added and the mixture was extracted, and the organic layer was dried using magnesium sulfate. The solvent was removed by distillation and 25 grams of a colorless oily substance was obtained. This oily substance was 5-(2-dodecanoic acid-2-yl)oxy-3,4-dihydroxy)phenylthio-1-phenyltetrazole. Recovery was 25 grams, for a yield of 88.0%.

Step v) Preparation of 5-(2-(Dodecanoic acid-2-yl)oxy-3,4-diacetoxy)phenylthio-1-phenyltetrazole 5-(2-(dodecanoic acid-2-yl)oxy-3,4-dihydroxy)-phenylthio-1-phenyltetrazole (20 grams) was dissolved in 200 ml of acetonitrile, 50 ml of pyridine and 50 ml of acetic anhydride were added and the mixture was reacted at room temperature for 5 hours. After the reaction had been completed, 500 ml of water and 500 ml of ethyl acetate were added and the mixture was extracted and, after drying the organic layer with magnesium sulfate, the solvent was removed by distillation under reduced pressure and an oily material was obtained. According to its NMR spectrum, this oily material was 5-(2-(dodecanoic acid-2-yl)oxy-3,4-diacetoxy)phenylthio-1-phenyltetrazole. Recovery was 20 grams, for a yield of 85.5%.

Step vi) Preparation of 5-(2-(N-methyl-N-hydroxydodecanamido-2-yl)-oxy-3,4-dihydroxy)phenylthio-1-phenyltetrazole (Illustrative Compound (22))

5-(2-(dodecanoic acid-2-yl)oxy-3,4-diacetoxy)-phenylthio-1-phenyltetrazole (20 grams) was dissolved in 150 ml of chloroform, 7.5 ml of thionyl chloride was added and, after heating under reflux for 2 hours, the chloroform was removed by distillation under reduced pressure, 50 ml of ethyl acetate was added and an ethyl acetate solution was obtained. This ethyl acetate solution was mixed, with stirring, with a liquid mixture comprised of 5 grams of N-methylhydroxylamine hydrochloride, 50 ml of water, 10 grams of sodium bicarbonate and 50 ml of ethyl acetate which had been prepared beforehand. A further 100- ml of ethyl acetate and 100 ml of water were then added and the mixture was extracted. Next, the organic layer was recovered and, after removing the solvent, 200 ml of methanol, 20 grams of hydroxylamine hydrochloride and 20 grams of sodium acetate were added and the mixture was heated under reflux for 30 minutes. After confirming that the reaction was complete using TLC, the methanol was removed by distillation under reduced pressure and the mixture was extracted with the addition of 300 ml of ethyl acetate and 100 ml of water. The organic layer was washed twice with water and dried over magnesium sulfate, after which the solvent was removed by distillation and the residue was refined using column chromatography. 5-(2-N-methyl-N-hydroxydodecanamido-2-yl)oxy-3,4-dihydroxy)phenylthio-1-phenyltetrazole (illustrative compound (22)) was obtained as the main product. This was crystallized from hexane-ethyl acetate. The melting point was 133–5° C., and the recovery was 10.1 grams, for a yield of 55.8%.

The compound of general formula (I-1) or (I-2) is added in silver halide emulsion layer or other hydrophilic colloid layer such as a protective layer and an intermediate layer. The amount of the compound of general formula (I-1) or (I-2) is generally from 5 mg/m$^2$ to 5 g/m$^2$ and preferably from 10 mg/m$^2$ to 1 g/m$^2$, while it depends on the molecular weight.

The compounds of general formula (I-1) and (I-2) of this present invention release (Time)$_r$-PUG as a result of a cross oxidation with the redox reaction in the oxidized form of the developing agent (or auxiliary developing agent) which is produced in the form of the image during development. (The auxiliary developing agent include those which reduce silver halide in place of a developing agent, that is, functions as an electron transfer agent between the silver halide and the developing agent. For example, 3-pyrazolidones are used as the auxiliary developing agent towards hydroquinones as a developing agent.) Furthermore, the compounds of general formula (I-1) and (I-2) reduce silver salts directly and are themselves oxidized and in this way the oxidized form is distributed in the form of the image. Subsequently, the photographically useful group is released from the oxidized form of general formula (I-1) or (I-2) by means of an intramolecular nucleophilic substitution reaction. The mechanisum of PUG release is shown below. In the following formulations, p represents a developing agent and p* represents an oxidized form of the developing agent.

(I-1)

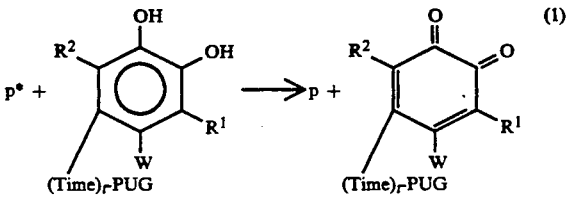

(1)

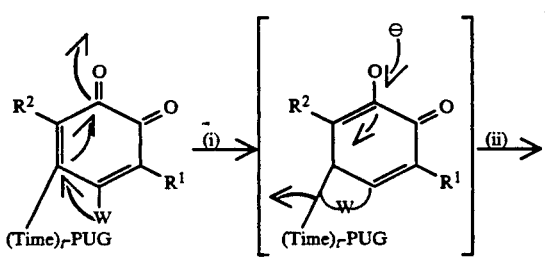

(2)

(i) conjugated addition

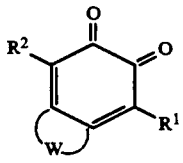

+ (Time)$_r$-PUG (ii) elimination (Time)$_r$-PUG ⟶ t(Time) + PUG (3)

(I-2)

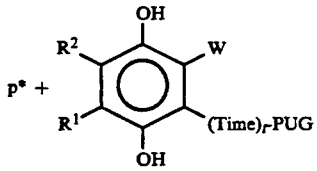

(1)

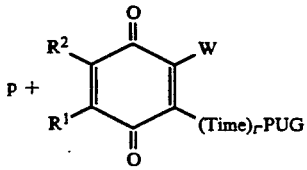

-continued (2)

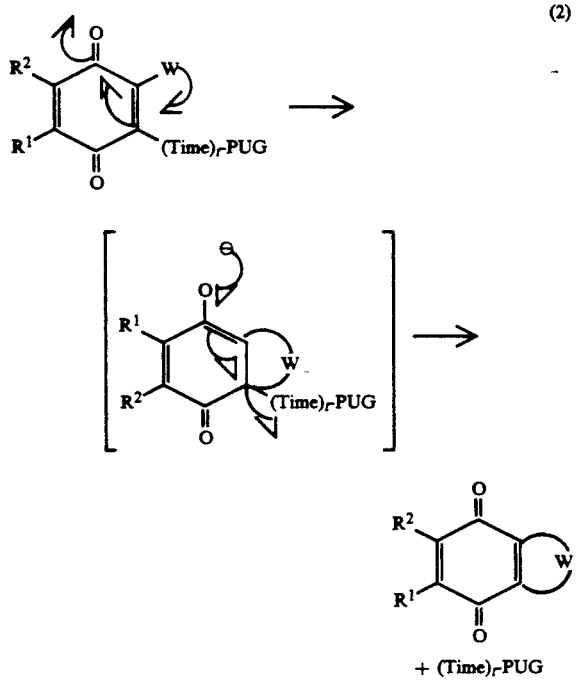

(Time)$_r$-PUG ⟶ t(Time) + PUG (3)

In this way, the compounds of this present invention release photographically useful groups in the form of the image rapidly and efficiently and so there is no limit to their application. Also, if, for example, a development inhibiting substance is released, development is inhibited in the form of the image, and, as a consequence, the image becomes more fine grained, the tone of the image is softened, the sharpness of the image is improved and the color reproduction is improved, which is to say that a DIR effect is observed. Furthermore, if a dye is released it is possible to form a color image.

The compounds which release development inhibiting substances among the compounds of this present invention have the effect of improving the color reproduction, especially of thermally developed color photosensitive materials and normal temperature processing diffusion transfer type color photosensitive materials.

Any of the conventional silver halides, namely, silver bromide, silver iodobromide, silver iodochlorobromide, silver chlorobromide and silver chloride, may be used in the photographic emulsion layers of a photographic material in which this present invention is used.

The silver halide grains in the photographic emulsion may be so-called regular grains which have a regular crystalline form such as a cubic, octahedral or tetradecahedral form, or they may have an irregular crystalline form such as a spherical form, or they may have crystal defects such as twinned crystal planes for example, or they may have a form which is a composite of these forms.

The size of the silver halide grains may be very small with a projected diameter of 0.1 microns or less, or the grains may be of a large size with a projected area diameter of up to 10 microns, and the emulsions may be mono-disperse emulsions with a narrow grain size distribution or poly-disperse emulsions with a wide grain size distribution.

The photographic emulsions used in the invention can be prepared using the methods described by P. Glafkides in *Chimie et Physique Photographique*, published by Paul Montel, 1967, by G. F. Duffin in *Photographic Emulsion Chemistry*, published by Focal Press, 1966, and by V. L. Zelikmann et al. in *Making and Coating Photographic Emulsions*, published by Focal Press, 1964. That is to say, acidic methods, neutral methods or ammonia methods can be used, and a single sided mixing method, a simultaneous mixing method, or a combination of these methods may be used for the system by which the soluble halogen salt is reacted with the soluble silver salt. Methods in which the grains are formed in the presence of excess silver ion (so-called reverse mixing methods) can also be used. The method in which the pAg value in the liquid phase in which the silver halide is being formed is held constant, the so-called controlled double jet method, can also be used as one type of simultaneous mixing method. Silver halide emulsions with a regular crystalline form and an almost uniform grain size can be obtained using this method.

Mixtures of two or more types of silver halide emulsion which have been prepared separately may be used.

The aforementioned silver halide emulsions comprised of regular grains can be obtained by adjusting the pAg and pH values during grain formation. Details have been disclosed, for example, on pages 159–165 of *Photographic Science and Engineering*, Vol. 6, 1962, on pages 242–251 of *Journal of Photographic Science*, Vol. 12, 1964, and in U.S. Pat. No. 3,655,394 and British Patent 1,413,748.

Mono-disperse emulsions have been disclosed, for example, in JP-A-48-8600, JP-A-51-39027, JP-A-51-83097, JP-A-53-137133, JP-A-54-48521, JP-A-54-99419, JP-A-58-37635, JP-A-58-49938, JP-B-47-11386, U.S. Pat. No. 3,655,394 and British Patent 1,413,748. (the term "JP-B" as used herein signifies an "examined Japanese patent publication".)

Furthermore, tabular grains of which the aspect ratio is 5 or more can also be used in this invention. Tabular grains can be prepared easily using the methods described, for example, by Cleve in *Photography Theory and Practice* page 131, (1930), by Gutoff in *Photographic Science and Engineering*, Vol. 14, pages 248–257 (1970), and in U.S. Pat. Nos. 4,434,226, 4,414,310, 4,433,048 and 4,439,520, and in British Patent 2,112,157. There are advantages in those cases where tabular grains are used in that the covering power is increased and in that the color sensitization efficiency with sensitizing dyes is increased, and details have been given in the previously cited U.S. Pat. No. 4,434,226.

The crystal structure may be uniform, or it may take a form comprising inner and outer parts which have different halogen compositions, and layer structures may be formed. Such emulsion grains have been disclosed, for example, in British Patent 1,027,146, U.S. Pat. Nos. 3,505,068 and 4,444,877, and in JP-A-60-143331. Furthermore, silver halides which have different compositions may be joined epitaxially, or they may be joined with compounds other than silver halides, such as silver thiocyanate or lead oxide. Such emulsion grains have been disclosed, for example, in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, and JP-A-59-162540.

Mixtures of grains of various crystalline forms may be used.

Silver halide solvents are useful for accelerating ripening. For example, it is known that ripening is accelerated with the presence of excess halogen ion in the reactor. Consequently, it is clear that ripening can be accelerated simply by introducing a solution of halide into the reactor. Other ripening agents can be used, and these can be combined in total with the dispersion medium in the reactor prior to the addition of the silver and halide or they can be introduced into the reactor together with the addition of one or two or more than two of the halides, silver salts and deflocculating agents. In another embodiment, the ripening agents are introduced independently at the halide or silver salt addition stage.

Ammonia or amine compounds and thiocyanates, for example alkali metal thiocyanates, especially sodium and potassium thiocyanates, and ammonium thiocyanate, can be used as ripening agents as well as halogen ions. The use of thiocyanate ripening agents has been described in U.S. Pat. Nos. 2,222,264, 2,448,534 and 3,320,069. Furthermore, the generally used thioether ripening agents such as those disclosed in U.S. Pat. Nos. 3,271,157, 3,574,628 and 3,737,313 can also be used. Alternatively, thione compounds such as those disclosed in JP-A-53-82408 and JP-A-53-144319 can also be used.

The sensitized nature of the silver halide grains can be controlled by the presence of various compounds during the silver halide precipitation and formation process. Compounds of this type may be present in the reactor initially or they can be added along with the addition of one, two or more than two salts in accordance with the usual methods known in the field. The characteristics of the silver halide can be controlled by the presence of during the silver halide precipitation and formation process of compounds of copper, iridium, lead, bismuth, cadmium, zinc (chalcogen compounds of sulfur, selenium, tellurium for example), and compounds of gold and group VII precious metals, as disclosed in U.S. Pat. Nos. 2,448,060, 2,628,167, 3,737,313 and 3,772,031, and in *Research Disclosure*, volume 134, June 1975, number 13452. Internal reduction sensitization of the grains can be achieved during the precipitation and formation process of silver halide emulsions as disclosed in JP-B-58-1410 and by Moisar et al. in Journal of Photographic Science, Volume 25, 1977, pages 19–27.

The silver halide emulsions are generally sensitized chemically. Chemical sensitization can be achieved using active gelatin as disclosed on pages 67–76 of *The Theory of the Photographic Process*, by T. H. James, 4th edition, Macmillan, 1977, and by using sulfur, selenium, tellurium, gold, platinum, palladium, iridium or a combination of these sensitizing agents at pAg 5–10, pH 5–8 and at a temperature of from 30° C. to 80° C., as disclosed in *Research Disclosure*, volume 120, April 1974, No. 12008, ibid volume 34, June 1975, No. 13452, U.S. Pat. Nos. 2,642,361, 3,297,446, 3,772,031, 3,857,711, 3,901,714, 4,266,018 and 3,904,415, and British Patent 1,315,755. Chemical sensitization is carried out optimally in the presence of gold compounds and thiocyanate compounds, and in the presence of the sulfur containing compounds disclosed in U.S. Pat. Nos. 3,857,711, 4,266,018 and 4,054,457 or sulfur containing compounds such as hypo, thiourea based compounds and rhodanine based compounds for example. Chemical sensitization can be carried out in the presence of chemical sensitization promotors. The compounds known as agents for inhibiting fogging in the chemical sensitization process and increasing photographic speed, such as azaindenes, azapyridazines and azapyrimidines, can be used as chemical sensitization promotors. Examples of chemical sensitization promotor improvers have been disclosed in U.S. Pat. Nos. 2,131,038, 3,411,914 and 3,554,757, JP-A-58-126526 and the aforementioned book Photographic Emulsion Chemistry, by Duffin, pages 138–143. Reduction sensitization can be achieved using hydrogen, for example, as disclosed in U.S. Pat. Nos. 3,891,446 and 3,948,249, or using stannous chloride, thiourea dioxide, polyamine or reducing agents of this type, and reduction sensitization by treatment at a low pAg value (for example less than 5) and/or a high pH value (for example greater than 8), as disclosed in U.S. Pat. Nos. 2,518,698, 2,743,182 and 2,743,183 can be carried out in addition to, or in place of, chemical sensitization. Furthermore, color sensitivity can also be improved using the chemical sensitization methods disclosed in U.S. Pat. Nos. 3,917,485 and 3,966,476.

The photosensitive materials of this present invention may contain one or more type of surfactant as coating promotors, for anti-static purposes, for improving slip properties, for emulsification and dispersion purposes, for preventing the occurrence of sticking and for improving photographic characteristics (for example, for accelerating development, increasing contrast and increasing photographic speed) for example.

The silver halide photographic emulsions used in the invention may be spectrally sensitized using methine dyes or by other means. The dyes which can be used include cyanine dyes, merocyanine dyes, complex cyanine dyes, complex merocyanine dyes, holopolar cyanine dyes, hemi-cyanine dyes, styryl dyes and hemioxonol dyes. Dyes classified as cyanine dyes, merocyanine dyes and complex merocyanine dyes are especially useful dyes. All of the nuclei normally found in cyanine dyes can be used for the basic heterocyclic nuclei in these dyes. That is to say, the nucleus may be a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus; a nucleus in which one of these nuclei is fused with an aliphatic hydrocarbyl ring or a nucleus in which one of these nuclei is fused with an aromatic hydrocarbyl ring, which is to say an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus for example. These nuclei may be substituted on the carbon atoms.

The nucleus which has a ketomethylene structure in the merocyanine dyes or complex merocyanine dyes may be a five or six membered heterocyclic nucleus, for example, a pyrazolin-5-one nucleus, a thiohydantoin nucleus, a 2-thio-oxazolidin-2,4-dione nucleus, a thiazolidin-2,4-dione nucleus, a rhodanine nucleus or a thiobarbituric acid nucleus.

These sensitizing dyes may be used individually or may be used in combinations thereof, and, in particular, combinations of sensitizing dyes can be used with the intention of achieving super-sensitization. Substances which exhibit super-sensitization, being dyes which themselves have no spectral sensitizing action or substances which essentially do not absorb visible light, can be included in the emulsion together with the sensitizing dyes. For example, substituted aminostilbene compounds with a nitrogen containing heterocyclic group (for example, those disclosed in U.S. Pat. Nos. 2,933,390 and 3,635,721), aromatic organic acid/formaldehyde condensates (for example, those disclosed in U.S. Pat. No. 3,743,510), and cadmium salts and azaindene compounds, for example, may be included. The combinations disclosed in U.S. Pat. Nos. 3,615,613, 3,615,641, 3,617,295 and 3,635,721 are especially useful.

Various compounds can be included conjointly in this present invention with a view, for example, to preventing the occurrence of fogging during the manufacture, storage or photographic processing of the photosensitive material, or with a view to stabilizing photographic performance. Thus, many compounds which are known as anti-fogging agents or stabilizers, such as azoles, for example benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole); mercaptopyrimidines; mercaptotriazines; for example thioketo compounds such as oxazolinethione; azaindenes, for example triazaindenes, tetra-azaindenes (especially 4-hydroxy substituted (1,3,3a,7-tetraazaindenes) and penta-azaindenes; benzenethiosulfonic acid; benzenesulfinic acid and benzenesulfonic acid amide, for example, can be added.

Gelatin is useful as a binding agent or protective colloid which can be used in the emulsion layers and intermediate layers of a photosensitive material of this present -invention, but other hydrophilic colloids can also be used. For example, gelatin derivatives, graft polymers of other polymers with gelatin, proteins such as albumin and casein, cellulose derivatives such as hydroxyethylcellulose, carboxymethylcellulose and cellulose sulfate esters, sodium alginate and sugar derivatives such as starch derivatives, and various synthetic hydrophilic polymeric materials, for example homopolymers or copolymers such as poly(vinyl alcohol), partially acetalated poly(vinyl alcohol), poly(N-vinyl-pyrrolidone), poly(acrylic acid), poly(methacrylic acid), polyacrylamide, polyvinylimidazole and polyvinylpyrazole, can be used.

As well as general purpose lime treated gelatins, acid treated gelatins and enzyme treated gelatins, as described in *Bull. Soc. Sci. Phot. Japan,* No. 16, page 30 (1966) may be used for the gelatin, and gelatin hydrolyzates can also be used.

The photosensitive materials of this present invention may contain inorganic or organic film hardening agents in any of the hydrophilic colloid layers which form the photographic photosensitive layer or the backing layer. Chromium salts, aldehydes (for example, formaldehyde, glyoxal, glutaraldehyde) and N-methylol compounds (for example, dimethylolurea) are cited as examples of such compounds. The use of active halogen compounds (for example, 2,4-dichloro-6-hydroxy-1,3,5-triazine and its sodium salt), and active vinyl compounds (for example, 1,3-bis-vinylsulfonyl-2-propanol, 1,2-bis(vinylsulfonylacetamido)ethane or vinyl based polymers which have vinylsulfonyl groups in side chains) is desirable for rapidly hardening the hydrophilic colloids such as gelatin and providing stable photographic characteristics. N-Carbamoylpyridinium salts (for example, (1-morpholinocarbonyl-3-pyridinio)methanesulfonate) and haloamidinium salts (for example, 1-(1-chloro-1-pyridinomethylene)pyrrolidinium 2-naphthalenesulfonate) are also excellent for providing rapid hardening rates.

The photographic emulsion layers and other layers in a photographic material of this present invention can be coated onto a flexible support such as a plastic film, paper or cloth for example, or onto a rigid support such as glass, porcelain or metal for example, of the type conventionally used for photographic materials. Useful flexible supports include, for example, films made of semi-synthetic or synthetic polymers, such as cellulose nitrate, cellulose acetate, cellulose acetate butyrate, polystyrene, poly(vinyl chloride), poly(ethylene terephthalate) or polycarbonate for example,-and papers which have been coated or laminated with a baryta layer or an α-olefin polymer (for example polyethylene, polypropylene, ethylene/butene copolymer). The support may be colored using dyes or pigments. The support may also be colored black for light shielding purposes. The surface of the support is usually undercoated to improve adhesion with the photographic emulsion layer for example. The surface of the support may be subjected to a glow discharge treatment, a corona discharge treatment, ultraviolet irradiation or a flame treatment, for example, before or after the undercoating treatment.

This present invention can be applied to various color and also black and white photosensitive materials. Typical applications include color negative films for general and cinematographic purposes, color reversal films for slides and television purposes, color papers, color positive films and color reversal papers, color diffusion transfer type photosensitive materials and heat developable type color photosensitive materials. The invention can also be applied to black and white photosensitive materials such as those intended for X-ray purposes in which the tri-color coupler mixtures disclosed, for example, in *Research Disclosure,* No. 17123 (July 1978) are used, or in which the black colored couplers disclosed, for example, in U.S. Pat. No. 4,126,461 and British Patent 2,102,136 are used. The invention can also be applied to printing plate making films, such as lith films and scanner films, to X-ray films intended for use in direct or indirect medical applications or industrial applications, camera black and white negative films, black and white printing papers, microfilms for COM or general purposes, silver salt diffusion transfer type photosensitive materials and print-out type photosensitive materials.

Various color couplers can be used in those cases where this present invention is applied to coupler type color photosensitive materials. Color couplers are compounds which can form dyes by means of a coupling reaction with the oxidized form of a primary aromatic amine developing agent. Typical examples of useful color couplers include naphthol or phenol based compounds, pyrazolone or pyrazoloazole based compounds, and open chain or heterocyclic ketomethylene compounds. Actual examples of these cyan, magenta and yellow couplers which can be used in the invention include the compounds disclosed in the patents cited in *Research Disclosure* 17643 (December 1978), section VII-D, and ibid, No. 18717 (published 1979).

The color couplers which are incorporated in the photosensitive material are preferably rendered fast to diffusion by having ballast groups or by polymerization. Two-equivalent color couplers which are substituted with a coupling leaving group are preferable to the four-equivalent couplers which have a hydrogen atom at the coupling active site in that the former enable the amount of coated silver to be reduced. Moreover, couplers of which the colored dye has a suitable degree of diffusibility, non-color forming couplers, or DIR couplers which release development inhibitors as the coupling reaction proceeds or couplers which release development accelerators as the coupling reaction proceeds, can also be used.

The oil protected type acylacetamide based couplers are typical of the yellow couplers which can be used in this present invention. Examples of such yellow couplers are disclosed, for example, in U.S. Pat. Nos. 2,407,210, 2,875,057 and 3,265,506. The use of two-equivalent yellow couplers is preferred in this present invention, and typical examples include the oxygen atom elimination type yellow couplers disclosed, for example, in U.S. Pat. Nos. 3,408,194, 3,447,928, 3,933,501 and 4,022,620, and the nitrogen atom elimination type yellow couplers disclosed, for example, in JP-B-58-10739, U.S. Pat. Nos. 4,401,752 and 4,326,024, RD 18053 (April 1979), British Patent 1,425,020, and West German Patent Application Laid Open Nos. 2,219,917, 2,261,361, 2,329,587 and 2,433,812. Moreover, α-pivaloyl-acetanilide based couplers provide colored dyes which have excellent fastness, especially light fastness, while α-benzoylacetanilide based couplers provide high color densities.

Oil protected type indazolone based or cyanoacetyl based, and preferably 5-pyrazolone based and pyrazoloazole, for example pyrazolotriazole, based couplers are mentioned as magenta couplers which can be used in this present invention. The 5-pyrazolone based couplers which have an arylamino group or an acylamino group substituted in the 3-position are preferred from the point of view of the hue of the colored dye and the color density, and typical examples are disclosed, for example, in U.S. Pat. Nos. 2,311,082, 2,343,703, 2,600,788, 2,908,573, 3,062,653, 3,152,896 and 3,936,015. The nitrogen atom leaving groups disclosed in U.S. Pat. No. 4,310,619 and the arylthio groups disclosed in U.S. Pat. No. 4,351,897 are especially desirable as leaving groups for two-equivalent 5-pyrazolone based couplers. Furthermore, the 5-pyrazolone based couplers which have ballast groups disclosed in European Patent 73,636 provide high color densities.

The pyrazolobenzimidazoles disclosed in U.S. Pat. No. 3,061,432, and preferably the pyrazolo[5,1-c][1,2,4]triazoles disclosed in U.S. Pat. No. 3,725,067, the pyrazolotetrazoles disclosed in *Research Disclosure* 24220 (June 1984) and JP-A-60-33552, and the pyrazolopyrazoles disclosed in *Research Disclosure* 24230 (June 1984) and JP-A-60-43659 are mentioned as pyrazoloazole based couplers. The imidazo[1,2-b]pyrazoles disclosed in U.S. Pat. No. 4,500,630 are preferred in view of the slight absorbance on the yellow side and the light fastness of the colored dye, and the pyrazolo[1,5-b][1,2,4]triazoles disclosed in U.S. Pat. No. 4,540,654 are especially desirable in this respect.

The oil protected type naphthol based and phenol based couplers are cyan couplers which can be used in this present invention, and typical examples include the naphthol based couplers disclosed in U.S. Pat. No. 2,474,293, and the oxygen atom elimination type two-equivalent naphthol based couplers disclosed in U.S. Pat. Nos. 4,052,212, 4,146,396, 4,228,233 and 4,296,200 are preferred. Furthermore, actual examples of phenol based couplers have been disclosed, for example, in U.S. Pat. Nos. 2,369,929, 2,801,171, 2,772,162 and 2,895,826. The use of cyan couplers which are fast to moisture and temperature is preferred in this invention, and typical examples of such couplers include the phenol based cyan couplers which have an alkyl groups comprising an ethyl or larger group in the meta position of the phenol ring disclosed in U.S. Pat. No. 3,772,002, the 2,5-diacylamino substituted phenol based couplers disclosed, for example, in U.S. Pat. Nos. 2,772,162, 3,758,308, 4,126,396, 4,334,011 and 4,327,173, West German Patent Laid Open 3,329,729 and European Patent 121,365, and the phenol based couplers which have a phenylureido group in the 2-position and an acylamino group in the 5-position disclosed, for example, in U.S. Pat. Nos. 3,446,622, 4,333,999, 4,451,559 and 4,427,767. The cyan couplers which have a sulfonamido group or an amido group for example substituted in the 5-position of the naphthol ring disclosed in Japanese Patent Application Nos. 59-93605, 59-264277 and 59-268135 also provide color images which have superior fastness and their use is preferred in this present invention.

The conjoint use of colored couplers for correcting the unwanted absorptions on the short wavelength side of the dyes formed from magenta and cyan couplers is preferred in camera color negative sensitive materials. The yellow colored magenta couplers disclosed, for example, in U.S. Pat. No. 4,163,670 and JP-B-57-39413 or the magenta colored cyan couplers disclosed, for example, in U.S. Pat. Nos. 4,004,929 and 4,138,258 and British Patent 1,146,368 can be cited as typical examples.

Graininess can be improved by the conjoint use of couplers of which the colored dyes have a suitable degree of diffusibility. Actual examples of blurring couplers of this type include the magenta couplers disclosed in U.S. Pat. No. 4,366,237 and British Patent 2,125,570, and the yellow, magenta and cyan couplers disclosed in European Patent 96,570 and West German Patent Application Laid Open 3,234,533.

The dye forming couplers and the special couplers above mentioned can take the form of dimers or larger polymers. Typical examples of polymerized dye forming couplers have been disclosed in U.S. Pat. Nos. 3,451,820 and 4,080,211. Actual examples of polymerized magenta couplers have been disclosed in British Patent 2,102,173, U.S. Pat. No. 4,367,282 and Japanese Patent Application Nos. 60-75041 and 60-113596.

Two or more of the various types of coupler used in this present invention can be used conjointly in a layer of the same color sensitivity, and the same compound can be introduced into two or more different layers, in order to satisfy the characteristics required of the photosensitive material.

The couplers can be introduced into a photosensitive material using a variety of known methods of dispersion, for example using the solid dispersion method or the alkali dispersion method, preferably using the latex dispersion method and most desirably using the oil in water dispersion method for example. In the oil in water dispersion method, after dissolution in either a high boiling point organic solvent of boiling point at least 175° C. or a so-called auxiliary solvent of low boiling point or in a mixture of such solvents, the solution is finely dispersed in water or an aqueous medium such as an aqueous gelatin solution, for example, in the presence of a surfactant. Examples of high boiling point organic solvents have been disclosed, for example, in U.S. Pat.

No. 2,322,027. The dispersion may be accompanied by a phase reversal and, where required, the auxiliary solvent may be reduced or removed by evaporation, noodle washing or ultrafiltration before the dispersion is used for coating.

Actual examples of high boiling point solvents include phthalic acid esters (for example, dibutyl phthalate, dicyclohexyl phthalate, di-2-ethylhexyl phthalate, decyl phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tri-dodecyl phosphate, tri-butoxyethyl phosphate, tri-chloropropyl phosphate, di-2-ethylhexyl phenyl phosphonate), benzoic acid esters (for example, 2-ethylhexyl benzoate, dodecyl benzoate, 2-ethylhexyl p-hydroxybenzoate), amides (for example, diethyldodecanamide, N-tetradecyl-pyrrolidone), alcohols or phenols (for example, iso-stearyl alcohol, 2,4-di-tert-amylphenol), aliphatic carboxylic acid esters (for example, dioctyl azelate, glycerol tributyrate, iso-stearyl lactate, trioctyl citrate), aniline derivatives (for example, N,N-dibutyl-2-butoxy-5-tert-octylaniline) and hydrocarbons (for example, paraffin, dodecylbenzene, diisopropylnaphthalene). Furthermore, organic solvents which have a boiling point above about 30° C., and preferably of at least 50° C., but below about 160° C., can be used as auxiliary solvents, and typical examples of these solvents include ethyl acetate, butyl acetate, ethyl propionate, methyl ethyl ketone, cyclohexanone, 2-ethoxyethyl acetate and dimethylformamide.

Actual examples of the processes and effects of the latex dispersion method and of latexes for loading purposes have been disclosed, for example, in U.S. Pat. No. 4,199,363 and West German Patent Application (OLS) Nos. 2,541,274 and 2,541,230.

Various known photographically useful additives which can be used in this present invention are disclosed in the aforementioned *Research Disclosure* 17643, pages 23–28 and ibid 18716, pages 648–651. These types of additive and the locations of these disclosures are indicated in detail in the table below.

| Type of Additive | RD 17643 | RD 18716 |
|---|---|---|
| 1. Chemical sensitizers | Page 23 | Page 648, right col. |
| 2. Speed increasing agents | | As above |
| 3. Spectral sensitizers and Super-sensitizers | Pages 23–24 | Pages 648 right col. to 649 right col. |
| 4. Whiteners | Page 24 | |
| 5. Anti-foggants and Stabilizers | Pages 24–25 | Page 649, right col. |
| 6. Light absorbers, filter dyes and UV absorbers | Pages 25–26 | Pages 649, right col. to 650, left col. |
| 7. Anti-staining agents | Page 25, right col. | Page 650, left-right cols. |
| 8. Dye image stabilizers | Page 25 | |
| 9. Film hardening agents | Page 26 | Page 651, left col. |
| 10. Binders | Page 26 | As above |
| 11. Plasticizers, lubricants | Page 27 | Page 650, right col. |
| 12. Coating promotors, Surfactants | Pages 26–27 | As above |
| 13. Anti-static agents | Page 27 | As above |

Conventionally known methods can be used for the photographic processing of photosensitive materials of this present invention and known processing baths can be used. Furthermore, a processing temperature is generally selected between 18° C. and 50° C., but the processing temperature may be lower than 18° C. or in excess of 50° C. Development processing in which a silver image is formed (black and white photographic processing) or color photographic processing comprised of a development process in which a dye image is formed can be used, as needed.

Known developing agents such as dihydroxybenzenes (for example, hydroquinone), 3-pyrazolidones (for example, 1-phenyl-3-pyrazolidone) and aminophenols (for example, N-methyl-p-aminophenol) can be used individually or in combination in a black and white developer.

A color developer is generally comprised of an alkaline aqueous solution which contains a color developing agent. The known primary aromatic amine developing agents such as the phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methane-sulfonamidoethylaniline, 4-amino-3-methyl-N-ethyl-N-β-methoxyethylaniline) can be used for the color developing agent.

Those disclosed on pages 226–229 of *Photographic Processing Chemistry* by L.F.A. Mason (Focal Press, 1966), U.S. Pat. Nos. 2,193,015 and 2,592,364, and JP-A-48-64933 can also be used.

In the present invention, developers containing 3-pyrazolidones are particularly preferred.

The developers can also contain pH buffers, such as alkali metal sulfites, carbonates, borates and phosphates, and development inhibitors or anti-foggants such as bromide, iodide and organic anti-foggants other than the compounds of this present invention. They may also contain, as needed, hard water softening agents, preservatives such as hydroxylamine, organic solvents such as benzyl alcohol and diethyleneglycol, development accelerators such as polyethyleneglycol, quaternary ammonium salts and amines, dye forming couplers, competitive couplers, fogging agents such as sodium borohydride, auxiliary developing agents such as 1-phenyl-3-pyrazolidone, thickeners, the polycarboxylic acid based chelating agents disclosed in U.S. Pat. No. 4,083,723 and the antioxidahts disclosed in West German Patent Laid Open (OLS) 2,622,950 for example.

In the case of color photographic processing, the color developed photographic material is generally subjected to a bleaching process. The bleaching process may be carried out at the same time as the fixing process or it may be carried out separately. Compounds of multi-valent metals, such as iron(III), cobalt(III), chromium(VI) and copper(II), peracids, quinones, and nitroso compounds, for example, can be used as bleaching agents. Thus, ferricyanide, dichromate, organic complex salts of iron(III) or cobalt(III), for example, complex salts with aminopolycarboxylic acids such as ethylenediamine tetra-acetic acid, nitrilotriacetic acid and 1,3-diamino-2-propanol tetra-acetic acid, complex salts with organic acids such as citric acid, tartaric acid and malic acid; persulfate; permanganate; and nitrosophenol, for example, can be used as bleaching agents. From among these materials, potassium ferricyanide, ethylenediamine tetra-acetic acid iron(III) sodium and ethylenediamine tetra-acetic acid iron(III) ammonium salt are especially useful. Ethylenediamine tetra-acetic acid iron(III) complex salts are useful in both independent bleach baths and single bath bleach-fix baths.

The bleaching accelerators disclosed, for example, in U.S. Pat. Nos. 3,042,520 and 3,241,966, JP-B-45-8506 and JP-B-45-8836, the thiol compounds disclosed in JP-A-53-65732 and various other additives can also be added to the bleach and bleach-fix baths.

The water washing process is in some cases carried out in a single tank, but it is often carried out using a multi-stage counter-flow water washing system with two or more tanks. The amount of water used in the washing process can be determined arbitrarily as required in accordance with the type of color photosensitive material, but it can also be calculated using the method described by S. R. Goldwasser in "Water Flow Rates in Immersion Washing of Motion Picture Film", published on pages 248–253 of *Journal of Motion Picture and Television Engineering,* volume 64 (May 1955) for example.

Problems arise with the occurrence of bacteria and fungi when economies are made with the amount of washing water, and in response to these problems the process can be carried out with washing water in which the calcium and magnesium levels have been reduced as disclosed in JP-A-62-288838, or with the addition of biocides and fungicides, for example the compounds disclosed in *J. Antibact. Antifung. Agents, Volume* 11, No. 5, pages 207–223 (1983) and the compounds disclosed in *The Chemistry of Biocides and Fungicides* by Horiguchi. Furthermore, chelating agents such as ethylenediamine tetra-acetic acid and diethylenetriamine penta-acetic acid can also be added as hard water softening agents.

When economizing on the amount of washing water, the amount of water used is generally from 100 ml to 2000 ml per square meter of color photosensitive material, but the use of from 200 ml to 1000 ml is preferred from the viewpoints of both the stability of the colored image and the water economizing effect.

The pH value in the washing process is generally within the range from 5 to 9.

When photosensitive materials of this present invention can be applied to all of the color diffusion photographic method wherein a film unit construction of the peel apart type or of the unified (integrated) type as disclosed in JP-B-46-16356, JP-B-48-33697, JP-A-50-13040 and U.S. Pat. No. 1,330,524, or of the type where peeling apart is unnecessary as disclosed in JP-A-57-119345.

In any of the embodiments mentioned above, the use of a polymeric acid layer which is protected by a neutral timing layer is useful for widening the permissible processing temperature latitude. In the case of color diffusion transfer methods, these layers may be added to any layer in the sensitive material, or they may be sealed into the processing liquid container as a developer component.

Moreover, combinations of at least three silver halide emulsion layers which are photosensitive to different spectral regions are used in order to obtain a wide range of colors in the chromaticity diagram using the three primary colors yellow, magenta and cyan. For example, combinations of blue, green and red sensitive layers, and combinations of green, red and infrared sensitive layer can be used. The photosensitive layers can be arranged in the various orders known for color photographic materials. Furthermore, each of these photosensitive layers may be divided into two or more layers as required.

In cases where a photosensitive material of this present invention is used as a heat developable photosensitive material, organometallic salts can be used conjointly as oxidizing agents along with the photosensitive silver halide. The use of organic silver salts from among these organometallic salts is especially desirable.

The benzotriazoles, fatty acids and other compounds disclosed, for example, in columns 52–53 of U.S. Pat. No. 4,500,626 can be used as organic compounds for forming the organic silver salt oxidizing agents mentioned above. Furthermore, the silver salts of carboxylic acids which have alkynyl groups, such as the silver phenylpropiolate disclosed in JP-A-60-113235, and the silver acetylenes disclosed in JP-A-61-249044, can also be used. Two or more organic silver salts can be used conjointly.

The above mentioned organic silver salts can be used conjointly in amounts of from 0.01 to 10 mol, and preferably of from 0.01 to 1 mol, per mol of photosensitive silver halide. The total amount of photosensitive silver halide and organic silver salt coated is suitably from 50 mg to 10 grams per square meter when calculated based on silver content.

The reducing agents known in the field of heat developable photosensitive materials can be used for the reducing agent in a heat developable photosensitive material. Furthermore, the dye donating compounds which have reducing properties described hereinafter can also be included (other reducing agents can also be used conjointly in this instance). Furthermore, reducing agent precursors which themselves have no reducing properties but which achieve reducing properties as a result of the action of a nucleophilic reagent or heat during the development process can also be used.

Examples of reducing agents which can be used in the heat developable photosensitive materials and the color diffusion transfer method include the reducing agents and reducing agent precursors disclosed, for example, in columns 49–50 of U.S. Pat. No. 4,500,626, columns 30–31 of U.S. Pat. No. 4,483,914, U.S. Pat. Nos. 4,330,617 and 4,590,152, pages 17–18 of JP-A-60-140335, JP-A-57-40245, JP-A-56-138736, JP-A-59-178458, JP-A-59-53831, JP-A-59-182449, JP-A-59-182450, JP-A-60-119555, JP-A-60-128436 to JP-A-60-128439, JP-A-60-198540, JP-A-60-181742, JP-A-61-259253, JP-A-62-244044, JP-A-62-131253 to JP-A-62-131256, and pages 78–96 of European Patent 220,746A2.

Combinations of Various reducing agents such as those disclosed in U.S. Pat. No. 3,039,869 can also be used.

In cases where a reducing agent which is fast to diffusion is used, combinations with an electron transfer agent and/or an electron transfer agent precursor, as required, can be used in order to promote electron transfer between -the non-diffusible reducing agent and the developable silver halide.

Electron transfer agents or precursors thereof can be selected from among the reducing agents and precursors thereof described earlier. The electron transfer agent or precursor thereof preferably has a greater mobility than the non-diffusible reducing agent (electron donor). 1-Phenyl-3-pyrazolidones and aminophenols are especially useful electron transfer agents.

The reducing agents (electron donors) which are fast to diffusion, which are used in combination with the electron transfer agents, should be those from among the aforementioned reducing agents which are essentially immobile in the layers of the photosensitive material, and preferred examples include hydroquinones, sulfonamidophenols, sulfonamidonaphthols, the compounds disclosed as electron donors in JP-A-53-110827 and the dye donating compounds which have reducing properties but which are fast to diffusion as described hereinafter.

The amount of reducing agent added in this present invention is from 0.001 to 20 mol, and most desirably from 0.01 to 10 mol, per mol of silver.

When a silver ion is reduced to silver in the heat developable color diffusion transfer method or the normal color diffusion transfer method, a compound which forms or releases a diffusible dye is in correspondence or in counter-correspondence to the reaction, which is to say a dye donating compound, is used.

Examples of dye donating compounds include first of all the compounds (couplers) which form dyes by means of an oxidative coupling reaction. These couplers may be four-equivalent couplers or two-equivalent couplers. Furthermore, two-equivalent couplers which have a non-diffusible group as a leaving group and form a diffusible dye by means of an oxidative coupling reaction are preferred. The non-diffusible group may take the form of a polymer chain. Actual examples of color developing agents and couplers are described in detail in, for example, *The Theory of the Photographic Process*, by T. H. James, fourth edition, pages 291–334 and 354–361, and in JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Furthermore, compounds which have the function of releasing or dispersing dispersible dyes in the form of the image are another type of useful dye donating compound. Compounds of this type can be represented by the general formula (LI) indicated below.

$$(\text{Dye-Y})_n\text{-Z} \qquad \text{(LI)}$$

Here, Dye represents a dye group, a dye group which has been temporarily shifted to the short wave length side or a dye precursor group, Y represents a single bond or a linking group, and Z represents a group which has the nature of producing a difference in the diffusibility of the compound represented by $(\text{Dye-Y})_n$-Z, or releasing Dye and producing a difference in the diffusibilities of the released Dye and $(\text{Dye-Y})_n$-Z, in correspondence or in counter-correspondence with the photosensitive silver salt in which a latent image has been formed in the form of the image, and n represents 1 or 2, and when n is 2 the two Dye-Y moieties may be the same or different.

Actual examples of dye donating compounds represented by general formula (LI) include the compounds described under the headings (1) to (5) below. Moreover, the compounds described under the headings (1) to (3) below form diffusible dye images in counter-correspondence with the development of the silver halide (positive dye images) and those described under the headings (4) and (5) form diffusible dye images in correspondence with the development of the silver halide (negative dye images).

(1) Dye developing agents in which a dye component is linked to a hydroquinone based developing agent as disclosed, for example, in U.S. Pat. Nos. 3,134,764, 3,362,819, 3,597,200, 3,544,545 and 3,482,972. These dye developing agents are diffusible under alkaline conditions but are rendered fast to diffusion on reaction with silver halide.

(2) Non-diffusible compounds which release a diffusible dye under alkaline conditions but which lose this ability on reaction with silver halide, as disclosed in U.S. Pat. No. 4,503,137, can also be used. Examples include the compounds which release diffusible dyes by means of an intramolecular nucleophilic substitution reaction disclosed in U.S. Pat. No. 3,980,479 and the compounds which release diffusible dyes by means of an intramolecular rearrangement reaction of a isooxazolone ring as disclosed in U.S. Pat. No. 4,199,354.

(3) Non-diffusible compounds which react with reducing agents which remain un-oxidized by development and release diffusible dyes as disclosed, for example, in U.S. Pat. No. 4,559,290, European Patent 220,746A2, U.S. Pat. No. 4,783,396 and Kokai Giho 87-6199 can also be used.

Examples include the compounds which release diffusible dyes by means of an intramolecular nucleophilic substitution reaction after reduction disclosed, for example, in U.S. Pat. Nos. 4,139,389 and 4,139,379, JP-A-59-185333 and JP-A-57-84453, the compounds which release a diffusible dye by means of an intramolecular electron transfer reaction after reduction disclosed, for example, in U.S. Pat. No. 4,232,107, JP-A-59-101649, JP-A-61-88257 and RD 24025 (1984), the compounds which release a diffusible dye via single bond cleavage after reduction disclosed, for example, in West German Patent 3,008,588A, JP-A-56-142530, and U.S. Pat. Nos. 4,343,893 and 4,619,884, the nitro compounds which release diffusible dyes after accepting an electron disclosed, for example, in U.S. Pat. No. 4,450,223, and the compounds which release diffusible dyes after accepting an electron disclosed, for example, in U.S. Pat. No. 4,609,610.

Furthermore, the compounds which have electron withdrawing groups and an N-X bond (where X represents an oxygen, sulfur or nitrogen atom) within the molecule disclosed, for example, in European Patent 220,746A2, Kokai Giho 87-6199, U.S. Pat. No. 4,783,396, JP-A-63-201653 and JP-A-63-201654, the compounds which have electron withdrawing groups and an $SO_2$-X bond (where X has the same significance as described immediately above) within the molecule disclosed in JP-A-1-26842, the compounds which have electron withdrawing groups and a PO-X bond (where X has the same significance as described immediately above) within the molecule as disclosed in JP-A-63-271344 and the compounds which have electron withdrawing groups and a C—X' bond (where X' is the same as X as described immediately above or —$SO_2$—) disclosed in JP-A-63-271341 are more preferable. Furthermore, the compounds which release diffusible dyes on the cleavage of a single bond after reduction by means of a $\pi$-bond which is conjugated with an electron accepting group disclosed in JP-A-1-161237 and 1-161342 can also be used.

From among these compounds, those which have an electron withdrawing group and an N—X bond within the molecule are especially preferred. Useful examples include the compounds in European Patent 220,746A2, compounds (1)–(3), (7)–(10), (12), (13), (15), (23)–(26), (31), (32), (35), (36), (40), (41), (44), (53)–(59), (64) and

(70) disclosed in U.S. Pat. No. 4,783,396, and compounds (11)–(23) disclosed in Kokai Giho 87-1699.

(4) Compounds which release diffusible dyes by means of a reaction with the oxidized form of a reducing agent, being couplers which have a diffusible dye as a leaving group (DDR couplers). Useful examples include those disclosed in British Patent 1,330,524, JP-B-48-39165 and U.S. Pat. Nos. 3,443,940, 4,474,867 and 4,483,914.

(5) Compounds which are reducing with respect to silver halide or organic silver salts and which release diffusible dyes on reduction (DRR compounds). These compounds preferably can be used singly so that there is no problem with image staining due to oxidative degradation of the reducing agent. Useful examples are disclosed, for example, in U.S. Pat. Nos. 3,928,312, 4,053,312, 4,055,428 and 4,336,322, JP-A-59-65839, JP-A-59-69839, JP-A-53-3819, JP-A-51-104343, RD 17465, U.S. Pat. Nos. 3,725,062, 3,728,113 and 3,443,939, JP-A-58-116537, JP-A-57-179840 and U.S. Pat. No. 4,500,626. Useful examples of DDR compounds include the compounds disclosed in columns 22 to 44 of the aforementioned U.S. Pat. No. 4,500,626, and compounds (1)–(3), (10)–(13), (16)–(19), (28)–(30), (33)–(35), (38)–(40) and (42)–(64) disclosed in the aforementioned U.S. Pat. No. 4,500,626 are preferred. Furthermore, the compounds disclosed in columns 37–39 of U.S. Pat. No. 4,639,408 can also be used.

Furthermore, the dye-silver compounds in which a dye is bonded to an organic silver salt (*Research Disclosure* May 1978, pages 54–58 for example), the azo dyes which are used in the heat-developable silver dye bleach method (U.S. Pat. No. 4,235,957, *Research Disclosure*, April 1976, pages 30–32 for example), and leuco dyes (U.S. Pat. Nos. 3,985,565 and 4,022,617 for example) can also be used as dye donating compounds other than the couplers and compounds of general formula [LI] described above.

Compounds which activate development and at the same time stabilize the image can be used in the photosensitive material in the case of a heat developable photosensitive material. Useful examples of compounds of which the use is preferred are disclosed in columns 51–52 of U.S. Pat. No. 4,500,626.

In a system where the image is formed by dye diffusion transfer, a dye fixing material is used along with the photosensitive material. The dye fixing material may be an embodiment in which it is coated separately on a separate support from the photosensitive element or it may be an embodiment in which it is coated onto the same support as the photosensitive element. The relationships disclosed in column 57 of U.S. Pat. No. 4,500,626 can also be applied here in respect of the relationship between the photosensitive material and the dye fixing material, the relationship with the support and the relationship with a white reflecting layer.

The dye fixing materials preferably used in this present invention have at least one layer which contains a mordant and a binder. The mordants known in the field of photography can be used for the mordant, and actual examples include those disclosed in columns 58–59 of U.S. Pat. No. 4,500,626 and on pages 32–41 of JP-A-61-88256, and those disclosed in JP-A-62-244043 and JP-A-62-244036. Furthermore, polymeric compounds which have dye accepting properties such as those disclosed in U.S. Pat. No. 4,463,079 can also be used.

Auxiliary layers, such as protective layers, peeling layers and anti-curl layers for example, can be established, as required, in a dye fixing material. The establishment of a protective layer is especially useful.

High boiling point organic solvents can be used as plasticizers, slip agents or as agents for improving the peeling properties of a photosensitive material and a dye fixing material in the structural layers of the photosensitive and dye fixing materials. In practice, use can be made of those disclosed, for example, on page 25 of JP-A-62-253159 and JP-A-62-245253.

Moreover, various silicone oils (all of the silicone oils ranging from-dimethylsilicone oil through to the modified silicone oils in which various organic groups have been introduced into dimethylsilicone) can be used for the above mentioned purposes. As an example, the use of the various modified silicone oils described in data sheet P6-18B, "Modified Silicone Oils", produced by the Shinetsu Silicone Co., and especially the carboxy modified silicone (trade name X-22-3710) is effective.

Furthermore, the silicone oils disclosed in JP-A-62-215953 and JP-A-63-46449 are also effective.

Image forming accelerators can be used in the photosensitive materials and/or dye fixing materials in this present invention. Image forming accelerators are compounds which function in such a way as to accelerate the redox reaction of the silver salt oxidizing agents and the reducing agent, to accelerate the reaction which produces the dye from the dye donating substance, which breaks down the dye or which releases a diffusible dye and accelerates the migration of the dye to the dye fixing layer, and on the basis of their physicochemical function, these can be divided into bases or base precursors, nucleophilic compounds, high boiling point organic solvent (oils), thermal solvents, surfactants, and compounds which interact with silver or silver ion, for example. However, these groups of substances generally have a complex function and normally combine a number of the above mentioned accelerating effects. Details have been disclosed in columns 38–40 of U.S. Pat. No. 4,678,739.

Base precursors are, for example, salts of a base and an organic acid which is decarboxylated by heating for use in heat developable photosensitive materials, and compounds which releases amines by an intramolecular nucleophilic substitution reaction, a Lossen rearrangement or a Beckmann rearrangement. Actual examples are disclosed, for example, in U.S. Pat. No. 4,511,493 and JP-A-62-65038.

In the systems in which development and dye transfer are carried out simultaneously in the presence of a small amount of water, the base and/or base precursor is preferably included in the dye fixing material in order to ensure good storage properties for the photosensitive material.

Apart from the above, the combinations of sparingly soluble metal compounds and compounds which can take part in a complex forming reaction (known as complex forming compounds) with the metal ions from which these sparingly soluble metal compounds are formed are disclosed in European Patent Laid Open 210,660 and U.S. Pat. No. 4,740,445, and the compounds which produce bases by electrolysis disclosed in JP-A-61-232451, for example, can also be used as base precursors. The former method is particularly effective. The sparingly soluble metal compound and the complex forming compound are usefully added separately to the photosensitive material and the dye fixing material.

Various development terminating agents can be used in photosensitive materials and/or dye fixing materials of this present invention with a view to obtaining a constant image irrespective of fluctuations in the processing temperature and the processing time during development.

Here, the term "development terminating agent" signifies a compound which, after proper development, neutralizes the base or reacts with the base, reduces the base concentration in the film and terminates development, or a compound which interacts with silver and silver salts and inhibits development. In practice, these compounds include acid polymers and nitrogen containing heterocyclic compounds, mercapto compounds and precursors of these compounds. Furthermore, acid precursors which release acids on heating, and electrophilic compounds which undergo substitution reactions with a base on heating can be used in heat developable photosensitive materials, and further details have been disclosed on pages 31–32 of JP-A-62-253159.

The methods which can be used for exposing and recording an image on the photosensitive material include those in which the picture of a view or a person is taken directly using a camera for example, methods in which an exposure is made though a reversal film or a negative film using a printer or an enlarger, methods in which a scanning exposure of an original is made through a slit using the exposing device of a copying machine for example, methods in which the exposure is made with light emitted from a light emitting diode or various types of laser, being controlled by an electrical signal in accordance with picture information, and methods in which exposures are made directly or via an optical system using the image information output of an image display device such as a CRT, a liquid crystal display, an electro-luminescent display or a plasma display.

As indicated above, natural light, tungsten lamps, light emitting diodes, laser light sources and CRT light sources, for example, the light sources disclosed in column 56 of U.S. Pat. No. 4,500,626, can be used as light sources for recording images on the photosensitive material.

Furthermore, image exposures can also be made using wave-length conversion elements in which a non-linear optical material is combined with a coherent light source such as laser light for example. Here, a non-linear optical material is a material which is such that when irradiated with a strong photoelectric field such as laser light it exhibits a non-linearity between the apparent polarization and the electric field, and inorganic compounds as typified by lithium niobate, potassium dihydrogen phosphate (KDP), lithium iodate and $BaB_2O_4$, and urea derivatives, nitroaniline derivatives, nitropyridine-N-oxide derivatives such as 3-methyl-4-nitropyridine-N-oxide (POM) for example, and the compounds disclosed in JP-A-61-53462 and JP-A-62-210432 are preferably used for this purpose. Any of the known embodiments of wavelength converting elements such as the single crystal optical wave guide type and the fibre type can be used.

Furthermore, the aforementioned image information may be an image signal which has been obtained using a video camera or an electronic still camera for example, a television signal as typified by the Japanese television signal specification (NTSC), an image signal obtained by dividing an original into a plurality of picture elements using a scanner for example, or an image signal which has been generated using a computer as typified by CG and CAD for example.

The processing methods for heat developable photosensitive materials of the present invention are described below.

The photosensitive material and/or dye fixing material may be such that they have an electrically conductive heat generating layer as a means of heating for thermal development purposes or for the diffusion transfer of dyes by heating. In such a case a transparent or opaque heat generating element can be used, as disclosed in JP-A-61-145544. Moreover, such an electrically conductive layer also functions as an antistatic layer.

Thermal development is possible at heating temperatures of from about 50° C. to about 250° C., but heating temperatures of from about 80° C. to about 180° C. are especially useful in the thermal development process. A dye diffusion transfer process may be carried out at the same time as thermal development, or it may be carried out after the completion of the thermal development process. In the latter case, transfer is possible with heating temperatures for the transfer process within the range from the temperature in the thermal development process to room temperature, but temperatures of at least 50° C. but about 10° C. lower than the temperature encountered during the thermal development process are preferred.

Dye transfer can be achieved by heat alone, but solvents may be used in order to promote dye transfer.

Furthermore, the methods in which development and transfer are carried out simultaneously or continuously by heating in the presence of a small amount of solvent (especially water) as described in detail in JP-A-59-218443 and JP-A-61-238056 are also useful. In these methods the heating temperature is preferably at least 50° C. but below the boiling point of the solvent and, for example, when water is used for the solvent, a temperature of at least 50° C. but less than 100° C. is desirable.

Water or a basic aqueous solution which contains an inorganic alkali metal salt or an organic base (the bases disclosed in the section on image forming accelerators can be used for the base) can be cited as examples of solvents which can be used to accelerate development and/or to transfer a diffusible dye to the dye fixing layer. Furthermore, low boiling point solvents or mixtures of low boiling point solvents and water or with basic aqueous solutions, for example, can also be used. Furthermore, surfactants, anti-fogging agents, and sparingly soluble metal salts and complex forming compounds, for example, may be included in the solvent.

These solvents may be applied to the dye fixing material, to the photosensitive material or to both of these materials. The amount used should be relatively small, being not more than the amount of solvent corresponding to the maximum swelled volume of the whole coated film (in particular, not more than the amount obtained on subtracting the weight of the whole coated film from the weight of solvent corresponding to the maximum swelled volume of the whole coated film).

The method described on page 26 of JP-A-61-147244 can be used, for example, for applying a solvent to a photosensitive layer or a dye fixing layer. Furthermore, the solvent can also be incorporated into the photosensitive material, the dye fixing material or both of these materials beforehand in a form in which it has been enclosed by micro-encapsulation.

Furthermore, methods in which a hydrophilic thermal solvent which is a solid at normal temperature but which melts at elevated temperatures is incorporated in the photosensitive material or dye fixing material can also be adopted for accelerating dye transfer. The hydrophilic thermal solvent may be incorporated into the photosensitive material or the dye fixing material, or it may be incorporated into both of these materials. The layer into which it is incorporated may be an emulsion layer, an intermediate layer, a protective layer or a dye fixing layer, but it is preferably incorporated into a dye fixing layer and/or a layer adjacent thereto.

Examples of hydrophilic thermal solvents include ureas, pyridines, amides, sulfonamides, imides, alnyles, oximes and other heterocyclic compounds.

Furthermore, high boiling point organic solvents may be included in a photosensitive material and/or dye fixing material in order to accelerate dye transfer.

Sometimes the material is brought into contact with a heated block or plate, sometimes the material is brought into contact with a hot plate, a hot presser, a heated roller, a halogen lamp heater or an infrared or far-infrared lamp heater for example, and sometimes the material is passed through a high temperature atmosphere as a means of heating in a development and/or transfer process.

The method by which a photosensitive material and a dye fixing material are brought together under the pressing conditions when they are brought into contact and pressure disclosed, for example, on page 27 of JP-A-61-147244 can be used.

Any of the various thermal development devices can be used for processing photographic elements of this present invention. For example, use of the devices disclosed, for example, in JP-A-59-75247, JP-A-59-177547, JP-A-59-181353, JP-A-60-18951 and JP-A-U-62-25944 is desirable. (The term "JP-A-U" as used herein signifies an "unexamined published Japanese utility model application".)

EXAMPLE 1

The preparation of a dye fixing material is described below.

A dye fixing material having the structure shown in Table 1 was prepared by providing the coated layer structure of the first to the third layers on a high quality paper support which had been laminated with polyethylene and on which the first and second backing layers had been pre-coated and dried having the structure shown in Table 2 and the properties shown in Table 3.

Moreover, the first to third layers were coated simultaneously with a coated layer application rate of 15 cc/m$^2$, 40 cc/m$^2$ and 15 cc/m$^2$, respectively.

A 10 m cold zone was established after coating, after which drying was carried out in a draught of 30° C., 30% RH.

TABLE 1

Structure of Dye Fixing Material

| Number | Additive | Amount Added (g/m$^2$) |
|---|---|---|
| Third Layer | Water soluble polymer (1) | 0.05 |
| | Silicone oil (1) | 0.04 |
| | Surfactant (1) | 0.001 |
| | Surfactant (2) | 0.02 |
| | Surfactant (3) | 0.10 |
| | Matting agent (1) | 0.02 |
| | Guanidine picolinate | 0.45 |
| | κ-Carrageenan | 0.12 |
| Second Layer | Mordant (1) | 2.35 |
| | Water soluble polymer (1) | 0.20 |
| | Gelatin | 1.40 |
| | Water soluble polymer (2) | 0.60 |
| | High boiling point solvent (1) | 1.40 |
| | Guanidine picolinate | 2.25 |
| | Fluorescent whitener (1) | 0.05 |
| | Surfactant (5) | 0.15 |
| First Layer | Gelatin | 0.45 |
| | Surfactant (3) | 0.01 |
| | Water soluble polymer (1) | 0.04 |
| | Film hardening agent (1) | 0.30 |
| Support (1) | | |
| First Backing Layer | Gelatin | 3.25 |
| | Film hardening agent (1) | 0.25 |
| Second Backing Layer | Gelatin | 0.44 |
| | Silicone oil (1) | 0.08 |
| | Surfactant (4) | 0.04 |
| | Surfactant (5) | 0.01 |
| | Matting agent (2) | 0.03 |

TABLE 2

Structure of the Support

| Layer Name | Composition | | Film Thickness (μ) |
|---|---|---|---|
| Surface Under-layer | Gelatin | | 0.1 |
| Surface PE Layer (Glossy) | Low density polyethylene (density 0.923) | 89.2 parts | 45.0 |
| | Surface treated titanium oxide | 10.0 parts | |
| | Ultramarine | 0.8 parts | |
| Pulp Layer | Top quality paper (LBKP/NBKP = 1:1) density 1.080 | | 92.6 |
| Reverse PE Layer (Matt) | High density polyethylene (density 0.960) | | 30.0 |
| Reverse Side Under-layer | Gelatin | | 0.05 |
| | Colloidal silica | | 0.05 |
| | | TOTAL | 173.8 |

TABLE 3

Properties of Support

| Item | Units | Physical Values | Measurement Method |
|---|---|---|---|
| Rigidity (length/width) | gram | 4.40/3.15 | T-Bar Rigidity Gauge |
| Whiteness | | L* 94.20<br>A* +0.12<br>B* −2.75 | CIE L*a*b* |

Silicone Oil (1)

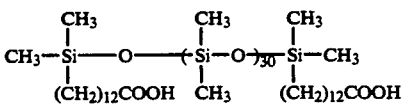

Surfactant (1)

TABLE 3-continued

| Item | Properties of Support: Units | Physical Values | Measurement Method |
|---|---|---|---|
| $C_nH_{2n+1}$—(C6H4)—$SO_3Na$ | | n ≈ 12.6 | |
| Surfactant (2) | | | |
| $C_8F_{17}SO_2N(C_3H_7)CH_2COOK$ | | | |
| Surfactant (3) | | | |
| $C_{11}H_{23}CONHCH_2CH_2CH_2N^{\oplus}(CH_3)_2CH_2COO^{\ominus}$ | | | |
| Surfactant (4) | | | |
| $NaO_3S$—$CH(CH_2COOCH_2CH(C_2H_5)C_4H_9)$—$COOCH_2CH(C_2H_5)C_4H_9$ | | | |
| Fluorescent Whitener (1) | | | |
| 2,5-Bis-(5-tert-butylbenzoxazole(2))thiophene | | | |
| Surfactant (5) | | | |
| $C_8F_{17}SO_2N(C_3H_7)(CH_2CH_2O)_4(CH_2)_4SO_4Na$ | | | |
| Water Soluble Polymer (1) | | | |
| Sumikagel $L_5$—H (made by Sumitomo Chemical Co.) | | | |
| Water Soluble Polymer (2) | | | |
| dextran (molecular weight 70,000) | | | |
| Mordant (1) | | | |
| $(CH_2-CH)_{60}(CH_2-CH)_{30}(CH_2-CH)_{10}$ (N; N; N; =O; $SO_2K$) | | | |
| High Boiling Point Solvent (1) | | | |
| $C_6H_4(CO_2C_{12}H_{25})_2$ | | | |
| Film Hardening Agent (1) | | | |
| $(CH_2)_4(O-CH_2-CH(O))_2$ | | | |
| Matting Agent (1) | | | |
| Silica | | | |
| Matting Agent (2) | | | |
| Benzoguanamine resin (average particle size 15μ) | | | |

The preparation of the emulsions is described below.

Photosensitive Silver Halide Emulsion (I) (Red Sensitive Emulsion Layer)

Solutions (I) and (II) indicated below were added simultaneously at an even flow rate over a period of 30 minutes to a thoroughly agitated aqueous gelatin solution (a solution obtained by adding 20 grams of gelatin, 0.3 gram of potassium bromide, 6 grams of sodium chloride and 30 mg of Reagent A indicated below to 800 ml of water and maintaining at a temperature of 50° C.). Subsequently, solutions (III) and (IV) indicated below in Tables 3 and 4 were added simultaneously over a period of 30 minutes. Furthermore, the dye solution containing the combination of dyes indicated below was added over a period of 20 minutes starting 3 minutes after the commencement of the addition of solutions (III) and (IV).

After washing with water and de-salting, 22 grams of lime treated ossein gelatin was added and, after adjustment to pH 6.2 and pAg 7.7, sodium thiosulfate and 4-hydroxy-6-methyl-1,3,3a,7-tetra-azaindene and chloroauric acid were added and the mixture was chemically sensitized optimally at 60° C. A monodisperse cubic silver chlorobromide emulsion of average grain size 0.38μ was obtained in this way. (Variation Coefficient 0.11) The recovery was 635 grams.

TABLE 4

| | Solution (I) Water Added to 200 ml | Solution (II) Water Added to 200 ml |
|---|---|---|
| $AgNO_3$ (grams) | 50.0 g | — |
| KBr | — | 28.0 g |
| NaCl | — | 3.4 g |

TABLE 4'

| | Solution (III) Water Added to 200 ml | Solution (IV) Water Added to 200 ml |
|---|---|---|
| $AgNO_3$ (grams) | 50.0 g | — |
| KBr | — | 35.0 g |
| Reagent A | | |

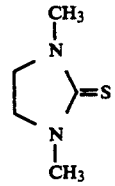

Dye Solution

The dye (a) indicated below (67 mg) and 133 mg of the Dye (b) indicated below were dissolved in 100 ml of methanol.

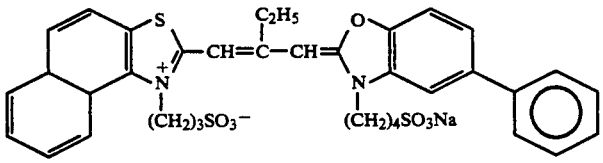

Dye (a)

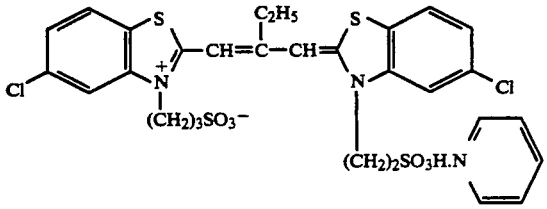

Dye (b)

Photosensitive Silver Halide Emulsion (II) (Green Sensitive Emulsion Layer)

Solution (I) and solution (II) shown in Table 6 were added over a period of 30 minutes to a thoroughly agitated aqueous gelatin solution (Table 5) which was being maintained at 50° C. Next, solution (III) and solution (IV) shown, in Table 6, were added over a period of 30 minutes and the dye solution shown in Table 7 was added 1 minute after completion of this addition.

TABLE 5

| | |
|---|---|
| Gelatin | 20 grams |
| NaCl | 6 grams |
| KBr | 0.3 gram |
| 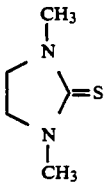 | 0.015 gram |
| $H_2O$ | 730 ml |

TABLE 6

| | I | II | III | IV |
|---|---|---|---|---|
| $AgNO_3$ | 50 grams | — | 50 grams | — |
| KBr | — | 21 grams | — | 28 grams |
| NaCl | — | 6.9 grams | — | 3.5 grams |
| $H_2O$ Added to total | 200 cc | 200 cc | 200 cc | 20 cc |

After washing with water and de-salting, 20 grams of gelatin was added, the pH and pAg values were adjusted and chemical sensitization was carried out optimally using triethylthiourea, chloroauric acid and 4-hydroxy-6-methyl-1,3,3a,7-tetra-azaindene. The emulsion obtained was a 0.40μ mono-disperse cubic emulsion (variation coefficient 0.15) and the recovery was 630 grams.

Photosensitive Silver Halide Emulsion (III) (Blue Sensitive Emulsion Layer)

Solution (1) and Solution (2) indicated below in Table 8 were added simultaneously over a period of 30 minutes to a thoroughly agitated aqueous gelatin solution (obtained by adding 20 grams of gelatin, 3 grams of potassium bromide, 0.03 gram of the compound (1) indicated below and 0.25 gram of $HO(CH_2)_2S(CH_2)_2S(CH_2)_2OH$ to 800 cc of water and maintaining at 50° C.). Subsequently, Solution (3) and solution (4) indicated below in Table 8 were added simultaneously over a period of 20 minutes. Furthermore, the dye solution containing the combination of dyes indicated below was added over a period of 18 minutes starting 5 minutes after the commencement of the addition of Solution (3).

After washing with water and desalting, 20 grams of lime treated ossein gelatin was added and, after adjusting to pH 6.2 and pAg 8.5, sodium thiosulfate and 4-hydroxy-6-methyl-1,3,3a,7-tetra-azaindene, and chloroauric acid, were added and the mixture was optimally chemically sensitized. Six hundred grams of a monodisperse cubic silver chlorobromide emulsion of average grain size 0.40μ (variation coefficient 0.12) was obtained in this way.

TABLE 7

| | |
|---|---|
| 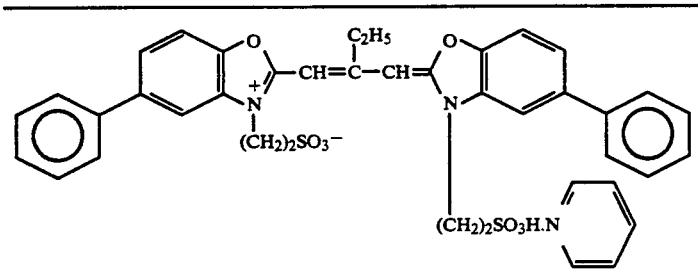 | 0.23 g |
| Methanol | 154 cc |

TABLE 8

| | Solution (1) in Water 180 ml | Solution (2) in Water 180 ml | Solution (3) in Water 350 ml | Solution (4) in Water 350 ml |
|---|---|---|---|---|
| $AgNO_3$ | 30 grams | — | 70 grams | — |
| KBr | — | 17.8 grams | — | 49 grams |
| NaCl | — | 1.6 grams | — | — |
| Dye Solution | | | | |

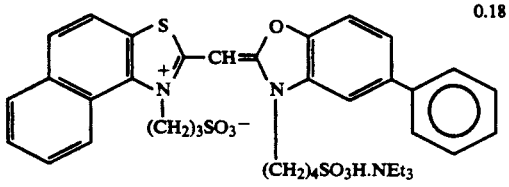

0.18 gram

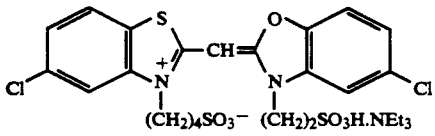

0.06 gram

Compound (1)

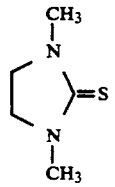

The dyes indicated above were dissolved in 160 cc of methanol.

The preparation of a zinc hydroxide dispersion used in the photosensitive material as described below is as follows.

Zinc hydroxide of average particle size 0.2μ (12.5 grams), 0.1 gram of poly(sodium acrylate) and 1 gram of carboxymethylcellulose as dispersant were added to 100 cc of 4% aqueous gelatin solution and pulverized for 30 minutes using glass beads of average diameter 0.75 mm in a mill. The glass beads were then removed and a dispersion of zinc hydroxide was obtained.

The preparation of an active carbon dispersion used in the photosensitive material as described below is as follows.

Active carbon powder (special reagent grade, 2.5 grams) made by the Wako Pure Drug Co. and 0.25 gram of polyethylene glycol nonylphenyl ether and 1 gram of Demol N made by the Kao Soap Co. as dispersant were added to 100 cc of 5% aqueous gelatin solution and pulverized for 120 minutes using glass beads of average diameter 0.75 mm in a mill. The glass beads were then removed and a dispersion of active carbon of average particle size 0.5μ was obtained.

The preparation of a dispersion of an electron transfer agent is described below.

The electron transfer agent indicated below (10 grams), 0.5 gram of the anionic surfactant indicated below and 0.5 gram of polyethyleneglycol nonylphenyl ether as dispersant were added to a 5% aqueous gelatin solution and pulverized for 60 minutes using glass beads of average diameter 0.75 mm in a mill. The glass beads were then removed and a dispersion of the electron transfer agent of average particle size 0.3μ was obtained.

Electron Transfer Agent

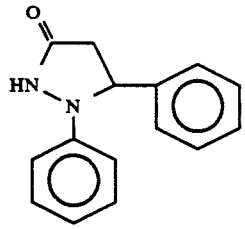

Anionic Surfactant

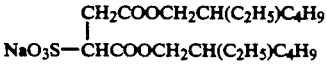

The preparation of gelatin dispersions of dye donating compounds is described below.

The yellow, magenta and cyan formulations are shown below in Table 9, and these were added to 50 ml of ethyl acetate in each case and heated to about 60° C. and dissolved to provide uniform solutions. The solutions were then mixed with agitation with 100 grams of 10% aqueous lime treated gelatin solution, 0.6 gram of sodium dodecylbenzenesulfonate and 50 cc of water and then dispersed at 10,000 rpm for 10 minutes in a homogenizer. The dispersions obtained were referred to as gelatin dispersions of the dye donating compounds.

TABLE 9

| | Yellow (1) | Magenta (2) | Cyan (3) |
|---|---|---|---|
| Dye donating compound indicated below | 13 grams | 15.5 grams | 16.6 grams |
| Electron donor (1) indicated below | 10.2 grams | 8.6 grams | 8.1 grams |
| High boiling point solvent (2) indicated below | 6.5 grams | 7.8 grams | 8.3 grams |
| Electron transfer agent precursor (3) indicated below | 0.4 gram | 0.7 gram | 0.7 gram |
| Compound A indicated below | 3.9 grams | — | — |

Dye Donating Compound (1)

TABLE 9-continued
| | Yellow (1) | Magenta (2) | Cyan (3) |
|---|---|---|---|
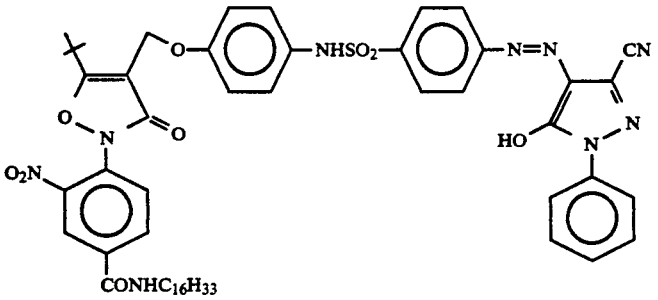
Dye Donating Compound (2)
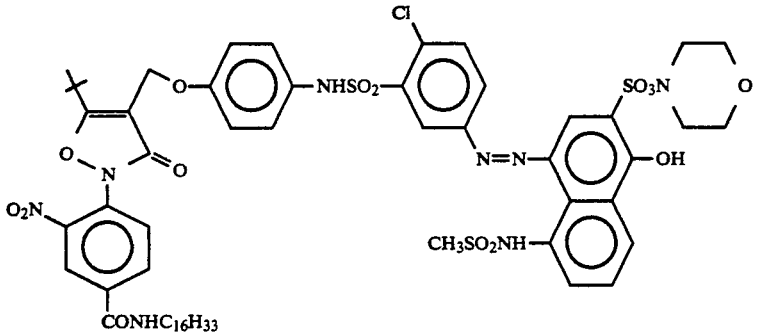
Dye Donating Compound (3)
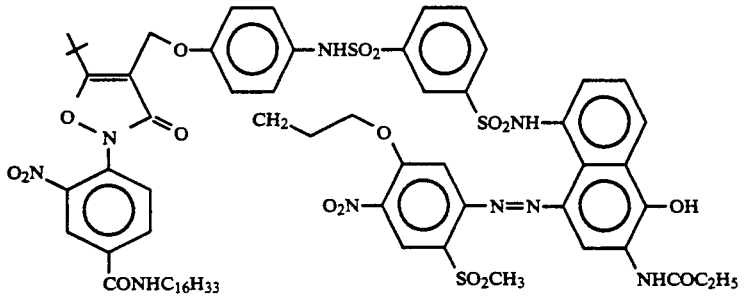
Electron Donor (1)
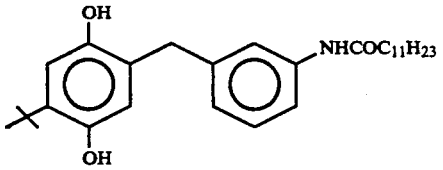
High Boiling Point Solvent (2)
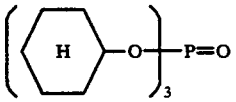
Electron Transfer Agent Precursor (3)

TABLE 9-continued

| | Yellow (1) | Magenta (2) | Cyan (3) |
|---|---|---|---|

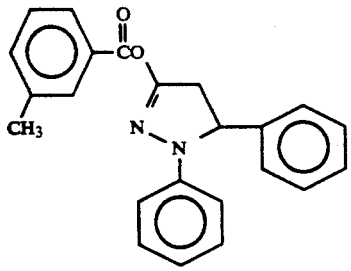

Compound A $CO_2C_{12}H_{25}$
|
$CO_2C_{12}H_{25}$

The preparation of a gelatin dispersion of the intermediate layer electron donor (4) is described below.

The electron donor (4) indicated below (23.6 grams) and 8.5 grams of the above mentioned high boiling point solvent (2) were added to 30 ml of ethyl acetate and a uniform solution was obtained. This solution and 100 grams of 10% aqueous lime treated gelatin solution, 0.25 gram of sodium bisulfite, 0.3 gram of sodium dodecylbenzenesulfonate and 30 ml of water were mixed together by stirring and then dispersed at 10,000 rpm for 10 minutes in a homogenizer. This dispersion is referred to as a gelatin dispersion of the electron donor (4).

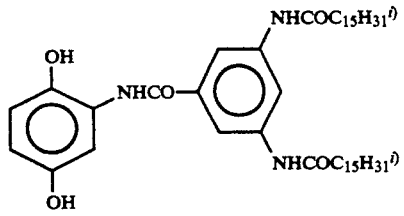

Electron Donor 4

The color photosensitive material 101 as shown in Table 10 was prepared using these emulsions and dispersions.

TABLE 10

Structure of the Photosensitive Material

| Layer Number | Layer Name | | Coated Weight ($mg/m^2$) |
|---|---|---|---|
| Sixth Layer | Protective layer | Gelatin | 720 |
| | | Silica (size 4μ) | 40 |
| | | Zinc hydroxide | 900 |
| | | Surfactant (Note 1) | 130 |
| | | Surfactant (Note 2) | 26 |
| | | Poly(vinyl alcohol) (average mol. wt. 2,000) | 63 |
| | | Dextran (average mol. wt. 70,000) | 30 |
| | | Water soluble polymer (Note 3) | 8 |
| Fifth Layer | Blue Sensitive Emulsion Layer | Photosensitive silver halide emulsion (III) as silver | 380 |
| | | Anti-fogging agent (Note 4) | 0.9 |
| | | Gelatin | 560 |
| | | Yellow dye donating compound (1) | 400 |
| | | Electron donor (1) | 320 |
| | | Electron transfer agent precursor (3) | 25 |
| | | Compound A | 120 |
| | | High boiling point solvent (2) | 200 |
| | | Surfactant (Note 5) | 45 |
| | | Water soluble polymer (Note 3) | 13 |
| Fourth Layer | Intermediate Layer | Gelatin | 620 |
| | | Electron donor (4) | 130 |
| | | High boiling point solvent (2) | 48 |
| | | Electron transfer agent (Note 7) | 85 |
| | | Surfactant (Note 2) | 15 |
| | | Surfactant (Note 5) | 4 |
| | | Surfactant (Note 6) | 30 |
| | | Poly(vinyl alcohol) (mol. wt. 2,000) | 30 |
| | | Dextran (mol. wt. 70,000) | 40 |
| | | Water soluble polymer (Note 3) | 19 |
| | | Film hardening agent (Note 8) | 37 |
| Third Layer | Green Sensitive Emulsion Layer | Photosensitive silver halide emulsion (II) as silver | 220 |
| | | Anti-fogging agent (Note 9) | 0.7 |
| | | Gelatin | 370 |
| | | Magenta dye donating compound (2) | 350 |
| | | Electron donor (1) | 195 |
| | | Electron transfer agent precursor (3) | 33 |

TABLE 10-continued

Structure of the Photosensitive Material

| Layer Number | Layer Name | | Coated Weight ($mg/m^2$) |
|---|---|---|---|
| | | High boiling point solvent (2) | 175 |
| | | Surfactant (Note 5) | 47 |
| | | Water soluble polymer (Note 3) | 11 |
| Second Layer | Intermediate | Gelatin | 730 |
| | Layer | Zinc hydroxide | 300 |
| | | Electron donor (4) | 130 |
| | | High boiling point solvent (2) | 50 |
| | | Surfactant (Note 2) | 11 |
| | | Surfactant (Note 5) | 4 |
| | | Surfactant (Note 6) | ~50 |
| | | Poly(vinyl alcohol) (mol. wt. 2,000) | 50 |
| | | Dextran (mol. wt. 70,000) | 40 |
| | | Water soluble polymer (Note 3) | 12 |
| | | Active carbon | 25 |
| First Layer | Red Sensitive | Photosensitive silver halide emulsion (I) | 330 |
| | Emulsion Layer | | as silver |
| | | Anti-fogging agent (Note 9) | 0.7 |
| | | Gelatin | 330 |
| | | Cyan dye donating compound (3) | 340 |
| | | Electron donor (1) | 133 |
| | | Electron transfer agent precursor (3) | 30 |
| | | High boiling point solvent (2) | 170 |
| | | Surfactant (Note 5) | 40 |
| | | Water soluble polymer (Note 3) | 5 |
| Support | | Poly(ethylene terephthalate) 96μ | |
| Backing | | Carbon black | 440 |
| Layer | | Polyester | 300 |

TABLE 10-continued

| Structure of the Photosensitive Material | | |
|---|---|---|
| Layer Number | Layer Name | Coated Weight ($mg/m^2$) |
| | Poly(vinyl chloride) | 300 |

Note 1) Surfactant

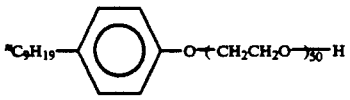

Note 2) Surfactant

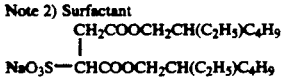

Note 3) Water Soluble Polymer

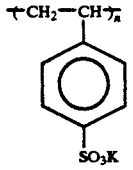

Note 4) Anti-fogging Agent

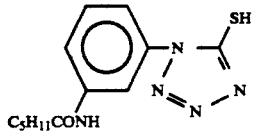

Note 5) Surfactant

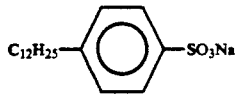

Note 6) Surfactant

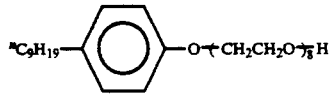

Note 7) Electron Transfer Agent

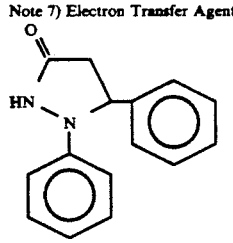

Note 8) Film Hardening Agent
1,2-Bis(vinylsulfonylacetamido)ethane
Note 9) Anti-fogging Agent

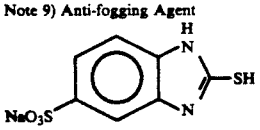

Photosensitive materials 102–106 which had the same structure as photosensitive material 101 except that PUG releasing compounds (1), (5), (10) and (12), described earlier, of this present invention or the comparative compound indicated below were added, respectively, at the rate of 20 mol % with respect to the electron donor (4) to the second and fourth layers of photosensitive material 101 were also prepared.

Comparative Compound

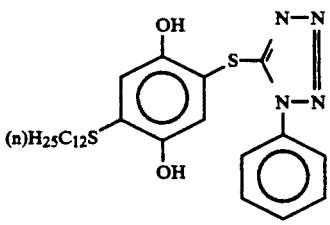

Photosensitive materials 101 to 106 were exposed from the emulsion side through yellow (Y), magenta (M) and cyan (C) color separation filters and then they were immersed in water at 35° C. for 3 seconds and passed through a squeeze roller and the excess water was removed. Next, they were laminated with the emulsion layer surface in contact with the image receiving layer of a dye fixing element described above and, after heating to 80° C. for 15 seconds, the photosensitive material and the dye fixing material were peeled apart.

The magenta density, designated (a), when the yellow density was 1.0, the cyan density, designated (b), when the magenta density was 1.0, and the magenta density, designated (c), when the cyan density was 1.0 of the positive images obtained on the dye fixing material were measured and the degree of color turbidity was investigated. The results obtained are shown in Table 11.

TABLE 11

| Photosensitive Material No. | Degree of Color Turbidity (a) | (b) | (c) |
|---|---|---|---|
| 101 (Comparative Example) | 0.32 | 0.29 | 0.38 |
| 102 (This Invention) | 0.26 | 0.21 | 0.30 |
| 103 (This Invention) | 0.25 | 0.19 | 0.29 |

TABLE 11-continued

| Photosensitive Material No. | Degree of Color Turbidity (a) | (b) | (c) |
|---|---|---|---|
| 104 (This Invention) | 0.26 | 0.20 | 0.29 |
| 105 (This Invention) | 0.24 | 0.20 | 0.28 |
| 106 (Comparative Example) | 0.29 | 0.24 | 0.34 |

It is clear from the results outlined above that color turbidity is improved by the use of a PUG releasing compound of this present invention and that color reproduction properties are improved.

EXAMPLE 2

Photosensitive material 201 which has the structure shown in Table 12 below was prepared using the same emulsions, dye donating substances and electron donors as in Example 1. Moreover, photosensitive material 202 was prepared by adding PUG releasing compound (15), described earlier, of this present invention at rates of 0.02 g/m$^2$ and 0.03 g/m$^2$ to the second and fourth layers respectively of photosensitive materials 201.

TABLE 12

| Layer Number | Layer Name | Additive | Coated Weight (g/m$^2$) |
|---|---|---|---|
| Sixth Layer | Protective layer | Gelatin | 0.90 |
| | | Matting agent (silica) | 0.03 |
| | | Water soluble polymer (Note 3) | 0.02 |
| | | Surfactant (Note 2) | 0.06 |
| | | Surfactant (Note 1) | 0.13 |
| | | Film hardening agent (Note 8) | $6 \times 10^{-3}$ |
| Fifth Layer | Blue Sensitive Emulsion Layer | Emulsion (III) | as silver 0.38 |
| | | Gelatin | 0.56 |
| | | Anti-foggant (Note 4) | $3.0 \times 10^{-4}$ |
| | | Yellow dye donating compound (1) | 0.40 |
| | | High boiling point organic solvent (2) | 0.20 |
| | | Electron donor (1) | 0.31 |
| | | Surfactant (Note 5) | 0.05 |
| | | Film hardening agent (Note 8) | $6 \times 10^{-3}$ |
| | | Water soluble polymer (Note 3) | 0.02 |
| Fourth Layer | Intermediate Layer | Gelatin | 0.70 |
| | | Electron donor (4) | 0.18 |
| | | High boiling point solvent (2) | 0.06 |
| | | Surfactant (Note 5) | $8.2 \times 10^{-3}$ |
| | | Surfactant (Note 2) | 0.02 |
| | | Surfactant (Note 6) | 0.07 |
| | | Water soluble polymer (Note 3) | 0.02 |
| | | Film hardening agent (Note 8) | $6 \times 10^{-3}$ |
| Third Layer | Green Sensitive Emulsion Layer | Emulsion (II) | as silver 0.21 |
| | | Gelatin | 0.29 |
| | | Anti-foggant (Note 9) | $2.0 \times 10^{-4}$ |
| | | Magenta dye donating compound (2) | 0.31 |
| | | High boiling point organic solvent (2) | 0.16 |
| | | Electron donor (1) | 0.17 |
| | | Surfactant (Note 5) | 0.04 |
| | | Film hardening agent (Note 8) | $6 \times 10^{-3}$ |
| | | Water soluble polymer (Note 3) | 0.02 |
| Second Layer | Intermediate Layer | Gelatin | 0.80 |
| | | Electron donor (4) | 0.18 |
| | | High boiling point solvent (2) | 0.06 |
| | | Surfactant (Note 5) | $8.2 \times 10^{-3}$ |
| | | Surfactant (Note 2) | 0.06 |
| | | Surfactant (Note 6) | 0.10 |
| | | Active carbon | 0.03 |
| | | Water soluble polymer (Note 3) | 0.03 |
| | | Film hardening agent (Note 8) | $6 \times 10^{-3}$ |
| First Layer | Red Sensitive Emulsion Layer | Emulsion (I) | 0.22 as Ag |
| | | Gelatin | 0.30 |
| | | Anti-foggant (Note 9) | $2.0 \times 10^{-4}$ |
| | | Cyan dye donating compound (3) | 0.39 |
| | | High boiling point organic solvent (2) | 0.19 |
| | | Electron donor (1) | 0.19 |
| | | Surfactant (Note 5) | 0.04 |
| | | Film hardening agent (Note 8) | $6 \times 10^{-3}$ |
| | | Water soluble polymer (Note 3) | 0.02 |
| | Support | (Poly(ethylene terphthalate), Thickness 100μ) | |
| Backing Layer | | Carbon black | 0.44 |
| | | Polyester | 0.30 |

TABLE 12-continued

| Layer Number | Layer Name | Additive | Coated Weight (g/m²) |
|---|---|---|---|
| | | Poly(vinyl chloride) | 0.30 |

A dye fixing material was prepared in the manner described below.

Paper Support:

Polyethylene of thickness 30μ was laminated on both sides of a paper support of thickness 150μ. Titanium oxide (10% by weight with respect to the polyethylene) was dispersed and added to the polyethylene on the image receiving layer side.

Backing Side:

(a) A light shielding layer of 4.0 g/m² of carbon black and 2.0 g/m² of gelatin.

(b) A white layer of 8.0 g/m² of titanium oxide and 1.0 g/m² of gelatin.

(c) A protective layer of 0.6 g/m² of gelatin.

These were established in the sequential order (a)–(c) by coating and hardened with a film hardening agent.

Image Receiving Layer Side:

(1) A neutralizing layer containing 22 g/m² of an acrylic acid/butyl acrylate (mol ratio 8:2) copolymer of average molecular weight 50,000.

(2) A second timing layer containing a total of 4.5 g/m² of cellulose acetate of 51.3% acetylation (of which the weight of acetic acid liberated on hydrolysis was 0.513 grams per gram of sample) and a styrene/maleic anhydride (mol ratio 1:1) copolymer of average molecular weight about 10,000 in the proportions by weight of 95 to 5.

(3) An intermediate layer containing 0.4 grams/m² of poly(2-hydroxyethyl acrylate).

(4) A first timing layer containing 1.6 g/m² as solid fraction of a blend in the proportions as solid fractions of 6 to 4 of a polymer latex obtained by the emulsion polymerization in the ratio by weight of 49.7/42.3/4/4 of styrene/butyl acrylate/acrylic acid/N-methylolacrylamide and a polymer latex obtained by the emulsion polymerization in the proportions by weight of 93/3/4 of methyl methacrylate/acrylic acid/N-methylolacrylamide.

(5) An image receiving layer was established by coating 3.0 g/m² of a polymer mordant which had repeating units as indicated below and 3.0 g/m² of gelatin, using the following compound with n=30 as a coating aid.

Polymer mordant

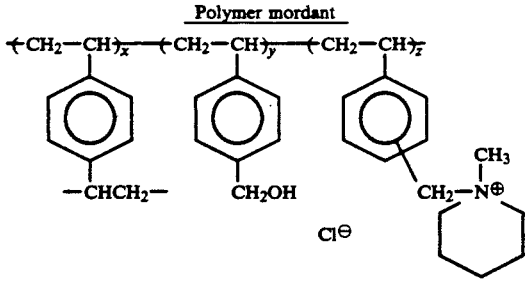

x:y:z = 5:5:90

Coating aid

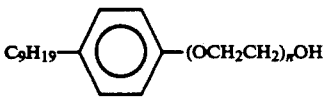

-continued
(n = 30)

(6) A protective layer established by coating 0.6 g/m² of gelatin.

The First-Sixth layers indicated above were established sequentially by coating and hardened with a film hardening agent.

The formulation of the processing fluid is indicated below.

| | |
|---|---|
| 1-p-Tolyl-4-hydroxymethyl-4-methyl-3-pyrazolidone | 8.0 grams |
| 1-Phenyl-4-hydroxymethyl-4-methyl-3-pyrazolidone | 2.0 grams |
| Sodium sulfite (anhydrous) | 2.0 grams |
| Hydroxyethylcellulose | 40 grams |
| Potassium hydroxide | 56 grams |
| Benzyl alcohol | 2.0 grams |
| Water to make up to a total weight of | 1 kg |

The aforementioned photosensitive materials were exposed from the emulsion layer side through Y, M, C and gray color separation filters and then they were laminated on the image receiving layer side of the dye fixing material and the above mentioned processing fluid was spread by means of pressure rollers to a thickness of 65μ between the two materials. Processing was carried out at 25° C. and the dye fixing material was peeled away from the photosensitive material after 1.5 minutes.

Next, the magenta density, designated as (a), on providing a yellow density of 1.0, the cyan density, designated as (b), on providing a magenta density of 1.0 and the magenta density, designated as (c), on providing a cyan density of 1.0 of the positive images obtained on the dye fixing material were measured and the degree of color turbidity was investigated. The results obtained are shown in Table 13.

TABLE 13

| Photosensitive Material No. | Degree of Color Turbidity (a) | (b) | (c) |
|---|---|---|---|
| 201 (Comparative Example) | 0.30 | 0.35 | 0.34 |
| 202 (This Invention) | 0.24 | 0.26 | 0.29 |

It is clear from the results outlined above that color turbidity is reduced and that the color reproduction properties are improved by using PUG releasing compounds of this present invention.

Illustrative examples of cases in which PUG releasing compounds which release dyes are used from among the compounds of this present invention are given below.

EXAMPLE 3

Color photosensitive material 301 of which the structure is shown in Table 14 was prepared using the photosensitive silver halide emulsion (II) of Example 1. Moreover, a gelatin dispersion prepared using the method outlined below was used for the PUG releasing compound (34) of this present invention.

Thus, 6 grams of high boiling point solvent (2) and 40 cc of ethyl acetate were added to 12 grams of PUG releasing compound (34) of this present invention and a solution was obtained by heating to about 60° C. A 10% aqueous lime treated gelatin solution (100 grams), 0.25 gram of sodium bisulfite, 0.3 gram of sodium dodecylbenzenesulfonate and 60 cc of water were added to this solution which was then dispersed for 10 minutes at 10,000 rpm in a homogenizer.

TABLE 14

| Layer Name | Additive | Amount Added ($g/m^2$) |
|---|---|---|
| Protective Layer | Gelatin | 1.00 |
| | Water soluble polymer (Note 3) | 0.02 |
| | Surfactant (Note 2) | 0.06 |
| | Film hardening agent (Note 8) | 0.02 |
| Emulsion Layer | Emulsion (II) | 0.25 as Ag |
| | Gelatin | 0.30 |
| | Anti-foggant (Note 9) | $1.0 \times 10^{-4}$ |
| | Compound (34) of this invention | 0.30 |
| | High boiling point solvent (2) | 0.15 |
| | Surfactant (Note 5) | 0.04 |
| | Water soluble polymer (Note 3) | 0.02 |
| Support: | (Poly(ethylene terephthalate): Thickness 100 μm) | |

On processing in the same way as described in Example 2 using the dye fixing material of Example 2, a negative magenta image of maximum density 2.1 and minimum density 0.35 was obtained on the dye fixing material.

Photosensitive materials 302 and 303 which had the same structure as photosensitive material 301 were prepared using PUG releasing compound (33) or compound (35) of this present invention in place of the compound (34) of this present invention used in photosensitive material 301. On processing in the same way as with photosensitive material 301, cyan and yellow negative images were obtained respectively on the dye fixing material.

The results demonstrated that the compounds of this present invention are useful as dye donating compounds.

EXAMPLE 4

Preparation of Photosensitive Emulsions

Emulsion A

An aqueous solution of silver nitrate and an aqueous solution of potassium iodide and potassium bromide were added simultaneously over a period of 60 minutes in the presence of $4\times10^{-7}$ mol/mol.Ag of potassium iridium(III) hexachloride and ammonia to an aqueous gelatin solution which was being maintained at 50° C. and, by maintaining a pAg value of 7.8 throughout this addition, a mono-disperse cubic emulsion of average grain size 0.28μ and average silver iodide content 0.3 mol % was obtained. This emulsion was de-salted using the flocculation method, after which 40 grams/gram-.Ag of inactive gelatin was added and then 5,5'-dichloro-9-ethyl-3,3'-bis(3-sulfopropyl)oxacarbocyanine as a sensitizing dye and $10^{-3}$ mol/mol.Ag of KI solution were added while maintaining a temperature of 50° C. and the temperature was lowered after ageing for 15 minutes.

Emulsion B

An aqueous silver nitrate solution and a mixed aqueous solution of sodium chloride and potassium bromide which contained $1.4\times10^{-7}$ mol/mol.Ag of hexachlororhodium(III) acid, ammonium salt, and $4\times10^{-7}$ mol/mol.Ag of hexachloroiridium(III) acid, potassium salt, were added simultaneously at a fixed rate over a period of 30 minutes to an aqueous gelatin solution of pH 4.0 which was being maintained at 50° C. and a silver chlorobromide mono-disperse emulsion (Cl content 70 mol %) of average grain size 0.23μ was obtained.

The emulsion was washed in the conventional way and, after removing the soluble salts, chemical sensitization was carried out with the addition of sodium thiosulfate and potassium chloroaurate. Further, conversion of the grains surface was carried out by adding a potassium iodide solution corresponding 0.1 mol % per mol of Ag. Moreover, the compound indicated below was added subsequently at a rate of $2.7\times10^{-4}$ mol/mol.Ag as a sensitizing dye and, after ageing for 15 minutes while maintaining a temperature of 50° C., the temperature was lowered.

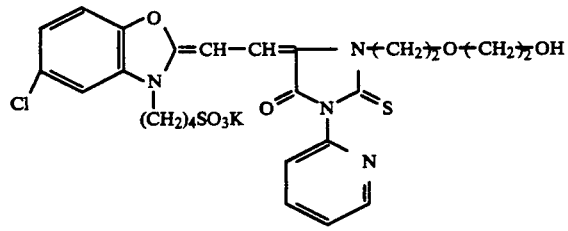

Preparation of Coated Samples

Support:

A poly(ethylene terephthalate) film (150μ) which had an under-layer (0.5μ) comprised of vinylidene chloride copolymer. Layers were coated into this support sequentially to provide the layer structure UL, ML, OL, PC from the support side. The preparation and coated weight of each layer is indicated below.

(UL)

The aforementioned emulsion B was melted at 40° C. together with gelatin and then 85 $mg/m^2$ of 5-methylbenzotriazole, 12 $mg/m^2$ of 4-hydroxy-1,3,3a,7-tetraazaindene, the compounds (i), (ii) and (iii) indicated below, 30 wt % with respect to the gelatin of poly(ethyl acrylate) and the compound (iv) indicated below as a film hardening agent were added and this was coated to provide Ag 3.6 $g/m^2$, $2.8\times10^{-5}$ $mol/m^2$ of the hydrazine compound (v) indicated below and 1.9 $g/m^2$ of gelatin.

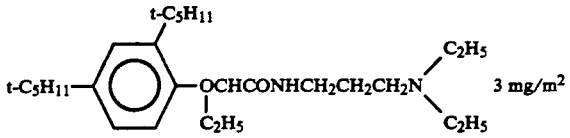

Compound (i)

-continued

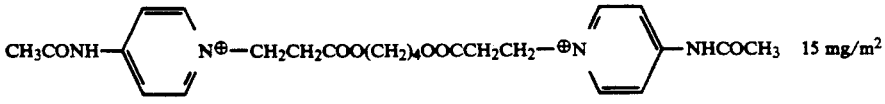

Compound (ii)

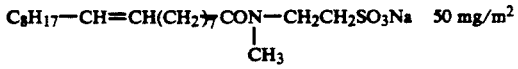

Compound (iii)

Hydrazine Compound (v)

Compound (iv)

(ML)

Gelatin (10 grams) and 2.0 wt % with respect to the gelatin of the aforementioned compound (iv) were

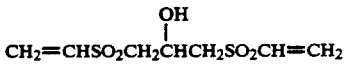

2.0 wt % with respect to the gelatin

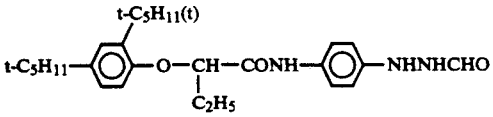

added, and then water was added to make up to a total volume of 250 ml and this was coated in such a way as to provide a gelatin coated weight of 1.5 g/m$^2$.

(PL)

The aforementioned emulsion A was melted at 40° C. and 3 mg/m$^2$ of 5-methybenzotriazole, 4-hydroxy-1,3,3a,7-tetra-azaindene, $3.5\times10^{-5}$ mol/m$^2$ of the PUG releasing compound of this present invention shown in Table 15, 0.4 mg/m$^2$ of compound (i), 1.5 mg/m$^2$ of compound (ii), 15 mg/m$^2$ of compound (iii), 30 wt % with respect to the gelatin of poly(ethyl acrylate) and 2 wt % with respect to the gelatin of compound (iv) as a gelatin film hardening agent were added. This was coated in such a way as to provide a coated silver weight of 0.4 g/m$^2$.

(PC)

A poly(methyl methacrylate) dispersion (average particle size 5.0μ) and the surfactants indicated below were added to a gelatin solution and this was coated in such a way as to provide coated weights of 1.5 g/m$^2$ of gelatin and 0.3 g/m$^2$ of poly(methyl methacrylate).

Surfactants

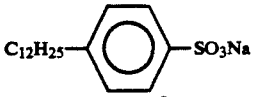

37 mg/m$^2$

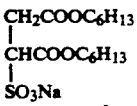

37 mg/m$^2$

-continued

Surfactants

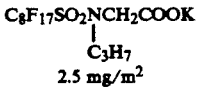

2.5 mg/m$^2$

Performance Evaluation

These samples were exposed through an optical wedge or an optical wedge and a contact screen (150L chain dot type, Fuji Film) using tungsten light of 3200° K., after which they were developed for 30 seconds at 34° C. in the developer indicated below, fixed, washed with water and dried.

GR-Fl made by the Fuji Photo Film Co., Ltd. was used for the fixer.

TABLE 15

| Developer | |
|---|---|
| Hydroquinone | 50.0 grams |
| N-Methyl-p-aminophenol | 0.3 gram |
| sodium hydroxide | 18.0 grams |
| 5-Sulfosalicylic acid | 55.0 grams |
| Potassium sulfite | 110.0 grams |
| Ethylenediamine tetra-acetic acid, di-sodium salt | 1.0 gram |
| Potassium bromide | 10.0 grams |
| 5-Methylbenzotriazole | 0.4 gram |
| 2-mercaptobenzimidazole-5-sulfonic acid | 0.3 gram |
| 3-(5-Mercaptotetrazole)benzenesulfonic acid, sodium salt | 0.2 gram |
| N-n-Butyldiethanolamine | 15.0 grams |
| Sodium toluenesulfonate | 8.0 grams |
| Water to make up to | 1 liter |
| pH (Adjusted with the addition of potassium hydroxide) | 11.6 |

The results obtained are shown in Table 16.

The gradation (gamma) is the gradient of the straight line joining the points of density 0.3 and 3.0 on the characteristic curve.

The screen gradation is represented by the following equation:

* Screen Gradation = Exposure which gives a screen dot area of 95% (log E 95%) − Exposure which gives a screen dot area of 5% (log E 5%).

The screen dot quality was assessed visually on a five point scale. A score of 5 indicates very good quality and a score of 1 indicates a very poor quality. A screen dot original for plate making can be used with a score of 5 or 4, a score of 3 is on the limit for practical use and a score of 2 or 1 indicates that the quality is such that it cannot be used in practice.

TABLE 16

| Sample Number | Compound | Photographic Performance | | |
|---|---|---|---|---|
| | | Gamma | Screen Dot Gradation | Screen Dot Quality |
| 401 (Comparative Example) | — | 15.3 | 1.18 | 5 |
| 402 (Comparative Example) | Comparative Compound A | 12.5 | 1.20 | 4 |
| 403 (Comparative Example) | Comparative Compound B | 10.0 | 1.24 | 5 |
| 404 (This Invention) | Compound (3) of this invention | 13.2 | 1.30 | 5 |
| 405 (This Invention) | Compound (17) of this invention | 11.9 | 1.28 | 5 |

Comparative Compound A

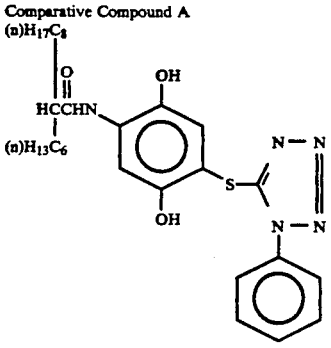

Comparative Compound B

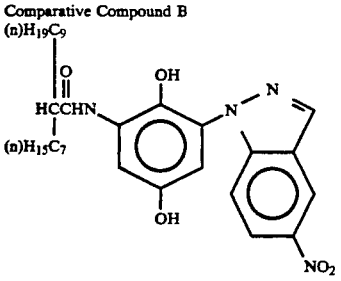

It is clear from the results shown in Table 16 that a photosensitive material of this present invention has a high gamma value and a wide screen gradation, and provides images which have a good screen dot quality.

EXAMPLE 5

A multi-layer color photosensitive material comprised of the layers of which the compositions are indicated below was prepared on a cellulose triacetate film support of thickness 127μ on which an under-layer had been established, and this was designated as sample 501. The numbers indicate the amounts added per square meter. Moreover, the effect of the compounds added is not necessarily limited to the application cited.

| | |
|---|---|
| **First Layer: Anti-halation Layer** | |
| Black colloidal silver | 0.25 gram |
| Gelatin | 1.9 grams |
| Ultraviolet absorber U-1 | 0.04 gram |
| Ultraviolet absorber U-2 | 0.1 gram |
| Ultraviolet absorber U-3 | 0.1 gram |
| Ultraviolet absorber U-4 | 0.1 gram |
| Ultraviolet absorber U-6 | 0.1 gram |
| High boiling point organic solvent Oil-1 | 0.1 gram |
| **Second Layer: Intermediate Layer** | |
| Gelatin | 0.40 gram |
| Compound Cpd-D | 6 mg |
| High boiling point organic solvent Oil-3 | 0.1 gram |
| Dye D-4 | 0.4 mg |
| **Third Layer: Intermediate Layer** | |
| A fine grained silver iodobromide emulsion of which the surface and interior had been fogged (average gain size 0.06 μm, variation coefficient 18%, AgI content 1 mol %) | 0.05 gram as silver |
| Gelatin | 0.4 gram |

-continued

| | |
|---|---|
| **Fourth Layer: Low Speed Red Sensitive Emulsion Layer** | |
| Emulsion A | 0.2 gram as silver |
| Emulsion B | 0.3 gram as silver |
| Gelatin | 0.8 gram |
| Coupler C-1 | 0.15 gram |
| Coupler C-2 | 0.05 gram |
| Coupler C-9 | 0.05 gram |
| Compound Cpd-D | 6 mg |
| High boiling point organic solvent Oil-2 | 0.1 gram |
| **Fifth Layer: Medium Speed Red Sensitive Emulsion Layer** | |
| Emulsion B | 0.2 gram as silver |
| Emulsion C | 0.3 gram as silver |
| Gelatin | 0.8 gram |
| Coupler C-1 | 0.2 gram |
| Coupler C-2 | 0.05 gram |
| Coupler C-3 | 0.2 gram |
| High boiling point organic solvent Oil-2 | 0.1 gram |
| **Sixth Layer: High Speed Red Sensitive Emulsion Layer** | |
| Emulsion D | 0.4 gram as silver |
| Gelatin | 1.1 grams |
| Coupler C-1 | 0.3 gram |
| Coupler C-3 | 0.7 gram |
| Additive P-1 | 0.1 gram |
| **Seventh Layer: Intermediate Layer** | |
| Gelatin | 0.6 gram |
| Compound M-1 | 0.3 gram |
| Anti-color mixing agent Cpd-K | 2.6 mg |
| Ultraviolet absorber U-1 | 0.1 gram |
| Ultraviolet absorber U-6 | 0.1 gram |
| Dye D-1 | 0.02 gram |
| **Eighth Layer: Intermediate Layer** | |
| A fine grained silver iodobromide emulsion of which the surface and interior had been fogged (average | 0.02 gram as silver |

-continued

| | |
|---|---|
| gain size 0.06 μm, variation coefficient 16%, AgI content 0.3 mol %) | |
| Gelatin | 1.0 gram |
| Additive P-1 | 0.2 gram |
| Anti-color mixing agent Cpd-J | 0.1 gram |
| Anti-color mixing agent Cpd-A | 0.1 gram |
| Ninth Layer: Low Speed Green Sensitive Emulsion Layer | |
| Emulsion E | 0.3 gram as silver |
| Emulsion F | 0.1 gram as silver |
| Emulsion G | 0.1 gram as silver |
| Gelatin | 0.5 gram |
| Coupler C-7 | 0.05 gram |
| Coupler C-8 | 0.20 gram |
| Compound Cpd-B | 0.03 gram |
| Compound Cpd-D | 6 mg |
| Compound Cpd-E | 0.02 gram |
| Compound Cpd-F | 0.02 gram |
| Compound Cpd-G | 0.02 gram |
| Compound Cpd-H | 0.02 gram |
| High boiling point organic solvent Oil-1 | 0.1 gram |
| High boiling point organic solvent Oil-2 | 0.1 gram |
| Tenth Layer: Medium Speed Green Sensitive Emulsion Layer | |
| Emulsion G | 0.3 gram as silver |
| Emulsion H | 0.1 gram as silver |
| Gelatin | 0.6 gram |
| Coupler C-7 | 0.2 gram |
| Coupler C-8 | 0.1 gram |
| Compound Cpd-B | 0.03 gram |
| Compound Cpd-E | 0.02 gram |
| Compound Cpd-F | 0.02 gram |
| Compound Cpd-G | 0.05 gram |
| Compound Cpd-H | 0.05 gram |
| High boiling point organic solvent Oil-2 | 0.01 gram |
| Eleventh Layer: High Speed Green Sensitive Emulsion Layer | |
| Emulsion I | 0.5 gram as silver |
| Gelatin | 1.0 gram |
| Coupler C-4 | 0.3 gram |
| Coupler C-8 | 0.1 gram |
| Compound Cpd-B | 0.08 gram |
| Compound Cpd-E | 0.02 gram |
| Compound Cpd-F | 0.02 gram |
| Compound Cpd-G | 0.02 gram |
| Compound Cpd-H | 0.02 gram |
| High boiling point organic solvent Oil-1 | 0.02 gram |
| High boiling point organic solvent Oil-2 | 0.02 gram |
| Twelfth Layer: Intermediate Layer | |
| Gelatin | 0.6 gram |
| Dye D-1 | 0.1 gram |
| Dye D-2 | 0.05 gram |
| Dye D-3 | 0.07 gram |
| Thirteenth Layer: Yellow Filter Layer | |
| Yellow colloidal silver | 0.1 gram as silver |
| Gelatin | 1.1 gram |
| Anti-color mixing agent Cpd-A | 0.01 gram |
| High boiling point organic solvent Oil-1 | 0.01 gram |
| Fourteenth Layer: Intermediate Layer | |
| Gelatin | 0.6 gram |
| Fifteenth Layer: Low Speed Blue Sensitive Emulsion Layer | |

-continued

| | |
|---|---|
| Emulsion J | 0.4 gram as silver |
| Emulsion K | 0.1 gram as silver |
| Emulsion L | 0.1 gram as silver |
| Gelatin | 0.8 gram |
| Coupler C-5 | 0.6 gram |
| Sixteenth Layer: Medium Speed Blue Sensitive Emulsion Layer | |
| Emulsion L | 0.1 gram as silver |
| Emulsion M | 0.4 gram as silver |
| Gelatin | 0.9 gram |
| Coupler C-5 | 0.3 gram |
| Coupler C-6 | 0.3 gram |
| Seventeenth Layer: High Speed Blue Sensitive Emulsion Layer | |
| Emulsion N | 0.4 gram as silver |
| Gelatin | 1.2 grams |
| Coupler C-6 | 0.7 gram |
| Eighteenth Layer: First Protective Layer | |
| Gelatin | 0.7 gram |
| Ultraviolet absorber U-1 | 0.04 gram |
| Ultraviolet absorber U-2 | 0.01 gram |
| Ultraviolet absorber U-3 | 0.03 gram |
| Ultraviolet absorber U-4 | 0.03 gram |
| Ultraviolet absorber U-5 | 0.05 gram |
| Ultraviolet absorber U-6 | 0.05 gram |
| High boiling point organic solvent Oil-1 | 0.02 gram |
| Formalin scavengers | |
| Cpd-C | 0.2 gram |
| Cpd-1 | 0.4 gram |
| Dye D-3 | 0.05 gram |
| Nineteenth Layer: Second Protective Layer | |
| Colloidal silver | 0.1 mg as silver |
| Fine grained silver iodobromide emulsion (average grain size 0.06 μm, AgI content 1 mol %) | 0.1 gram as silver |
| Gelatin | 0.4 gram |
| Twentieth Layer: Third Protective Layer | |
| Gelatin | 0.4 gram |
| Poly(methyl methacrylate) (average particle size 1.5μ) | 0.1 gram |
| Methyl methacrylate/acrylic acid (4:6) copolymer (average particle size 1.5μ) | 0.1 gram |
| Silicone oil | 0.03 gram |
| Surfactant W-1 | 3.0 mg |
| Surfactant W-2 | 0.03 gram |

Furthermore, additives F-1 to F-8 were added to all of the emulsion layers in addition to the components indicated above. Moreover, a gelatin hardening agent H-1 and the surfactants W-3 and W-4 for coating purposes were added to each layer in addition to the components indicated above.

Moreover, phenol, 1,2-benzisothiazolin-3-one, 2-phenoxyethanol and phenethyl alcohol were added as biocides and fungicides.

The silver iodobromide emulsions used in sample 501 are indicated below.

TABLE 17

| Emulsion | | Average Grain Size (μm) | Variation Coefficient (%) | AgI Content (%) |
|---|---|---|---|---|
| A | Mono-disperse tetradecahedral grains | 0.25 | 16 | 3.7 |
| B | Mono-disperse cubic internal latent image type grains | 0.30 | 10 | 3.3 |
| C | Mono-disperse tetradecahedral grains | 0.30 | 18 | 5.0 |
| D | Poly-disperse twinned crystal grains | 0.60 | 25 | 2.0 |
| E | Mono-disperse cubic grains | 0.17 | 17 | 4.0 |
| F | Mono-disperse cubic grains | 0.20 | 16 | 4.0 |

TABLE 17-continued

| Emulsion | | Average Grain Size (μm) | Variation Coefficient (%) | AgI Content (%) |
|---|---|---|---|---|
| G | Mono-disperse cubic internal latent image type grains | 0.25 | 11 | 3.5 |
| H | Mono-disperse cubic internal latent image type grains | 0.30 | 9 | 3.5 |
| I | Poly-disperse tabular grains, average aspect ratio 4.0 | 0.80 | 28 | 1.5 |
| J | Mono-disperse tetradecahedral grains | 0.30 | 18 | 4.0 |
| K | Mono-disperse tetradecahedral grains | 0.37 | 17 | 4.0 |
| L | Mono-disperse cubic internal latent image type grains | 0.46 | 14 | 3.5 |
| M | Mono-disperse cubic grains | 0.55 | 13 | 4.0 |
| N | Poly-disperse tabular grains, average aspect ratio 7.0 | 1.00 | 33 | 1.3 |

TABLE 18

Spectral Sensitization of Emulsions A to N

| Emulsion | Sensitizing Dye Added | Amount Added per Mol Silver Halide | Time At Which Sensitizing Dye Was Added |
|---|---|---|---|
| A | S-1 | 0.025 | Immediately after chemical sensitization |
| | S-2 | 0.25 | Immediately after chemical sensitization |
| B | S-1 | 0.01 | Immediately after the end of grain formation |
| | S-2 | 0.25 | Immediately after the end of grain formation |
| C | S-1 | 0.02 | Immediately after chemical sensitization |
| | S-2 | 0.25 | Immediately after chemical sensitization |
| D | S-1 | 0.01 | Immediately after chemical sensitization |
| | S-2 | 0.10 | Immediately after chemical sensitization |
| | S-7 | 0.01 | Immediately after chemical sensitization |
| E | S-3 | 0.5 | Immediately after chemical sensitization |
| | S-4 | 0.1 | Immediately after chemical sensitization |
| F | S-3 | 0.3 | Immediately after chemical sensitization |
| | S-4 | 0.1 | Immediately after chemical sensitization |
| G | S-3 | 0.25 | Immediately after the end of grain formation |
| | S-4 | 0.08 | Immediately after the end of grain formation |
| H | S-3 | 0.2 | During grain formation |
| | S-4 | 0.06 | During grain formation |
| I | S-3 | 0.3 | Immediately before start of chemical sensitization |
| | S-4 | 0.07 | Immediately before start of chemical sensitization |
| | S-8 | 0.1 | Immediately before start of chemical sensitization |
| J | S-6 | 0.2 | During grain formation |
| | S-5 | 0.05 | During grain formation |
| K | S-6 | 0.2 | During grain formation |
| | S-5 | 0.05 | During grain formation |
| L | S-6 | 0.22 | Immediately after the end of grain formation |
| | S-5 | 0.06 | Immediately after the end of grain formation |
| M | S-6 | 0.15 | Immediately after chemical sensitization |
| | S-5 | 0.04 | Immediately after chemical sensitization |
| N | S-6 | 0.22 | Immediately after the end of grain formation |
| | S-5 | 0.06 | Immediately after the end of grain formation |

C-1

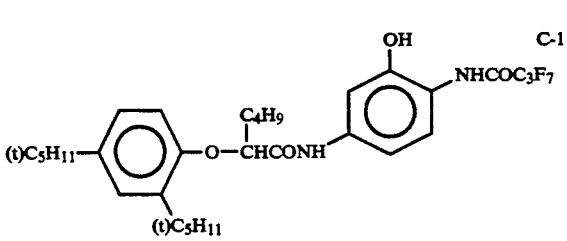

C-2

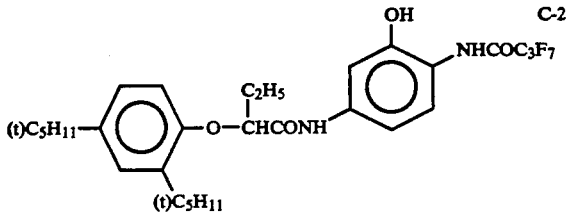

-continued

C-3

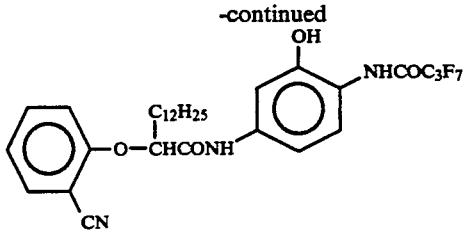

-continued
C-4
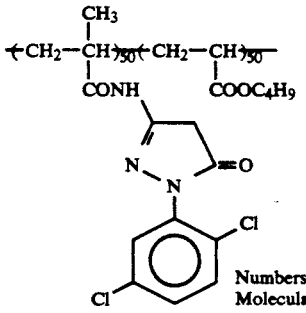
Numbers indicate wt % Average Molecular Weight: About 25,000
C-5
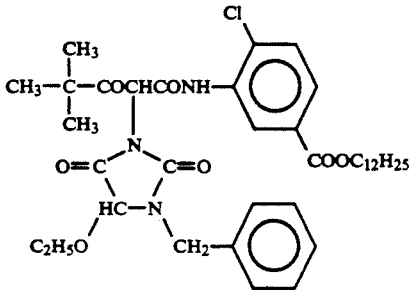
C-6
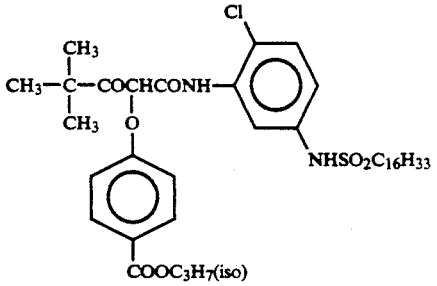
C-7
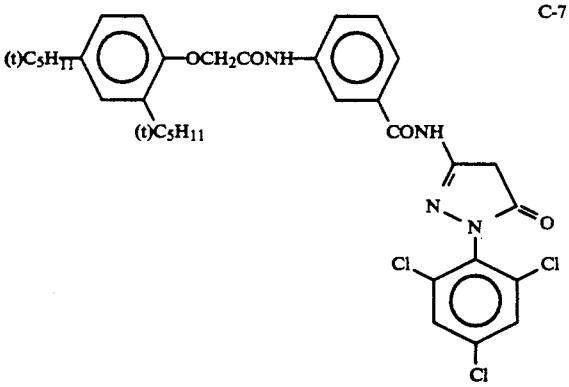
C-8
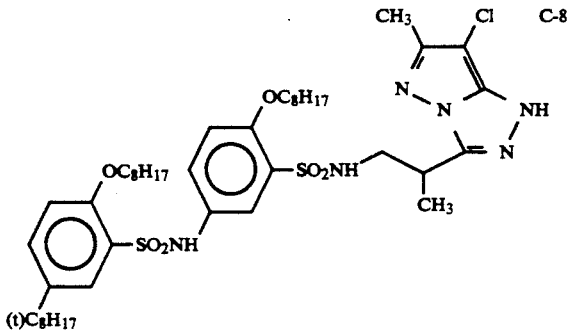
-continued
C-9
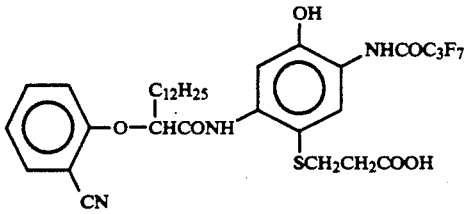
Dibutyl phthalate — Oil-1
Tricresyl phosphate — Oil-2
Oil-3
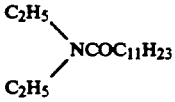
Cpd-A
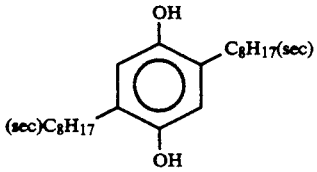
Cpd-B
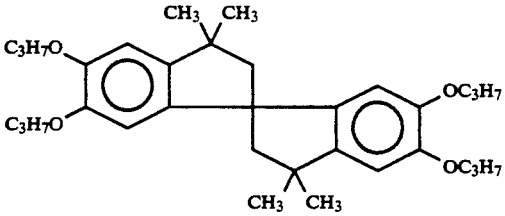
Cpd-C
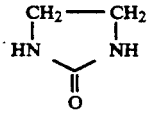
Cpd-D
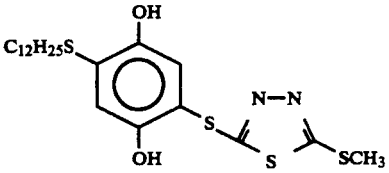
Cpd-E
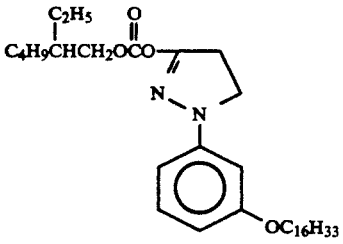

-continued
Cpd-F
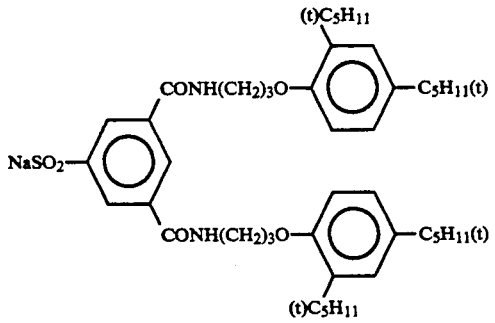
Cpd-G
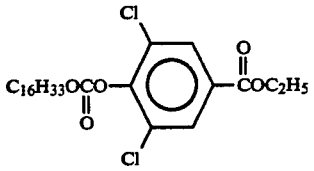
Cpd-H
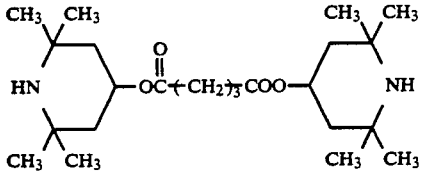
Cpd-I
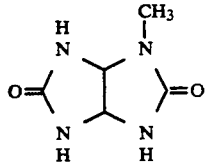
Cpd-J
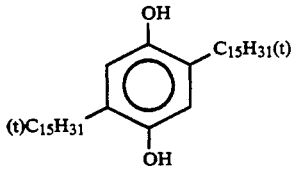
Cpd-K
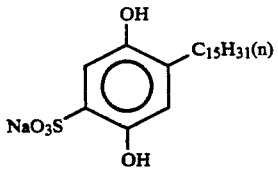
U-1
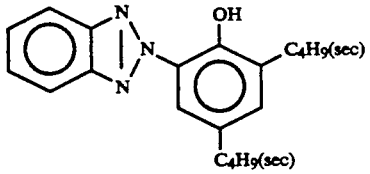
U-2
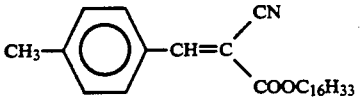
-continued
U-3
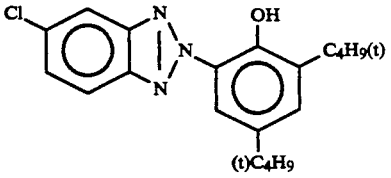
U-4
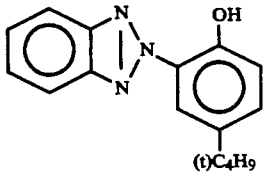
U-5
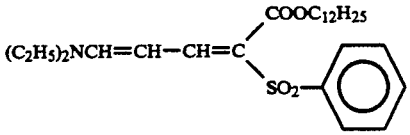
U-6
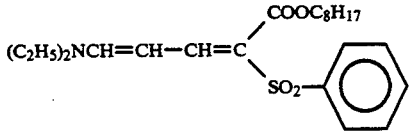
S-1
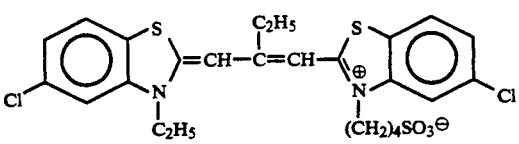
S-2
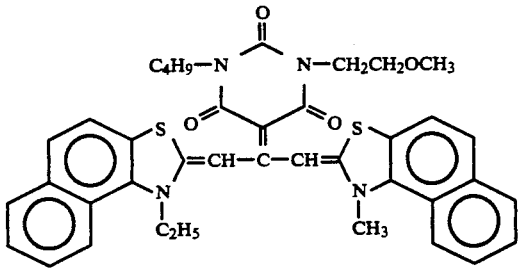
S-3
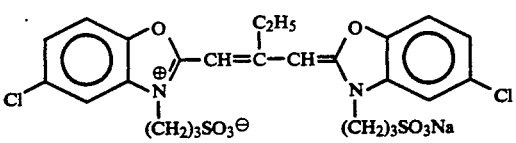
S-4
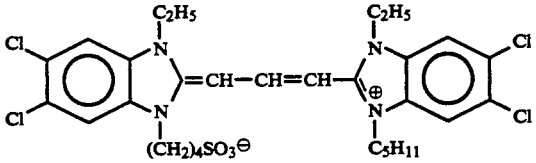
S-5
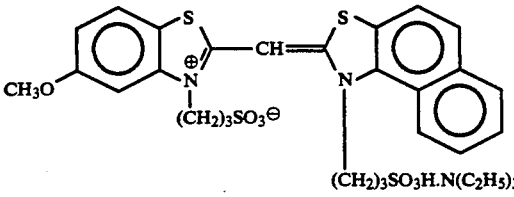

-continued
S-6
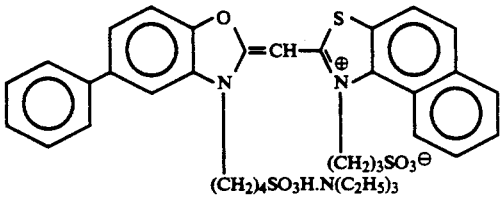
S-7
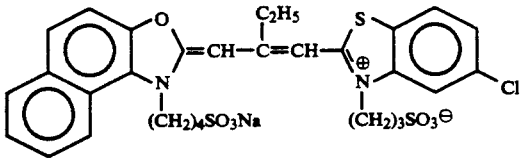
S-8
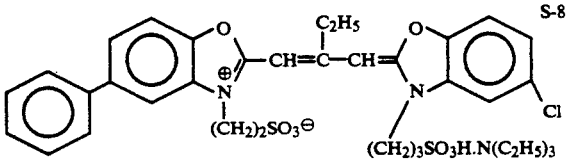
D-1
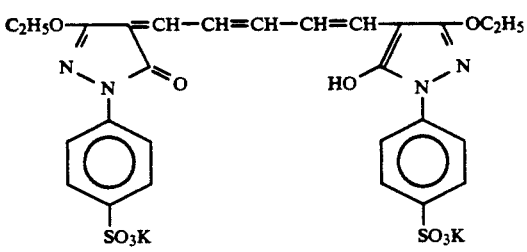
D-2
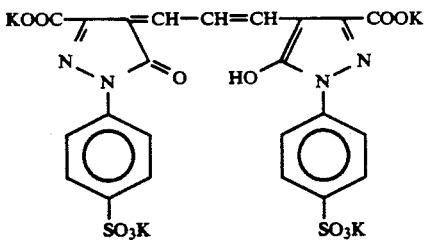
D-3
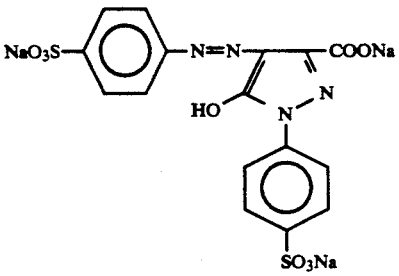
-continued
D-4
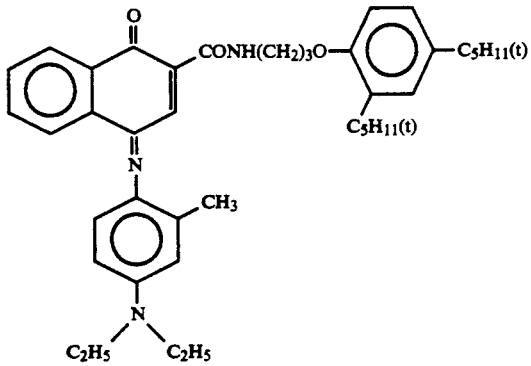
H-1
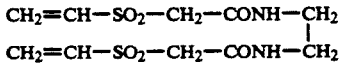
W-1
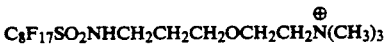
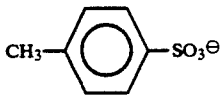
W-2
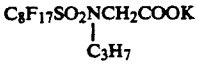
W-3
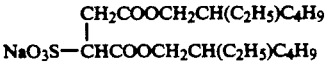
W-4
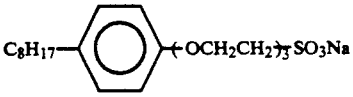
P-1
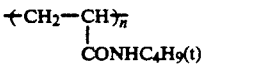
M-1
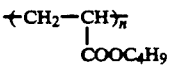
F-1
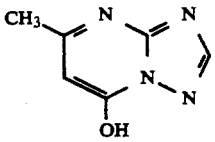
F-2
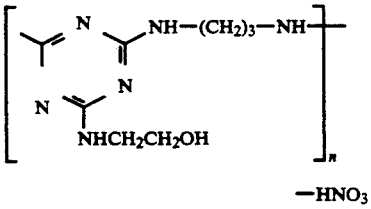
F-3
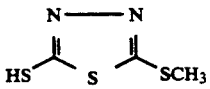

-continued

F-4

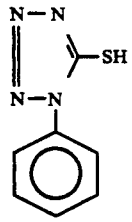

F-5

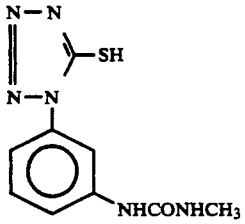

F-6

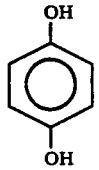

F-6

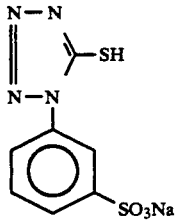

F-8

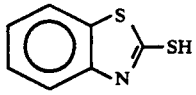

Photosensitive material 502 was obtained in the same way as photosensitive material 501 except that PUG releasing compound (7) of this present invention was used in an equimolar amount with respect to compound Cpd-D in place of the compound Cpd-D per se in the second, fourth and ninth layers of photosensitive material 501.

Samples 501 and 502 were exposed and then subjected to the development processes A and B indicated below. The sharpness was obtained by measuring the sharpness of the processed image and it was assessed using the MTF value.

The results obtained are shown in Table 19.

A higher value indicates a more desirable sharpness.

| Processing Operation | Time (min) | Temp. (°C.) | Tank Capacity (liters) | Replenishment Rate (l/m²) |
|---|---|---|---|---|
| Black & White Development | 6 | 38 | 12 | 2.2 |
| First Water Wash | 2 | 38 | 4 | 7.5 |
| Reversal | 2 | 38 | 4 | 1.1 |
| Color Development | 6 | 38 | 12 | 2.2 |
| Conditioning | 2 | 38 | 4 | 1.1 |
| Bleach-fix | 6 | 38 | 12 | 1.3 |

-continued

| Processing Operation | Time (min) | Temp. (°C.) | Tank Capacity (liters) | Replenishment Rate (l/m²) |
|---|---|---|---|---|
| Second Water Wash (1) | 2 | 38 | 4 | — |
| Second Water Wash (2) | 2 | 38 | 4 | 7.5 |
| Stabilization | 2 | 38 | 4 | 1.1 |
| Third Water Wash | 1 | 38 | 4 | 7.5 |

The overflow from the second water wash (2) bath was fed into the second water wash (1) bath.

The composition of each processing bath was as indicated below.

| Black and White Developer | Parent Bath | Replenisher |
|---|---|---|
| Nitrilo-N,N,N-trimethylene phosphonic acid, penta-sodium salt | 2.0 grams | 2.0 grams |
| Diethylenetriamine penta-acetic acid, penta-sodium salt | 3.0 grams | 3.0 grams |
| Potassium sulfite | 30.0 grams | 30.0 grams |
| Hydroquinone monosulfonic acid, potassium salt | 20.0 grams | 20.0 grams |
| Potassium carbonate | 33.0 grams | 33.0 grams |
| 1-Phenyl-4-methyl-4-hydroxy methyl-3-pyrazolidone | 2.0 grams | 2.0 grams |
| Potassium bromide | 2.5 grams | 1.4 grams |
| Potassium thiocyanate | 1.2 grams | 1.2 grams |
| Potassium iodide | 2.0 mg | 2.0 mg |
| Water to make up to | 1.0 liter | 1.0 liter |
| pH (25° C.) | 9.60 | 9.70 |

The pH was adjusted with hydrochloric acid or potassium hydroxide.

| Reversal Bath | Parent Bath | Replenisher |
|---|---|---|
| Nitrilo-N,N,N-trimethylene phosphonic acid, penta-sodium salt | 3.0 grams | Same as Parent Bath |
| Stannous chloride, di-hydrate | 1.0 gram | |
| p-Aminophenol | 0.1 gram | |
| Sodium hydroxide | 8.0 grams | |
| Glacial acetic acid | 15.0 ml | |
| Water to make up to | 1.0 liter | |
| pH (25° C.) | 6.00 | |

The pH was adjusted with hydrochloric acid or sodium hydroxide.

| Color Developer | Parent Bath | Replenisher |
|---|---|---|
| Nitrilo-N,N,N-trimethylene phosphonic acid, penta-sodium salt | 2.0 grams | 2.0 grams |
| Diethylenetriamine penta-acetic acid, penta-sodium salt | 2.0 grams | 2.0 grams |
| Sodium sulfite | 7.0 grams | 7.0 grams |
| Tri-potassium phosphate, dodecahydrate | 36.0 grams | 36.0 grams |
| Potassium bromide | 1.0 gram | — |
| Potassium iodide | 90.0 mg | — |
| Sodium hydroxide | 3.0 grams | 3.0 grams |
| Citrazinic acid | 1.5 grams | 1.5 grams |
| N-Ethyl-(β-methanesulfonamidoethyl)-3-methyl-4-aminoaniline sulfate | 10.5 grams | 10.5 grams |

-continued

| Color Developer | Parent Bath | Replenisher |
|---|---|---|
| 3,6-Dithiaoctane-1,8-diol | 3.5 grams | 3.5 grams |
| Water to make up to | 1.0 liter | 1.0 liter |
| pH (25° C.) | 11.90 | 12.05 |

The pH was adjusted with hydrochloric acid or potassium hydroxide.

| Conditioner | Parent Bath | Replenisher |
|---|---|---|
| Ethylenediamine tetra-acetic acid, di-sodium salt, di-hydrate | 8.0 grams | Same as Parent Bath |
| Sodium sulfite | 12.0 grams | |
| 2-mercapto-1,3,4-triazole | 0.5 gram | |
| TWEEN 20# | 2.0 ml | |
| Water to make up to | 1.0 liter | |
| pH (25° C) | 6.20 | |

The pH was adjusted with hydrochloric acid or sodium hydroxide.

TWEEN 20#: A surfactant made by ICI American Inc.

| Bleach-Fixer | Parent Bath | Replenisher |
|---|---|---|
| Ethylenediamine tetra-acetic acid, di-sodium salt, di-hydrate | 2.0 grams | Same as Parent Bath |
| Ethylenediamine tetra-acetic acid, ferric ammonium salt, di-hydrate | 70.0 grams | |
| Ammonium thiosulfate (700 g/l) | 200.0 grams | |
| Ammonium sulfite | 20.0 grams | |
| Water to make up to | 1.0 liter | |
| pH (25° C.) | 6.60 | |

The pH was adjusted with acetic acid or aqueous ammonia.

| Stabilizer | Parent Bath | Replenisher |
|---|---|---|
| Ethylenediamine tetra-acetic acid, di-sodium salt, di-hydrate | 1.0 gram | Same as Parent Bath |
| Imidazole | 1.0 gram | |
| Dimethylol urea | 8.0 grams | |
| Water to make up to | 1.0 liter | |
| pH (25° C.) | 7.50 | |

The pH was adjusted with acetic acid or aqueous ammonia.

Process B

Process B was just the same as process A except that the ethylenediamine tetra-acetic acid, di-sodium salt, dihydrate, in the bleach-fixer in process A was replaced by 1,3-diaminopropane tetra-acetic acid and the ethylenediamine tetra-acetic acid ferric ammonium salt, dihydrate, in the bleach-fixer used in process A was replaced with 1,3-diaminopropane tetra-acetic acid, ferric ammonium salt, monohydrate.

TABLE 19

| | Process A | | Process B | |
|---|---|---|---|---|
| Sample No. | 10 cycles/mm | 20 cycles/mm | 10 cycles/mm | 20 cycles/mm |
| 501 (Comparative Example) | 1.09 | 0.84 | 1.10 | 0.85 |
| 502 (Invention) | 1.19 | 0.90 | 1.19 | 0.91 |

It is clear from table 19 that the photosensitive material in which a compound of this present invention has been used has excellent sharpness.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support, having thereon at least one silver halide emulsion layer, wherein there is contained in the silver halide emulsion layer or other hydrophilic colloid layer a compound of which an oxidized form is produced in accordance with development of silver halide and is capable of releasing a photographically useful group by means of a conjugated addition-elimination mechanism due to an intramolecular nucleophilic group attack, wherein said compound is represented by formula (I-1) or (I-2):

General Formula (I-1)

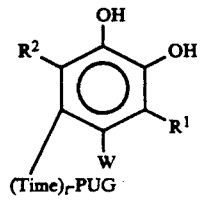

General Formula (I-2)

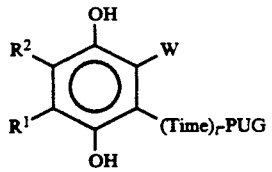

wherein Time represents a timing group, t represents 0 or 1, PUG represents a photographically useful group, W represents a nucleophilic group represented by —Y—X—H wherein Y represents a divalent linking group, X represents

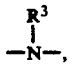

—O—, or —S—, wherein $R^3$ represents a hydrogen atom, an alkyl group, an aryl group, a heterocyclic group or an acyl group, $R^1$ and $R^2$ are the same or different and each represents a hydrogen atom, a halogen atom, a cyano group, a carboxyl group, a sulfo group, a nitro group, an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, an acyl group, a heterocyclic group or -(Time)-PUG and wherein $R^1$ and $R^2$ may be joined together to form a carbocyclic group or heterocyclic ring in Formula (I-2).

2. A silver halide photographic material as in claim 1, wherein the total number of atoms in the linear chain part which are included in Y and X, excluding the terminal hydrogen atoms therein, in group W is from 3 to 8.

3. A silver halide photographic material as in claim 1, wherein W is a group represented by formula (i) or (ii):

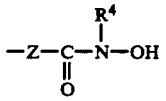

(i)

-continued

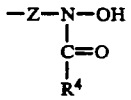

(ii)

wherein $R^4$ represents an alkyl group, an aryl group or a heterocyclic group and Z represents a divalent linking group.

4. A silver halide photographic material as in claim 2 wherein W is a group represented by formula (i) or (ii):

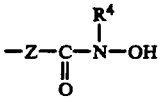

(i)

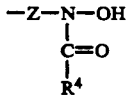

(ii)

wherein $R^4$ represents an alkyl group, an aryl group or a heterocyclic group and Z represents a divalent linking group.

5. A silver halide photographic material as in claim 3, wherein Z is an alkylene group or an oxyalkylene group containing 1 to 30 carbon atoms.

* * * * *